US011668066B2

(12) United States Patent
Moyher

(10) Patent No.: US 11,668,066 B2
(45) **Date of Patent: *Jun. 6, 2023**

(54) FORMING, DRAINAGE AND VENTILATION SYSTEM FOR AGRICULTURE, IRRIGATION AND ATHLETIC FIELDS

(71) Applicant: DRFF, LLC, Shelton, CT (US)

(72) Inventor: Charles Moyher, Chesire, CT (US)

(73) Assignee: DRFF, LLC, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/133,748

(22) Filed: Dec. 24, 2020

(65) Prior Publication Data

US 2021/0189683 A1 Jun. 24, 2021

Related U.S. Application Data

(63) Continuation of application No. 16/793,458, filed on Feb. 18, 2020, now abandoned, which is a continuation of application No. PCT/US2018/000367, filed on Aug. 20, 2018, application No. 17/133,748 is a continuation-in-part of application No. 15/971,247, filed on May 4, 2018, now Pat. No. 11,008,750, said application No. PCT/US2018/000367 is a continuation-in-part of application No. 15/971,247, filed on May 4, 2018, (Continued)

(51) Int. Cl.

| | |
|---|---|
| ***E02D 31/02*** | (2006.01) |
| ***E02D 27/01*** | (2006.01) |
| ***E04B 1/70*** | (2006.01) |

(52) U.S. Cl.

CPC ..... *E02D 31/02* (2013.01); *E02D 27/01* (2013.01); *E04B 1/7069* (2013.01)

(58) Field of Classification Search

CPC ..... E04B 1/70; E04B 1/7061; E04B 1/703; E04B 1/7023; E04B 1/7069; E02D 31/02; E02D 27/01; E04G 9/10

USPC ..... 52/169.5, 302.1, 302.3, 302.4, 900; 249/3, 4, 5, 6, 7, 34, 216, 218; 454/909

See application file for complete search history.

(56) References Cited

U.S. PATENT DOCUMENTS 5,474,400 A * 12/1995 Kliefoth ..... E02D 31/00 405/229

5,884,439 A * 3/1999 Hess, III ..... E02D 27/02 52/169.5

(Continued)

*Primary Examiner* — Michael Safavi

(74) *Attorney, Agent, or Firm* — Dilworth IP, LLC

(57) ABSTRACT

A system for retaining a flowable and curable building material to form a portion of a foundation includes side walls disposed in a predetermined configuration having a first side wall and a second side wall, and at least one component having an interior cavity disposed in one of the side walls. A bracket assembly includes an outwardly bounding reinforcement post for each of the side walls, a separator bar having a plurality of apertures sized to receive and retain each of the reinforcement posts at locations corresponding to nominal widths of the at least one component. A barrier is disposed between the outwardly bounding posts. The barrier and the component in the side wall is retained in the foundation after the building material cures. The barrier prevents backfill from filling a volume between the outwardly bounding posts.

22 Claims, 52 Drawing Sheets

Related U.S. Application Data now Pat. No. 11,008,750, which is a continuation of application No. PCT/US2016/000093, filed on Nov. 7, 2016.

(60) Provisional application No. 62/547,441, filed on Aug. 18, 2017, provisional application No. 62/394,368, filed on Sep. 14, 2016, provisional application No. 62/251,264, filed on Nov. 5, 2015.

(56) References Cited

U.S. PATENT DOCUMENTS 6,706,096 B2 * 3/2004 Sanglerat ..... B01D 46/30 405/128.2
7,832,156 B2 * 11/2010 Trotter ..... E04B 1/7023 52/169.5
7,866,097 B1 * 1/2011 Moyher ..... E02D 27/02 454/909

* cited by examiner

FIG. 18C

| Example Filter Geotextile Properties (FABRIC 610B, 710B, 860) | | | |
|---|---|---|---|
| Grab Tensile Properties (strength) | ASTM D4632 | pounds force | MD: >100<br>TD: > 100 |
| Grab tensile Properties (elongation at maximum load) | | % | MD: >50<br>TD: >50 |
| CBR Puncture Strength | ASTM D6241 | pounds force | >200 |
| Apparent Opening Size | ASTM D4751 | mm | <0.400 |
| | | US Standard Sieve Size | 40 |
| Permittivity | ASTM D4491 | $sec^{-1}$ | >1.8 |
| Flow Rate | | $gal/min/ft^2$ | >140 |
| Permeability | | cm/sec | >0.08 |
| | | | |

870

| Example Cuspated Core Hydraulic Properties (Core 650,660,750,760,850) | | | | |
|---|---|---|---|---|
| Cusp Height (in) | Hydraulic Gradient (slope) | L/s | LPM | Gal/min/ft width |
| 0.5 | 0.025 | 0.22 | 13.3 | 3.5 |
| | 0.05 | 0.31 | 18.7 | 4.9 |
| | 0.1 | 0.45 | 27.1 | 7.2 |
| | 0.25 | 0.71 | 42.9 | 11.3 |
| | 0.5 | 1.05 | 63 | 16.7 |
| | 1 | 1.50 | 90 | 23.8 |
| | | | | |
| 1 | 0.01 | 0.28 | 16.7 | 4.4 |
| | 0.025 | 0.43 | 26 | 6.9 |
| | 0.04 | 0.58 | 35 | 9.2 |
| | 0.12 | 1.05 | 63.2 | 16.7 |
| | 0.5 | 2.21 | 132 | 35 |
| | 1 | 3.14 | 188 | 49.5 |

880

Agriculture, Golf Courses, Synthetic Fields (but not limited to)

220' long - Centerline at 110', expansion starts at centerline.
Then 8' each way off center line
*approx 6' off both ends last expansion joint.

FORMING, DRAINAGE AND VENTILATION SYSTEM FOR AGRICULTURE, IRRIGATION AND ATHLETIC FIELDS

CROSS REFERENCE TO RELATED APPLICATIONS

This application is a continuation application of U.S. Continuation patent application Ser. No. 16/793,458, filed on Feb. 18, 2020, now abandoned, which claims the benefit of International Patent Application Ser. No. PCT/US2018/000367, filed on Aug. 20, 2018, now expired, which claims the benefit as a continuation-in-part of U.S. Non-Provisional patent application Ser. No. 15/971,247, filed on May 4, 2018, now U.S. Pat. No. 11,008,750, and of U.S. Provisional Patent Application Ser. No. 62/547,441, filed on Aug. 18, 2017, now expired. This application is also a continuation-in-part application of the aforementioned U.S. Non-Provisional patent application Ser. No. 15/971,247, filed on May 4, 2018, now U.S. Pat. No. 11,008,750, which is a continuation application of International Patent Application Ser. No. PCT/US2016/000093, filed on Nov. 7, 2016, now expired, which claims the benefit of U.S. Provisional Patent Application Ser. Nos. 62/251,264, filed on Nov. 5, 2015, and 62/394,368, filed on Sep. 14, 2016, now expired. The disclosures of the aforementioned International and U.S. patent documents are incorporated herein by reference in their entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the United States Patent and Trademark Office files or records, but otherwise reserves all copyright rights whatsoever.

BACKGROUND OF THE INVENTION

1. Field of the Invention

This invention relates generally to a form system used to build structural components such as, for example, a footing or foundation for a structure, by retaining a volume of at least partially liquid and curable building material, and when cured, the form system is integral within the structural component to provide drainage, ventilation and/or mitigation or remediation of unhealthily conditions cause by poor air flow, unwanted gases, moisture and the like, around and within the structure. In some aspects, the form system, and components included therein, provides a conduit or duct that acts as a thermal barrier and/or passage for air and liquid flow to improve drainage, insulation and ventilation. In embodiments, the form system and its components, used within the form system and as standalone components, provide forming, drainage and ventilation in applications that include, for example, agriculture, irrigation, bridges, sidewalks, roadways, mining, athletic fields and special purpose landscapes such as a golf course or so called "green roofs" for structures that comprise at least partially vegetation and a growing medium.

2. Description of Related Art

As noted in commonly owned U.S. Pat. No. 7,866,097, commonly owned U.S. Pat. No. 8,627,615, and commonly owned U.S. Pat. No. 9,228,365, conventional form systems are known to receive and to maintain a volume of concrete and/or other at least partially liquid building material in place while the building material cures over time. Once cured, the form system is typically removed from the cured building material to expose the formed structural component for use as, for example, a foundation or portion thereof, supporting a building or like structure of interest.

As is generally known in the art of building construction, an area is excavated and a form system is assembled therein to match dimensions of a desired foundation or footing. Conventional forms typically comprise panels constructed of steel, wooden boards, planks or sheet material (e.g., plywood) and the like, that are arranged in parallel side-by-side configurations to define side walls and a channel between the side walls along one or more lengths of the excavated area. The panels are staked or otherwise secured in place to prohibit deformation of the side walls as concrete is poured in the channel between the side walls. As can be appreciated, dimensions (e.g., height, thickness, length and shape) of foundations and footings (and thus the form system) vary depending on the structure being built as well as applicable building codes and standards of the industry.

Accordingly, while some aspects of conventional forms and components thereof can be standardized, some degree of customization is typically needed to meet the requirements of the structure being built and/or the building codes and standards employed at the particular job or project site. In addition, some building codes require that a drainage system be installed around the formed structural component such as, for example, a foundation for a structure of interest. Typically, drainage tiles, gravel, crushed stone, perforated pipe or other systems or materials are installed at or below the formed structural component to facilitate discharge of fluids such as, for example, ground water, by gravity or mechanical means into an approved drainage system and away from the structural component.

Conventional drainage systems are also employed to remove excess ground or subsurface water from athletic fields, golf courses, and the like. The fields themselves may include a crown, slope or pitch (e.g., one to two percent (1-2%) or more incline) from the center portion to sideline portions to assist in directing ground water off the field and to drainage systems at sidelines thereof. In some instances, a crown, slope or pitch can influence game play, so are not desirable. In such cases or as an additional feature to crowned fields, the drainage system may include additional sub-surface pipes, conduits or drains, below the surface of the field of play, that capture, retain, and move ground water below the surface of the field to the drainage system. Moreover, it is preferable that areas or fields used for athletic sports have good footing and traction to promote performance and safety for athletes. Soil quality (e.g., organic matter and nutrients) and proper irrigation that promote growth for natural turf, and drainage for both natural and synthetic turfs, are important factors in maintaining a good quality field. A quality field provides not only for better athletic performance but also lessens injury and fatigue as the turf is more impact resistant.

Radon is a cancer-causing natural radioactive gas and can cause lung cancer. The radon and other gases such as, for example, carbon dioxide, methane, and the like, can permeate the soil beneath a formed structural component (e.g., a foundation or footing) and often enter the supported building or like structure of interest through cracks in the foundation, windows, doors, or the HVAC system itself. The gas can be drawn into the building because the pressure inside the building is typically lower than the pressure in the soil around and beneath the foundation. Gas mitigation systems can be installed after construction; however, such systems are often costly, aesthetically displeasing, cumbersome and difficult to install. Additionally, if installation is not properly performed after construction, the installation can compromise the structure.

In view thereof, the inventor has recognized that a need exists for a relatively inexpensive and easily configured form system to build structural components such as, for example, a foundation or footing for a building or portions thereof. The inventor has further recognized that a need exists for a similarly inexpensive and easily configured drainage and ventilation system, which can include thermal insulating characteristic, installed around the formed structural component of a structure of interest such as a building or portion thereof.

SUMMARY OF THE INVENTION

The present invention resides in one aspect in a system for retaining a flowable and curable building material such as, for example, concrete, to form a portion of a foundation of at least a portion of a structure of interest. The system includes side walls receiving and retaining the building material therebetween. The side walls are disposed in a predetermined configuration suitable for the portion of the foundation and include a first side wall and a second side wall disposed opposite the first side wall and providing a space (e.g., distance) therebetween. At least one of the first side wall and the second side wall is comprised of at least one component having an interior cavity. A bracket assembly retains the side walls in the predetermined configuration. The bracket assembly includes a first outwardly bounding reinforcement post disposed proximate the first side wall, and a second outwardly bounding reinforcement post disposed proximate the second side wall. A separator bar includes a first end, a second end opposed from the first end, and a plurality of apertures disposed along a length of the separator bar. The plurality of apertures includes a first set of apertures disposed proximate the first end and a second set of apertures disposed proximate the second end. The first set apertures and the second set of apertures are sized to receive and retain each of the reinforcement posts at locations corresponding to nominal widths of the at least one component. A barrier is disposed between the outwardly bounding reinforcement post and inwardly bounding reinforcement post. The barrier is defined by an inner layer wrapped by an outer layer. The barrier is permeable by liquid and/or air or gas (e.g., ground water and/or heated or cooled air, or gas from soil, gravel or other fill medium exterior a structural) in at least one direction into and through the barrier to an interior channel, and in some embodiments, two directions including into and through the barrier to the interior channel, and from the interior channel into and through the barrier to soil, gravel or other fill medium. The barrier and the at least one component is retained in the foundation after the building material cures, and the barrier prevents backfill (e.g., fill medium such as soil, gravel and the like) from filling a volume between the portion of the foundation and the outwardly bounding posts.

The present invention resides in one aspect in a foundation footing drainage and ventilation system, the system comprising: a conduit; a first drainage core having a first end, a second end, and plurality of passages extending therethrough; a second drainage core having a first end, a second end, and plurality of passages extending therethrough; a fabric wrapped around each of the conduit, the first drainage core and the second drainage core; and a drainage cavity bounded by the conduit and the first and second drainage cores; wherein the second drainage core is disposed substantially vertically and proximate a first side of the conduit, the second end of the second drainage core being disposed proximate the second end of the first drainage core, wherein the first end of the first drainage core is positioned upwardly from the second end of the first drainage core and proximate a second side of the conduit; and wherein the at least one component is disposed on the first end of each of the first and second drainage cores.

The present invention resides in one aspect in a foundation footing drainage and ventilation system, the system comprising: a conduit; a first drainage core having a first end, a second end, a first plurality of passages extending therethrough and a second plurality of passages extending therethrough substantially orthogonal to the first plurality of passages; a second drainage core having a first end, a second end, a first plurality of passages extending therethrough and a second plurality of passages extending therethrough substantially orthogonal to the first plurality of passages; a fabric wrapped around each of the conduit, the first drainage core and the second drainage core; wherein the conduit is disposed proximate the first end of each of the first and second drainage cores, and the second end of each of the first and second drainage cores extends outwardly from the conduit.

The present invention also resides in one aspect in applying the aforementioned footing bracket and forming system to provide and to improve drainage, air and gas barriers, remediation and improved air flow (into and out of a system), and in some embodiments, thermal insulating and fire retardant characteristics, to structural components such as foundations, slab walls (interior and exterior), and provides and improves irrigation systems, drainage, storm water management, septic leaching fields, and the like, within such applications as, including but not limited to, agriculture, athletic fields, golf courses, landscaping soft and hard scape, and building structures of a variety of uses including residential, commercial, industrial, governmental and educational uses, as well as open air structures and environments including, but not limited to, driveways, parking lots, bridges, roadways, sidewalks, swales, parking garages, airport runways, roofing systems, mining, HVAC, and the like.

As described herein, in applications of use the present invention provides an open area or passage within a structure or building envelope that allows convection of air, liquid and gases passively or in large volumes with mechanical help. The inventor has discovered that the area or passage can be employed, and in some embodiments, to increase thermal conductivity, flow, fire and impact resistance, insulating and fire retardant characteristics. The inventors envisions application within numerous construction-Divisions defined by the Construction Specifications Institute (CSI), including uses in foundations, slab walls (interior and exterior), improved agriculture and irrigation systems, drainage, storm water management, septic leaching fields, and in indoor and outdoor sports fields, golf courses, landscaping soft and hard scape.

BRIEF DESCRIPTION OF THE DRAWINGS

FIG. 18C is a chart illustrating example characteristics of components, a geotextile fabric and a core, of the form system of FIG. 16 and the foundation footing drainage and ventilation system of FIG. 17;

In these figures like structures are assigned like reference numerals, but may not be referenced in the description of all figures.

DETAILED DESCRIPTION OF PREFERRED EMBODIMENTS

General Overview:

As taught and described herein, aspects of present invention include: (1) a form system for building structural components, for example, footing, foundations and portions thereof; (2) an integral ventilation system included within the form system, which introduces conditioned air (e.g., heated, cooled, humidity controlled air) into the system and/or removes and remediates gas, moisture, and the like, from the system and soil surrounding the structural component formed with the same; (3) an integral drainage system, which in embodiments includes gravel-less features, and which captures, retains and directs a flow of liquid, such as ground and subsurface water, away from a structure, athletic fields, golf courses, and the like; and (4) in embodiments, one or more of the above described form, ventilation and drainage systems provides a barrier including thermal insulating and fire retardant characteristics.

As described herein, the present invention includes improved drainage, air, gas (radon, methane and the line) mitigation or remediation systems, promoting thermal conductivity, insulation and barrier characteristics. When used in drainage mat applications, the invention provides improved impact resistance and soil retainment characteristics, as described herein.

Figure 1A:
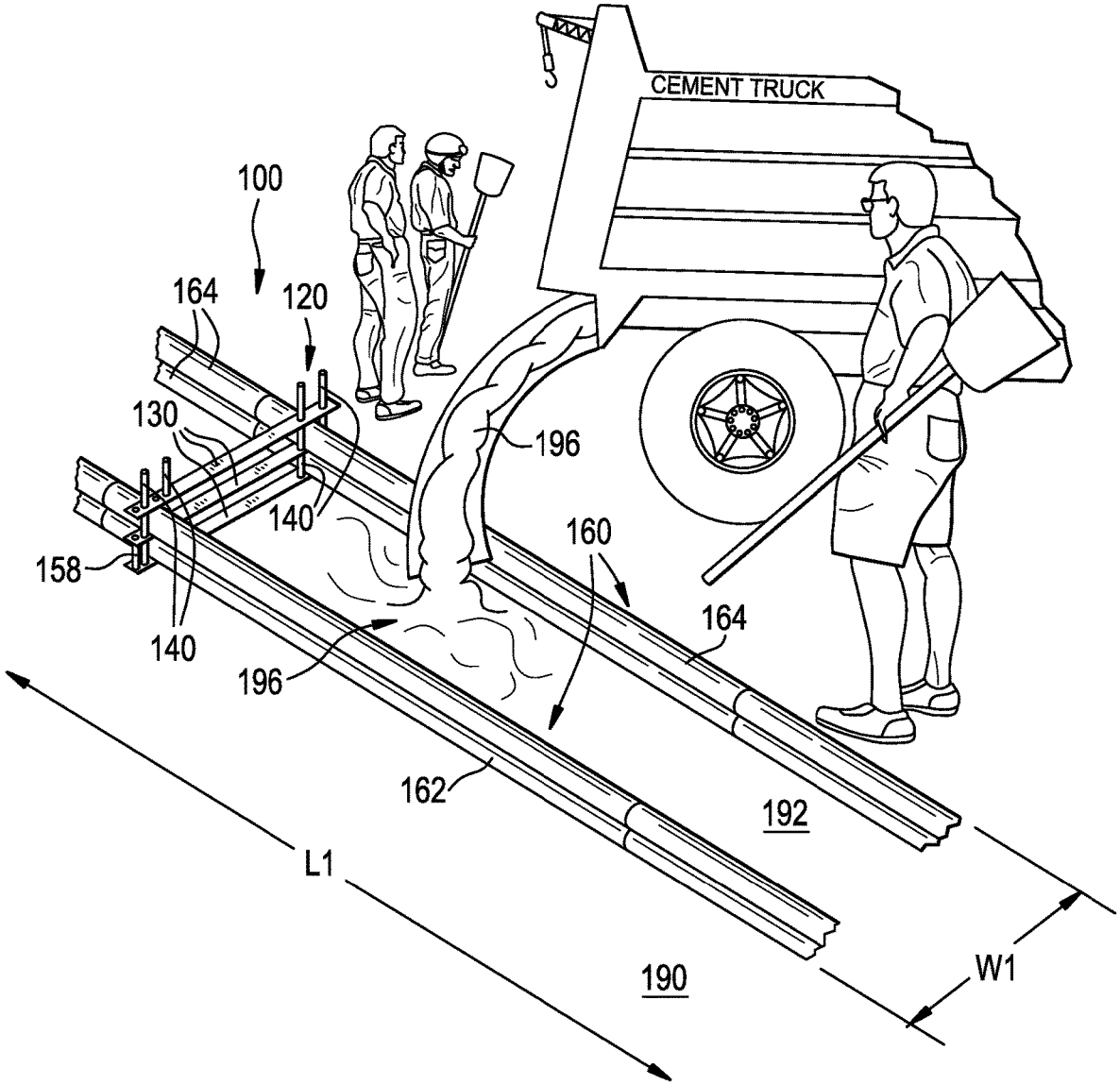
FIG. 1A is a perspective view of an inventive form system in accordance with one embodiment of the present invention.
Figure 1B:
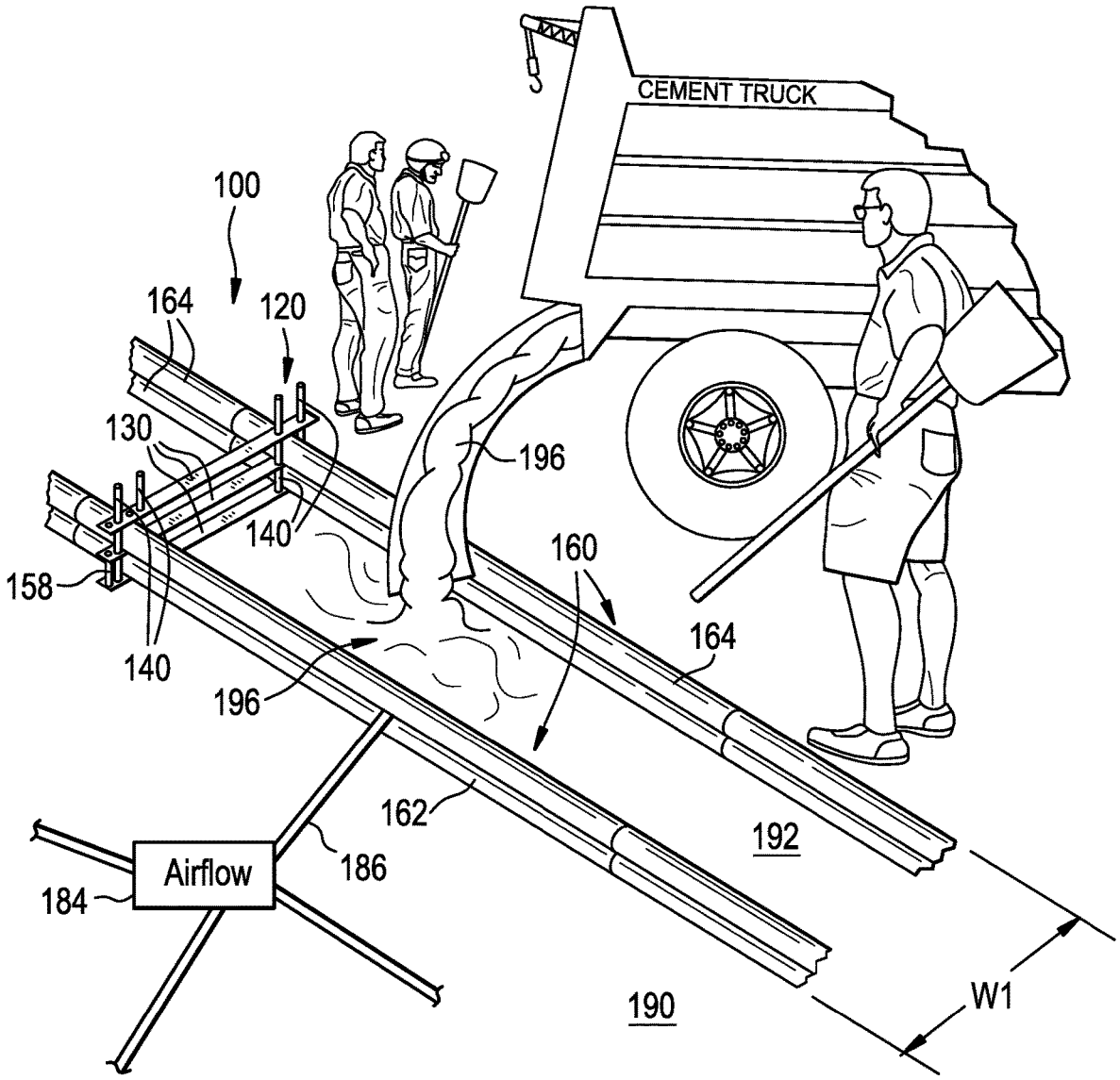
FIG. 1B is a perspective view of an inventive form system in accordance with another embodiment of the present invention.
Figure 2:
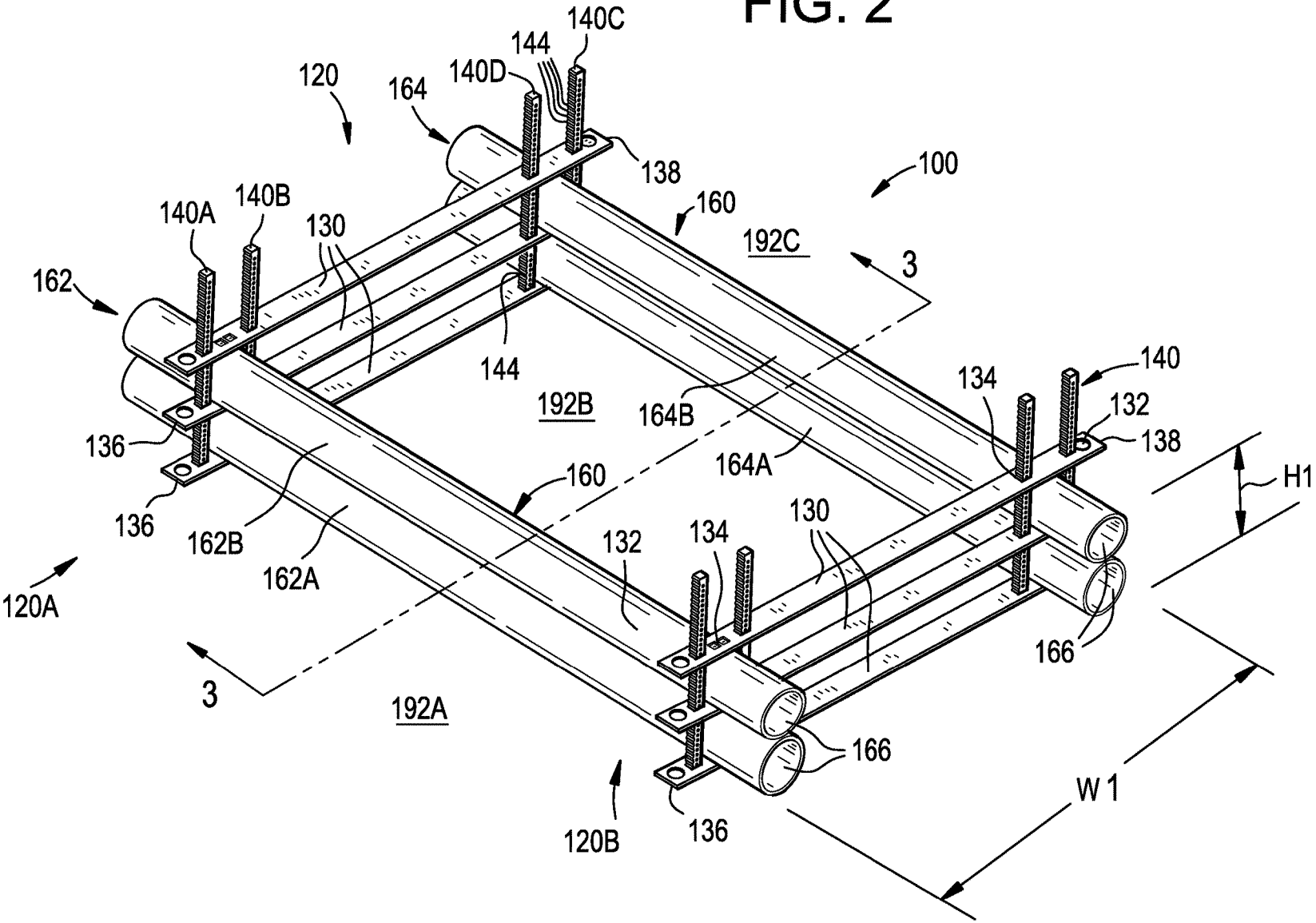
FIG. 2 is a perspective view of components of the form system in accordance with one embodiment of the present invention.

Form System:

As shown in FIGS. 1A, 1B and 2, in one embodiment of the present invention, an inventive form system 100 includes a bracket assembly 120 configured and operating to retain side walls 160, for example a first side wall 162 and a second side wall 164, in a spaced relation apart from one another over a predetermined configuration (e.g., height H1, width W1, length L1 and shape S1) within an excavated area 190. For example, the bracket assembly 120 retains the first side wall 162 at a configuration that includes a position parallel to and horizontally spaced apart from (e.g., distant from) the second side wall 164 along at least a portion of the length L1 of and/or partially within the excavated area 190. As shown in FIG. 1A, the bracket assembly 120 and side walls 160 cooperate to define a channel 192 that receives and retains a flowable and at least partially liquid building material 196 such as, for example, concrete, poured into the channel 192. As described herein, the channel 192 is configured to be of a predetermined configuration (e.g., height H1, width W1, length L1 and shape S1) suitable for a footing and/or wall of a foundation supporting a structure of interest, or portion thereof.

It should be appreciated that while FIGS. 1A and 1B illustrate only one bracket assembly 120 retaining the side walls 160, it is within the scope of the present invention to employ one or more bracket assemblies 120 at varying intervals along the length L1 of and/or the configuration within the excavated area 190 to keep the side walls 160 from moving (e.g., being displaced) by pressure exerted thereon by the flowing concrete 196 introduced to the channel 192. It should also be appreciated that the side walls 160 may be constructed from one single, or two or more stacked components as needed to form the predetermined configuration. The components include a section or sections (e.g., pieces) of elongated building materials such as, for example, wooden boards, planks or sheet materials such as plywood, tubular members such as round drain or drainage pipe, square or rectangular pipe or conduit, drainage cores, and the like, and combinations thereof.

Figure 3:
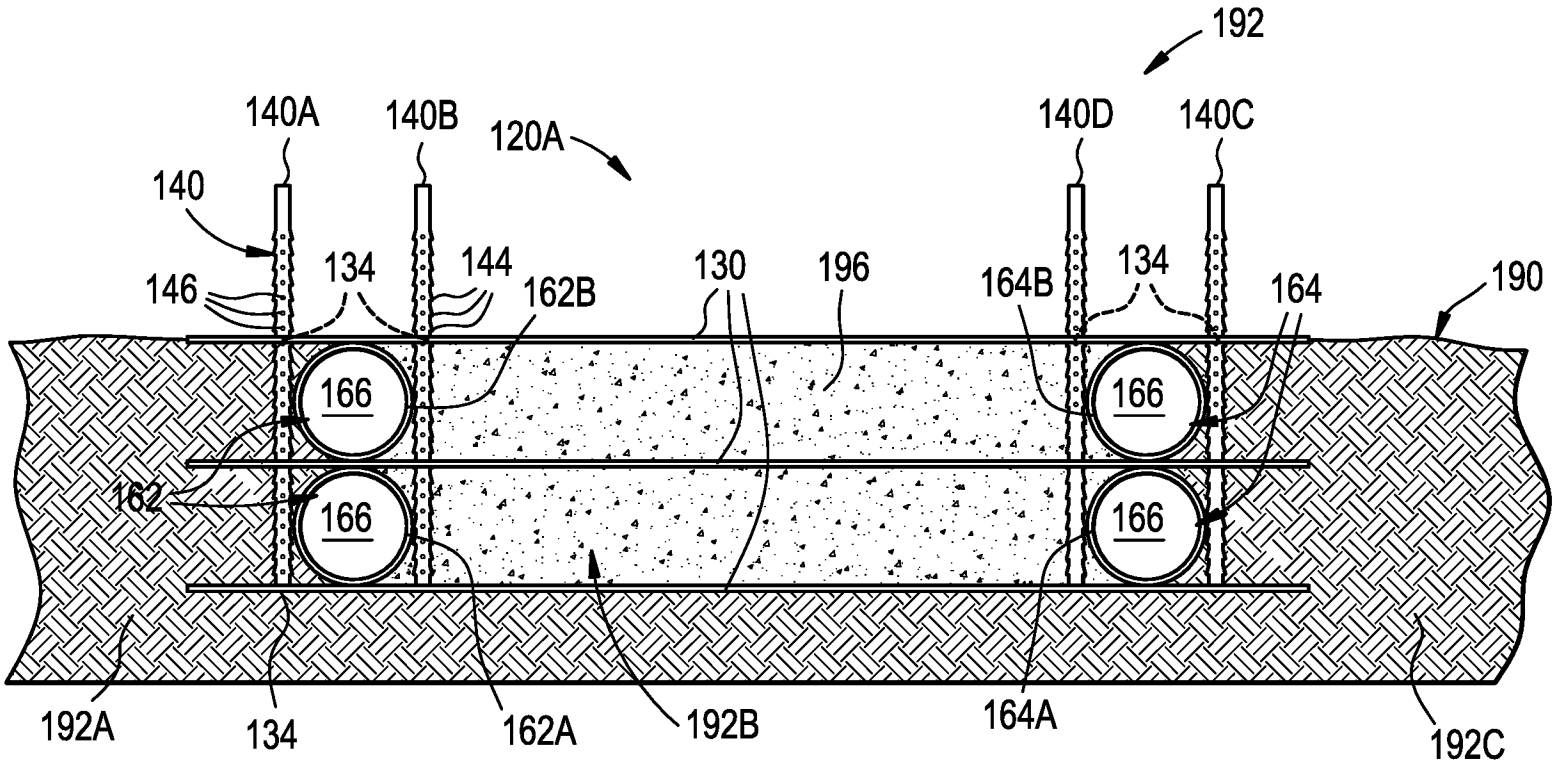
FIG. 3 is a cross-sectional view of the components of FIG. 2, taken along line 3-3.
Figure 4:
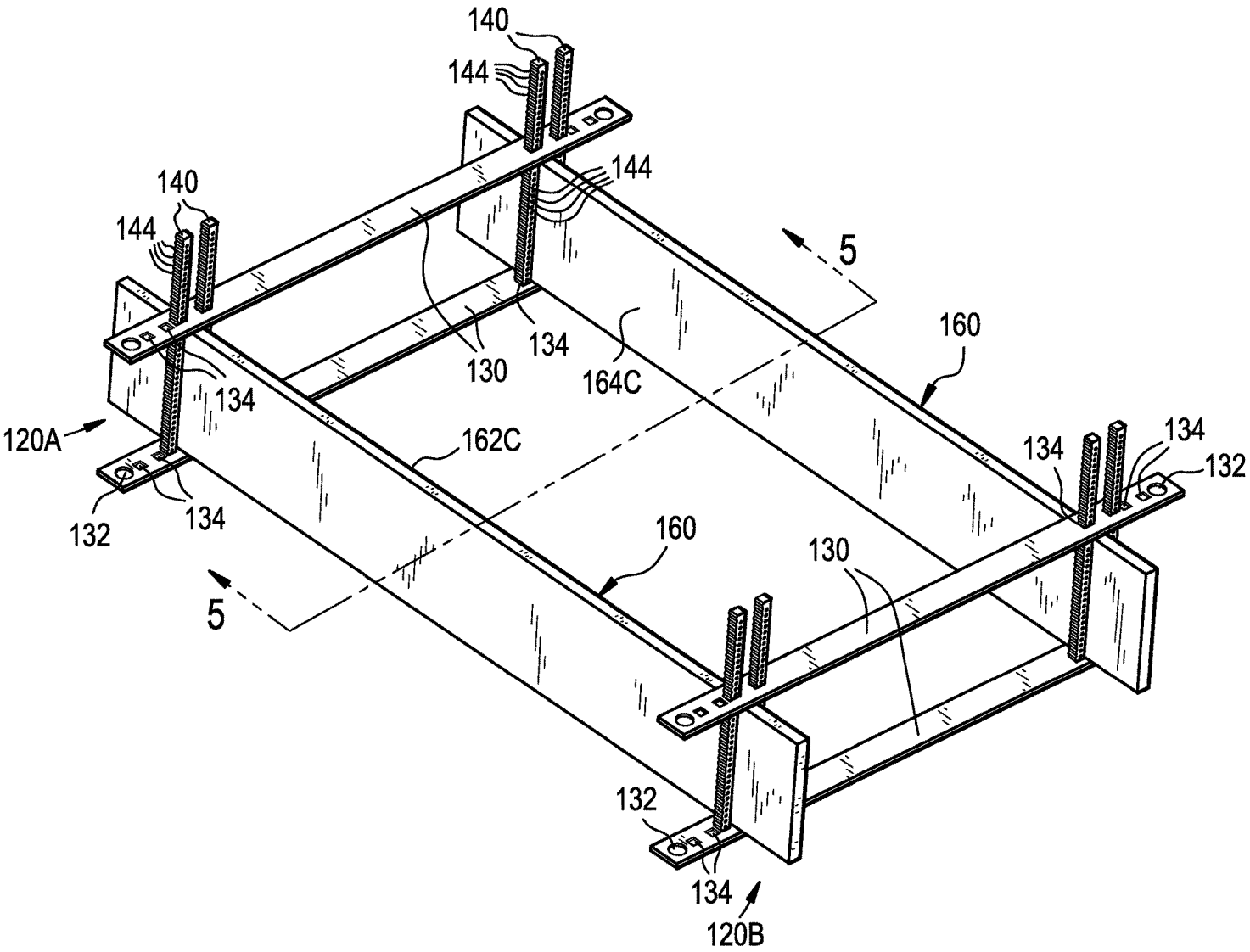
FIG. 4 is a perspective view of components of the form system in accordance with one embodiment of the present invention.
Figure 5:
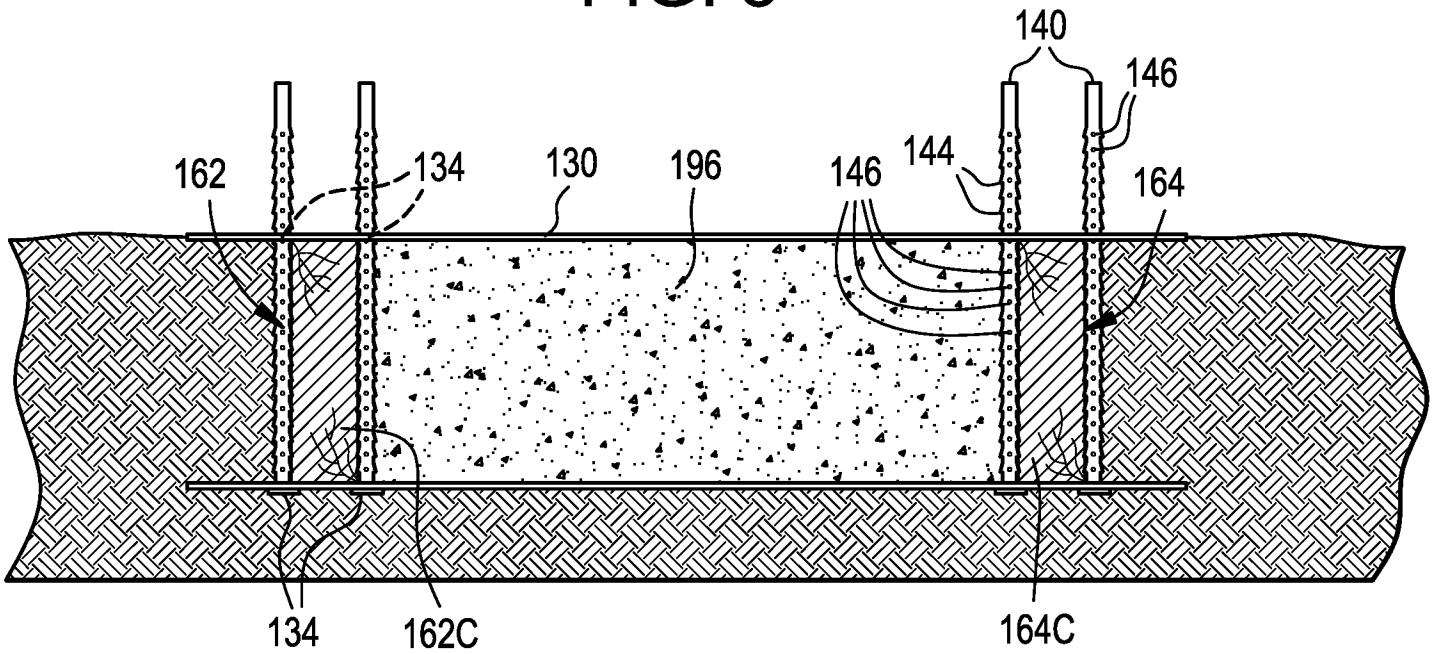
FIG. 5 is a cross-sectional view of the components of FIG. 4, taken along line 5-5.
Figure 6:
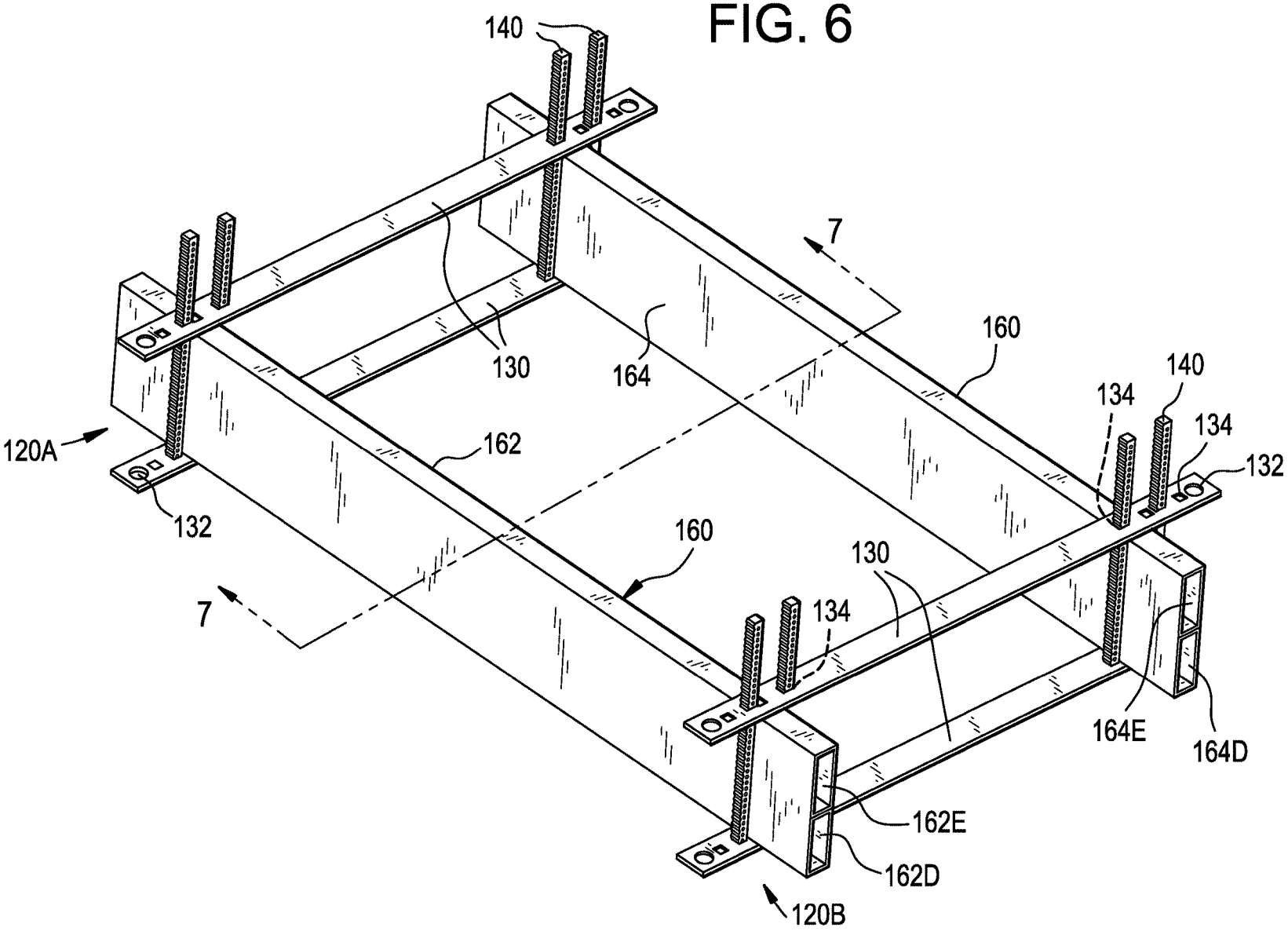
FIG. 6 is a perspective view of components of the form system in accordance with one embodiment of the present invention.
Figure 7:
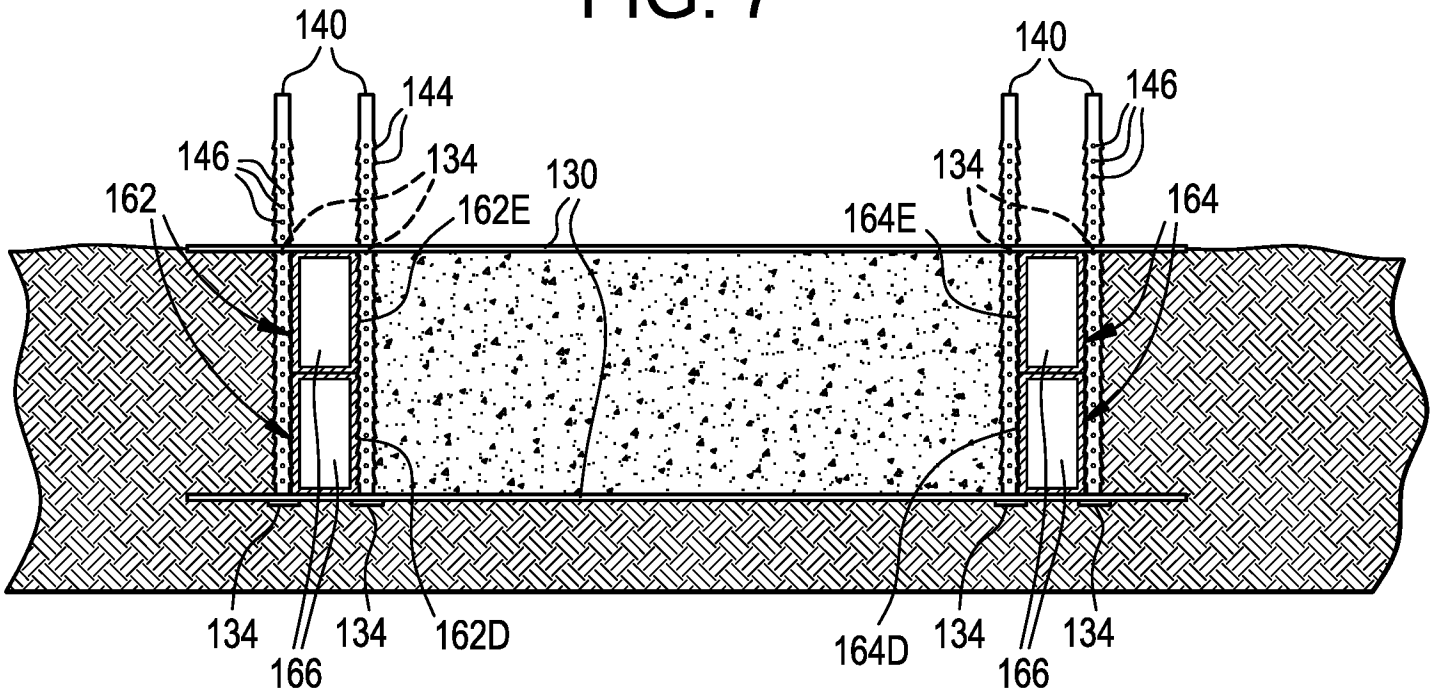
FIG. 7 is a cross-sectional view of the components of FIG. 6, taken along line 7-7.

For example, FIGS. 2, 4 and 6 illustrate two bracket assemblies 120A and 120B disposed at opposite ends and retaining components of the two side walls 162 and 164 within the configuration, or portion thereof. As shown in FIGS. 2 and 3, two stacked sections of elongated building material, for example, drain pipe 162A and 162B, comprising the first side wall 162, are retained in a vertically stacked orientation and a horizontally distant relation from two stacked sections of drain pipes 164A and 164B, comprising the second wall 164 of the configuration. FIGS. 4 and 5 illustrate two bracket assemblies 120A and 120B disposed at opposite ends and retaining pieces of elongated wooden planks 162C and 164C, comprising the first side wall 162 and the second side wall 164, in a vertical orientation and horizontally distant relation. FIGS. 6, 7 and 12G illustrate two bracket assemblies 120A and 120B disposed at opposite ends and retaining two pieces of elongated rectangular conduit 162D and 162E of the first side wall 162 in a vertically stacked orientation and a horizontally distant relation from two pieces of elongated rectangular conduit 164D and 164E of the second wall 164.

Referring again to FIG. 2, in one embodiment, the bracket assembly 120 (e.g., each of bracket assemblies 120A and 120B) includes one or more separator bars 130 and two or more reinforcement posts 140, illustrated in greater detail at FIGS. 8, 9A and 9B, 10D and 10E, respectively. The separator bars 130 and the reinforcement posts 140 cooperate to retain the side walls 160, and components 162A-162E and 164A-164E thereof, in the vertical orientation and the horizontally spaced apart (e.g., distant) relation of the predetermined configuration or portion thereof. As shown in FIGS. 1-7, the separator bars 130 and a first pair of reinforcement posts 140 cooperate to retain a portion of the first side wall 162 in the substantially vertical orientation and the horizontally distant relation from the second side wall 164 retained by the separator bars 130 and a second pair of the reinforcement posts 140.

Figure 8A:
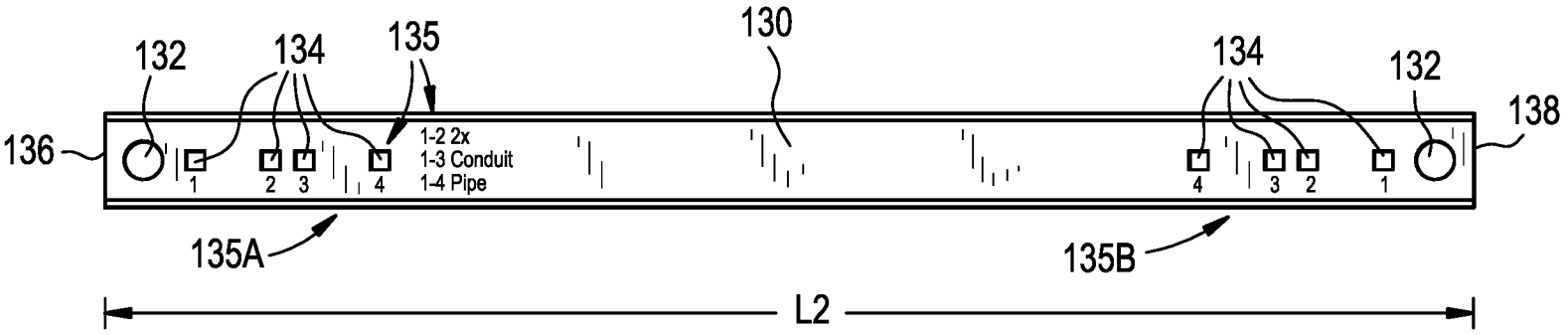
FIG. 8A is a plan view and FIG. 8B is a side view, respectively, of a separator bar in accordance with one embodiment of the present invention.
Figure 8B:
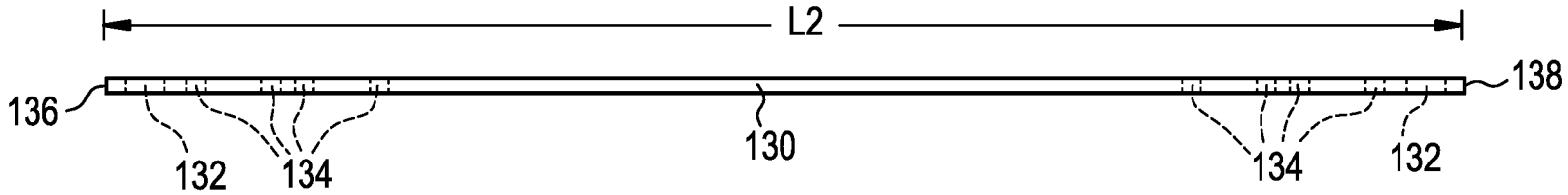
Figure 9A:
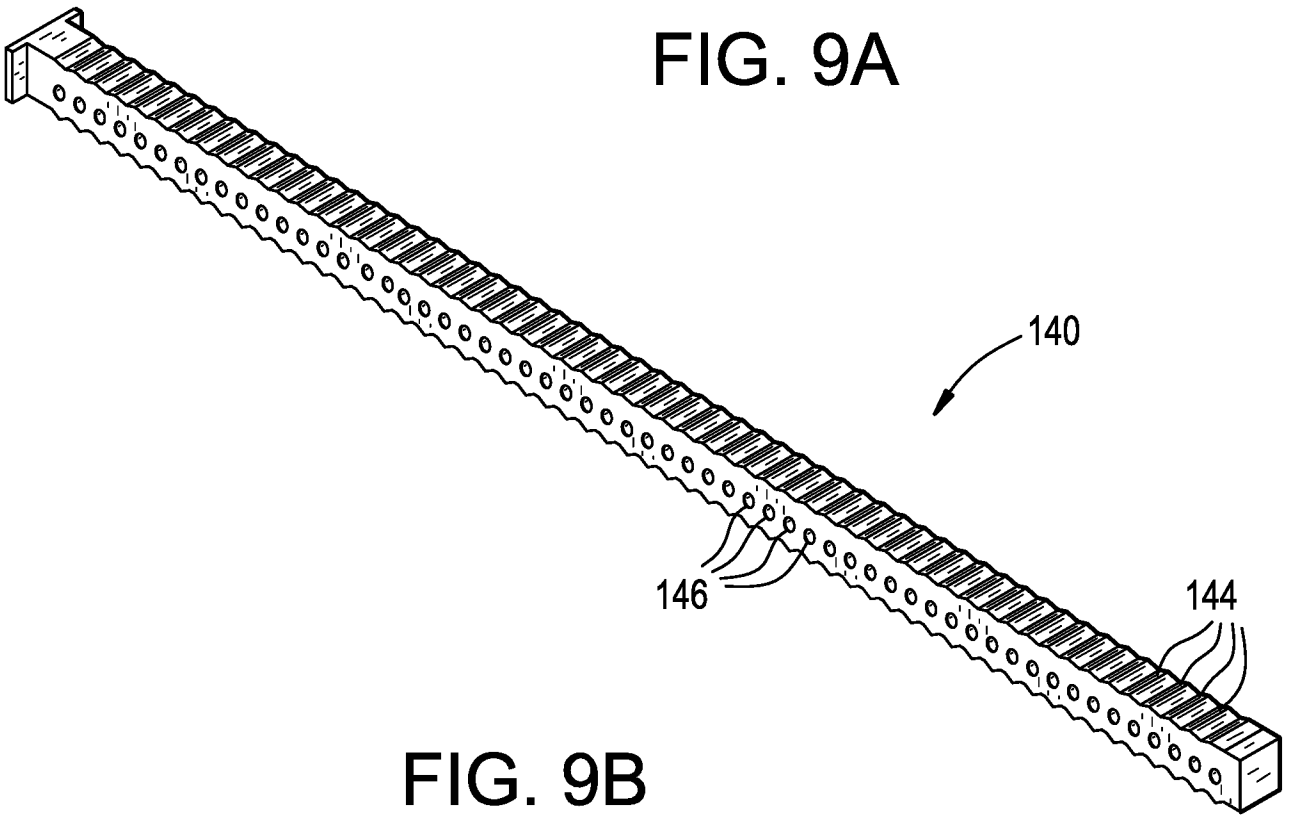
FIG. 9A is perspective view and FIG. 9B is a side view, respectively, of a reinforcement post in accordance with one embodiment of the present invention.
Figure 9B:
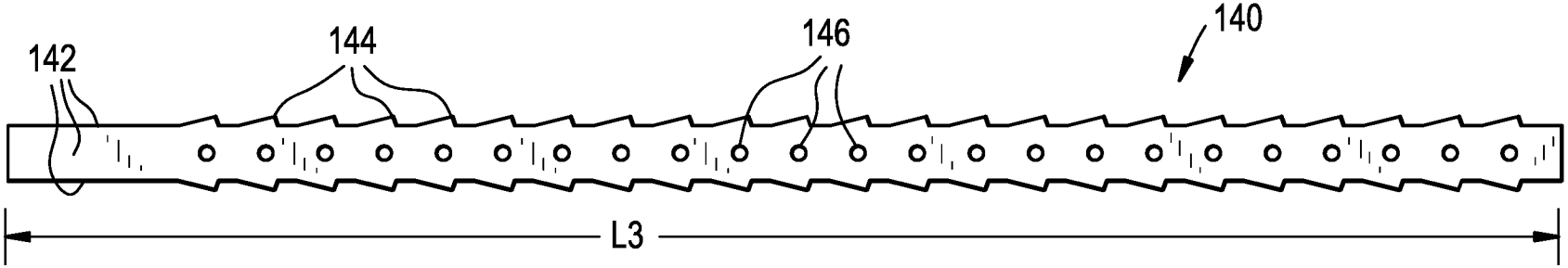

As illustrated in FIGS. 8A and 8B, in one embodiment, each of the one or more separator bars 130 include a plurality of apertures 132 and 134 disposed at predetermined locations along a length L2 of the separator bar 130. In one embodiment, the apertures 132 are disposed at opposing ends 136 and 138 of each of the separator bars 130 and are sized to receive a stake or post 158 (FIG. 1A) for securing the bracket assembly 120 at a location within the excavated area 190. The apertures 134 are disposed (as described below) at predetermined locations along the length L2 of the separator bar 130 and are sized to receive the reinforcement posts 140. As illustrated in FIGS. 9A and 9B, in one embodiment each of the reinforcement posts 140 includes serrations 144 disposed along at least a portion of a length L3 of sides 142 of the reinforcement post 140. The plurality of apertures 134 of the separator bars 130 and the serrations 144 of the reinforcement posts 140 are sized to frictionally engage one another whereby placement of a reinforcement bar 140 within an aperture 134 provides frictional engagement between the serrations 144 and the separator bar 130 to prevent displacement. In one embodiment, the reinforcement posts 140 include apertures 146 through the sides 142 of the posts. The apertures 146 provide means whereby a length of line (e.g., a level line) can be inserted through one or more reinforcement posts 140 and additional articles (e.g., rebar, the separator bars 130) can be tethered to and/or supported by the reinforcement post 140. In one embodiment, wire, pins, fasteners may be disposed within the apertures 146 to support the separator bar 130 in a vertical orientation between the reinforcement posts 140. In one embodiment, the separator bar 130 is otherwise clamped, fastened or secured in the vertical orientation between the reinforcement posts 140. In one embodiment, the separator bar 130 may include a plurality of tabs that are selectively extendable into the apertures 134 to lock the reinforcement post 140 to the separator 130. Other embodiments of the separator bar 130 and reinforcement post 140 are shown in FIG. 10D and FIG. 10E, respectively.

In one aspect of the invention, the predetermined locations of the apertures 134 of the separator bars 130 correspond to nominal widths of elongated building material required, recommended or preferred, for use as components to construct the side walls 160. For example, when a first pair of the reinforcement posts 140 are placed within corresponding ones of the apertures 134 proximate end 136 of the separator bar 130 the first side wall 162 is retained in place between the first pair of posts 140, and when a second pair of the reinforcement posts 140 are placed within corresponding ones of the apertures 134 proximate the opposing end 138 of the separator bar 130 the second side wall 164 is retained in place between the second pair of posts 140. As shown in FIG. 8, in one embodiment, the separator bar 130 is stamped, labeled or otherwise marked with indicia, shown generally at 135, to identify nominal widths of typical building materials, required, recommended or preferred, for use as components to construct the side walls 160. For example, the separator bar 130 includes such indicia 135 proximate its ends 136 and 138 to correspond to locations to construct each of the side walls. In one embodiment, a first set of indicia 135A proximate the end 136 corresponds to the location for constructing the first side wall 162 and a second set of indicia 135B proximate the end 138 corresponds to the location for constructing the second side wall 164.

As shown in FIGS. 2 and 3, during construction of the first side wall, for example, a first post 140A of the first pair of reinforcement posts 140 is placed within an aperture 134 proximate the end 136 of the separator bar 130 such that the first reinforcement post 140A is disposed externally with respect to the channel 192 (e.g., disposed at a location shown generally at 192A), and a second post 140B of the first pair of reinforcement posts 140 is placed within an aperture 134 inwardly from the end 136 such that the second reinforcement post 140B is disposed internally with respect to the channel 192 (e.g., disposed at a location shown generally at 192B) to externally and internally bound the components used to construct the first side wall 162 between the first pair of reinforcement posts 140A and 140B. Similarly, during construction of the second side wall a first post 140C of the second pair of reinforcement posts 140 is placed within an aperture 134 proximate the end 138 of the separator bar 130 such that the reinforcement post 140C is disposed externally with respect to the channel 192 (e.g., disposed at a location shown generally at 192C), and a second post 140D of the second pair of reinforcement posts 140 is placed within an aperture 134 inwardly from the end 138 such that the reinforcement post 140D is disposed internally with respect to the channel 192 (e.g., disposed at about location 192B), to externally and internally bound the components used to construct the second side wall 164 between the second pair of reinforcement posts 140C and 140D.

In one embodiment, the indicia 135 are comprised of a coding system such as, for example, a numeric coding system. For example, a first one of the apertures 134 proximate each of the ends 136 and 138 of the separator bar 130 is identified by a "1" marking and a second one of the apertures 134 disposed inwardly from the first aperture is identified by a "2" marking, where the first and second apertures are disposed at locations that correspond to a nominal width of a wooden board (e.g., stock "two-by" board materials having a nominal width of about one and one half inch (1.5 in.; 3.81 cm)); the first aperture (marked "1") and a third one of the apertures 134 inwardly from the second aperture (marked "2") is identified by a "3" marking, where the first and third apertures are disposed at locations that correspond to a nominal width of a rectangular conduit (e.g., a stock rectangular conduit having a nominal with of about two inches (2 in.; 5.08 cm)); and the first aperture (marked "1") and a fourth one of the apertures 134 inwardly from the third aperture (marked "3") is identified by a "4" marking, where the first and fourth apertures are disposed at locations that correspond to a nominal width or diameter of a round drain pipe (e.g., a stock drain pipe having a nominal diameter of about four inches (4.0 in.; 10.16 cm), six inches (6.0 in.; 15.24 cm) or other dimensions as would be required, recommended or preferred by one skilled in the art). While the present invention expressly discloses a numeric coding system for the apertures 134, it should be appreciated that it is within the scope of the present invention to employ other coding systems including, for example, a scale illustrating measurements in English (fraction or inch based), Metric (decimal based) and other measurement systems as would be used in the art. While not shown, it should be appreciated that spacers or shims may be used to increase or decrease the distance between two or more of the apertures 134 for securing building materials of nonstandard widths between corresponding pairs of reinforcement posts 140.

Figure 10A:
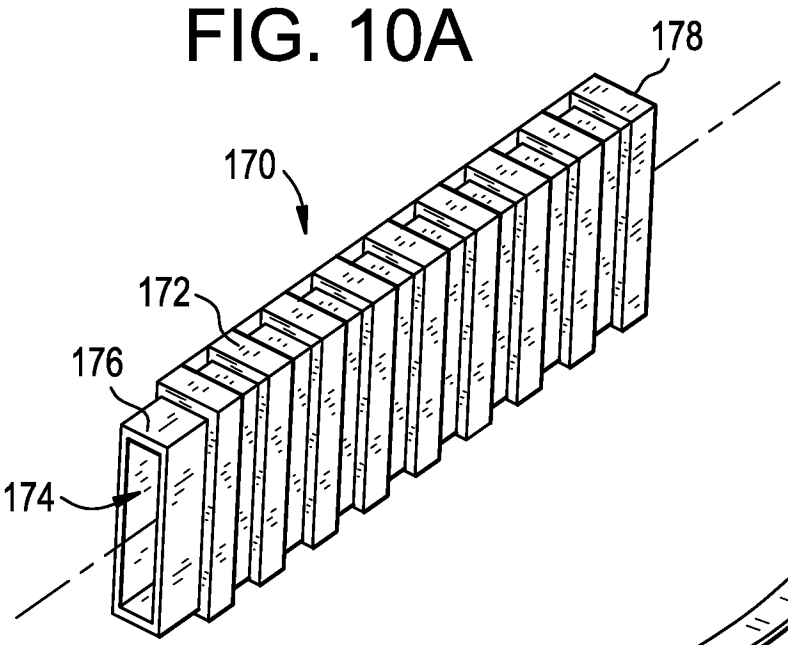
FIGS. 10A to 10E illustrate components of the form system in accordance with one embodiment of the present invention.
Figure 10B:
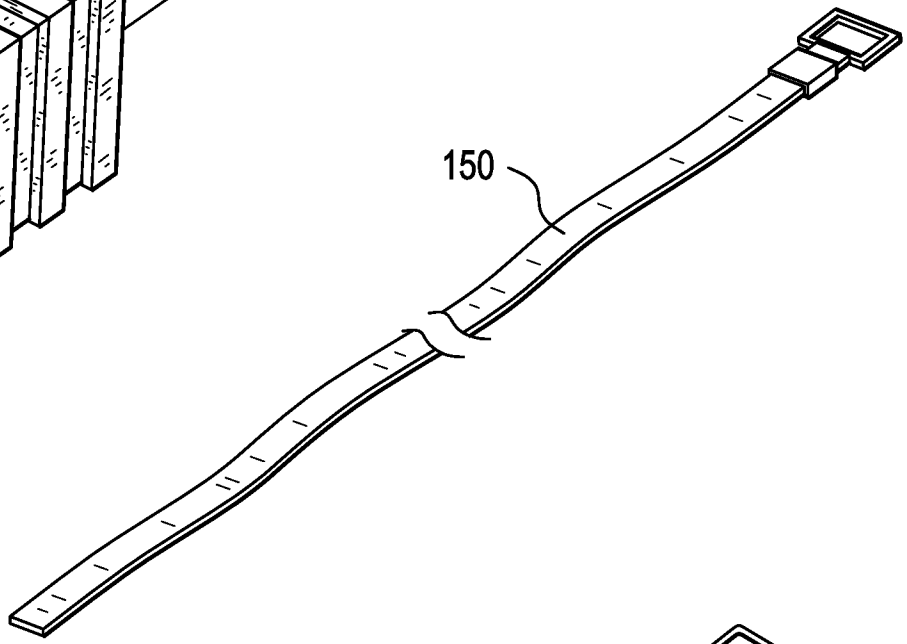
Figure 10C:
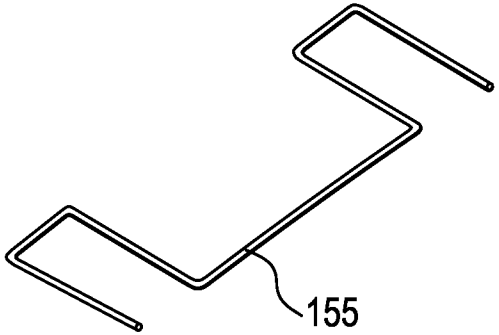
Figure 10E:
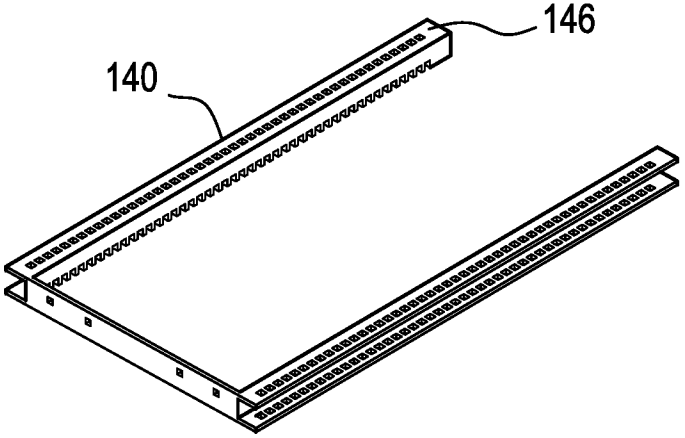
Figure 10D:
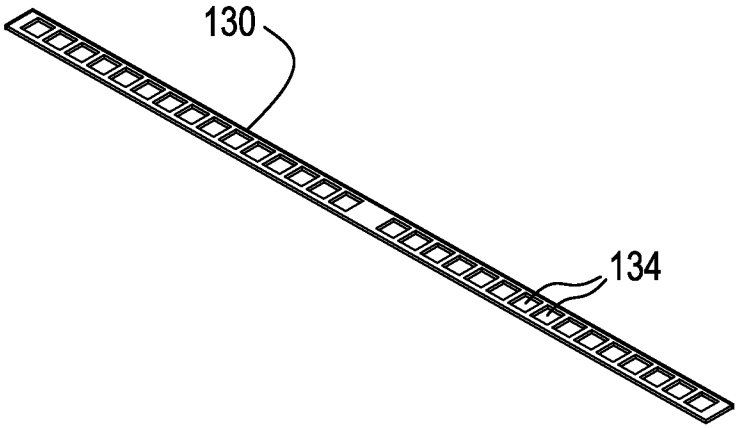

In one embodiment, shown in FIG. 10A, a conduit 170 is illustrated for use as a component to construct the side walls 160. The conduit 170 includes a corrugated-shaped wall 172 defining an interior cavity 174. As shown in FIG. 10A, in one embodiment the conduit 170 includes a male end 176 and a female end 178. The male end 176 and the female end 178 are configured to permit an end-to-end coupling of a plurality of the conduits 170. In one embodiment, underground utilities may be carried within the interior cavity 174. In another embodiment, plumbing may be carried within the interior cavity 174. As shown in FIGS. 10B and 10C, in one embodiment, one or both of a plurality of straps 150 and spreaders 155 may be positioned about the side walls 160 and cooperate with the bracket assembly 120 to assist in retaining the components of the side walls 160 in place as the concrete is received and cures within the inventive form system 100.

Figure 11B:
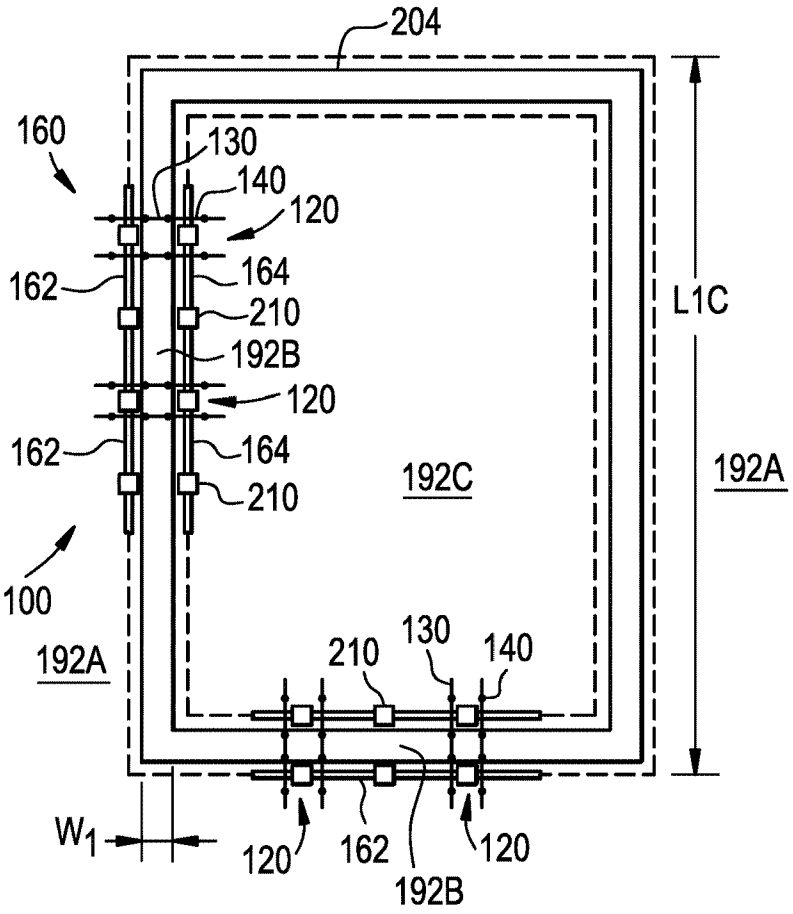
FIGS. 11A to 11D depict uses of the form system of the present invention.
Figure 11A:
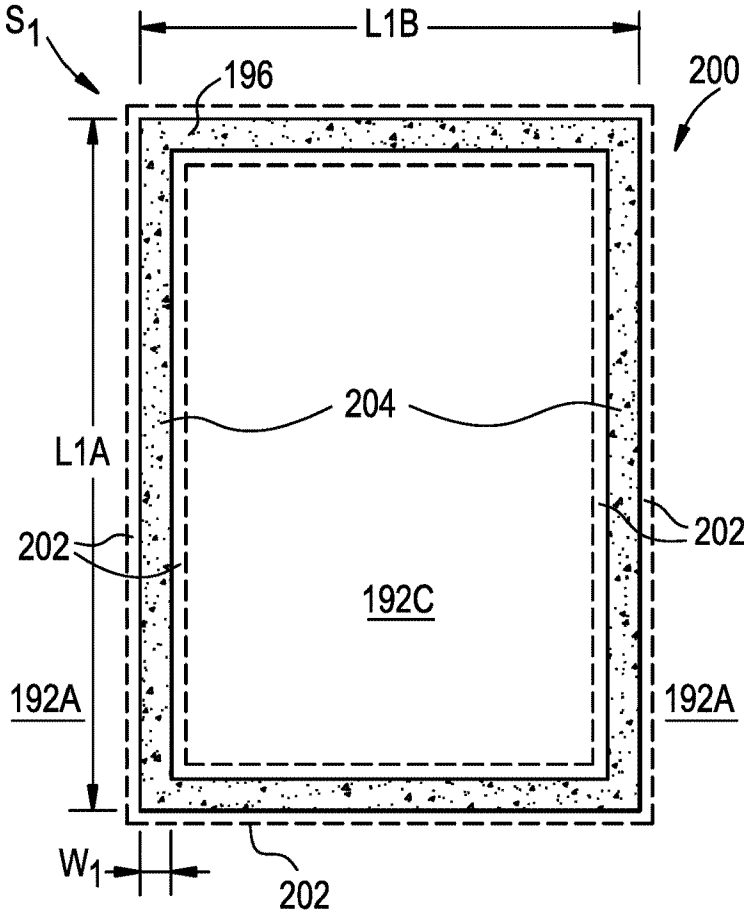
Figure 11D:
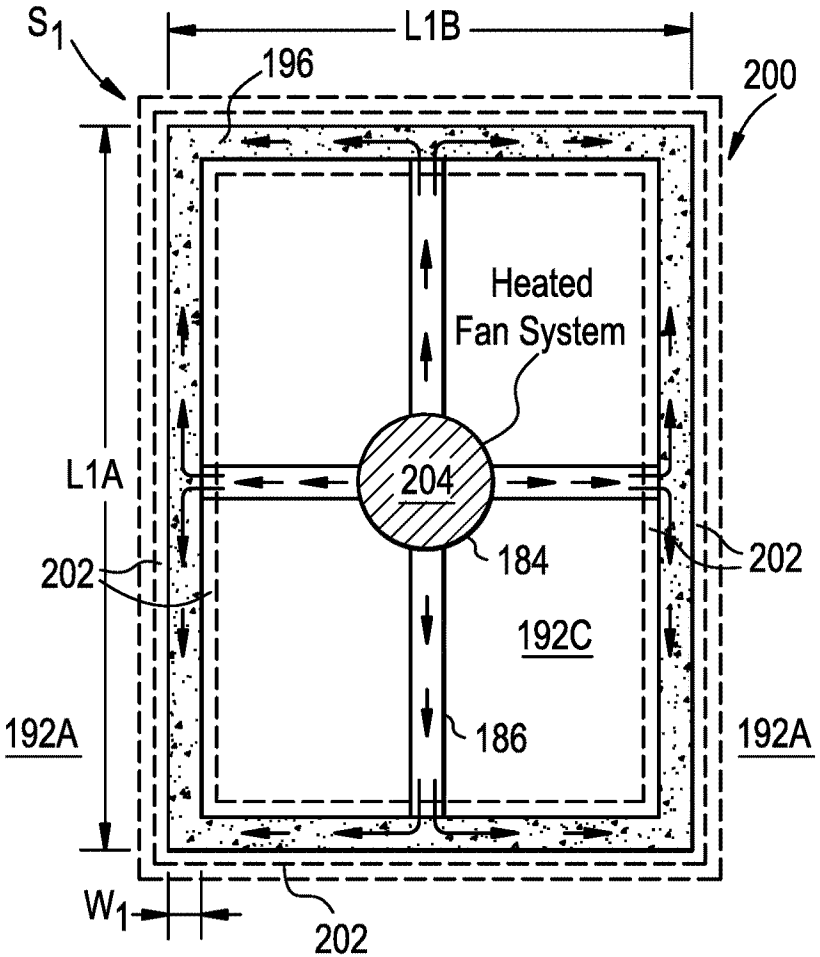
Figure 11C:
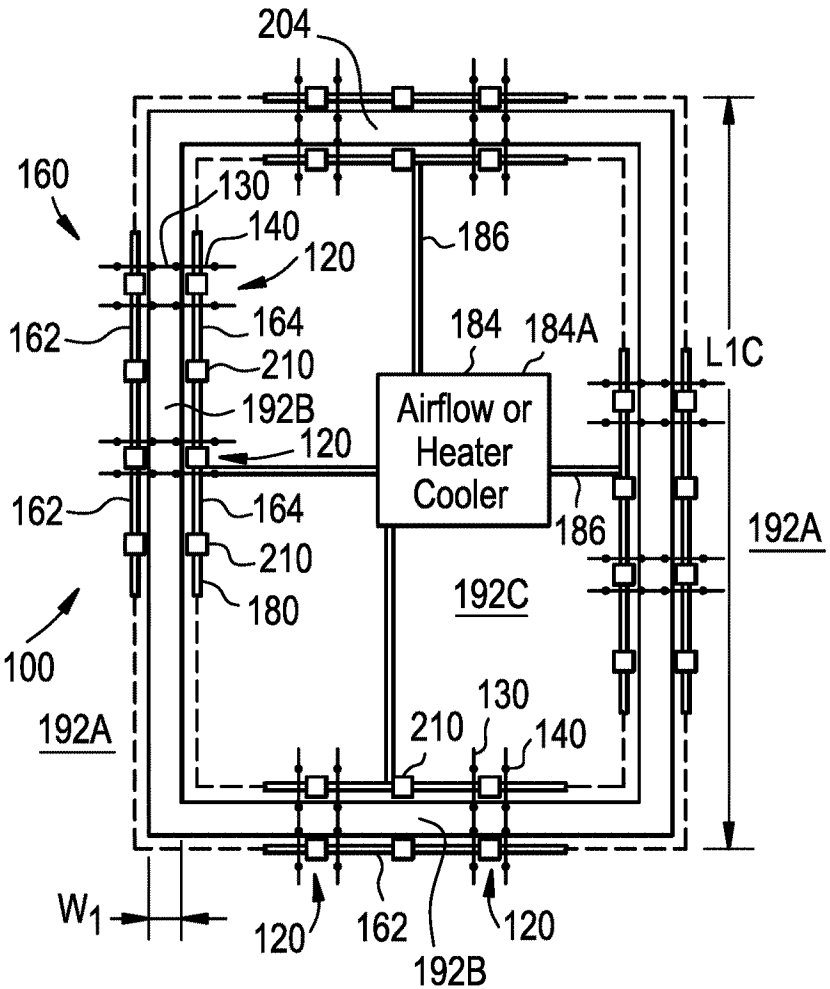

Ventilation System:

As illustrated in FIGS. 11A to 11D, the inventive form system 100 receives and retains concrete 196 being cured for use in constructing a foundation 200 including a footing 202 and walls 204 for a structure of interest such as, for example, a residential or commercial building or portion thereof. For example, a plurality of the bracket assemblies 120 may be operated to retain a plurality of the side walls 160 in the predetermined configuration, including the height H1 (extending in a plane vertically out of the drawing sheet), width W1, length L1 (including legs L1A, L1B, L1C, etc.) and shape S1 within the excavated area 190, to receive the concrete 196 to form one or both of the footing 202 and walls 204 of the foundation 200 for the structure of interest. As shown in FIG. 11B, components of the side walls 160 (e.g., sections of elongated building materials such as wooden boards, planks or sheet materials, tubular members such as round drain or drainage pipe, square or rectangular pipe or conduit, drainage core, and the like) are assembled, interconnected or interlocked in end-to-end fashion by, for example, one or more connectors 210, to form walls for retaining the concrete or other building material 196.

As described in further detail below, when the side walls 160 are comprised of tubular, square or rectangular members having interior cavities 166 and 174, such as pipe or conduit (as shown in FIGS. 2, 3, 6 and 7), the assembled, interconnected or interlocked side wall components are integrally formed within the structure and cooperate to define one or more passages 180 within the side walls 160 for air flow around at least an exterior (e.g., within area 192A) and interior (e.g., within area 192C) of the formed footing 202 and the walls 204, and/or for air flow within the footing 202 or walls 204 themselves (e.g., with area 192B). For example, the inventor has found that when accessed after construction, the one or more passages 180 of the side walls are conducive to providing ventilation for effective and efficient transfer (e.g., removal and/or remediation) of a flow of radon or other unwanted gas such as, for example, carbon dioxide, methane, from the structure constructed, and during construction, one or more passages 180 are conducive for providing air flow (e.g., conditioned air such as cool and/or warm air with or without humidity control, for example) to assist in curing the building material 196. In still another embodiment, the inventor has discovered that the passages 180 allow a transfer of conditioned air, for example, heated or cooled air, naturally by thermal effects of the sun on the structural components or soil surrounding the structure or by mechanical condition (an HVAC system). The transfer within the system improves environmental, living conditions within the building envelope of the structure, and in some cases can minimize costs of maintain the environmental conditions.

In one embodiment, the transfer of gas may be aided by an additional volume of air flow introduced by, for example, an in-line force air system. In one embodiment the flow rate is a minimum of three hundred fifty to four hundred cubic feet per minutes (350-400 cfm) through a one and a half inch (½ in.; 1.27 cm) drainage core described below. Of course, flow rate may increase significantly in large systems, e.g., four inch pipes for example. In one embodiment, illustrated in FIGS. 1B, 11C and 11D, the inventor has found that the one or more passages 180 of the side walls may be used to provide heated or cooled air from an air exchange unit 184, such as for example a heating and/or cooling unit 184A, via passages 186 in communication with at least one of the passages 180, to the interior and/or exterior areas about and/or within the footing 202 and walls, e.g., the aforementioned areas 192A, 192B and 192C, to remove moisture, condensation, humidity or the like in the areas, to aid cure time during construction, to permit construction in unfavorable weather and/or air or soil conditions (e.g., heat the building material and/or surrounding soil to permit construction in cold temperatures by permitting a passive flow and/or cure without freezing, and/or vice versa, to cool the building material and/or the surrounding soil to permit construction and stable curing during hot weather conditions), and to remove moisture that may lead to mold and/or other hazards. It should be appreciated that the passage 180 may be continuous, for example, provide for air flow about substantially all of an exterior perimeter, interior perimeter or both the exterior and interior perimeter of the formed footing 202 and the walls 204 (e.g., areas 192A, 192B and/or 192C). Alternatively, one or more portions of the exterior and interior perimeter of the formed footing 202 and the walls 204 may include the integrally formed side walls that provide one or more of the passages 180 that can be accessed to transfer, e.g., remove and/or remediate radon or other unwanted gas such as, for example, carbon dioxide, methane, and other gases, moisture or the like, and/or introduce heated and/or cooled conditioned air, from the areas (e.g., areas 192A, 192B, and/or 192C) proximate the building constructed.

As noted above, the inventive form system 100 may be used to construct the foundation 200 including one or both of the footing 202 and the walls 204 for the structure of interest. For example, a plurality of the bracket assemblies 120 and 220 (described below) may be operated to retain a plurality of the side walls 160 and 260, and components thereof, in the predetermined configuration to receive the concrete 196 to form one or both of the footing 202 and walls 204 of the foundation 200 for the structure of interest. When the components used to construct the side walls 160 and 260 are comprised of tubular, square or rectangular members having the interior cavity 166 and 174, the interior cavities 166 and 174 of the interconnected components cooperate to define one or more of the passages 180 within the side walls 160 and 260 for air flow around at least a portion of an exterior perimeter (e.g., within area 192A) and/or interior perimeter (e.g., within area 192C) of the formed footing 202 and the walls 204. The inventor has found that when accessed after construction, the one or more passages 180 are conducive to providing ventilation for effective and efficient transfer (e.g., removal and/or remediation) of radon or other unwanted gas such as, for example, carbon dioxide, methane, moisture or the like, and/or introduce heated or cooled condition air, from exterior or interior portions of the structure constructed. In one embodiment, the additional conditioned air through the passages 180 may supplement and enhance the conventional HVAC system and improve its performance.

Figure 12A:
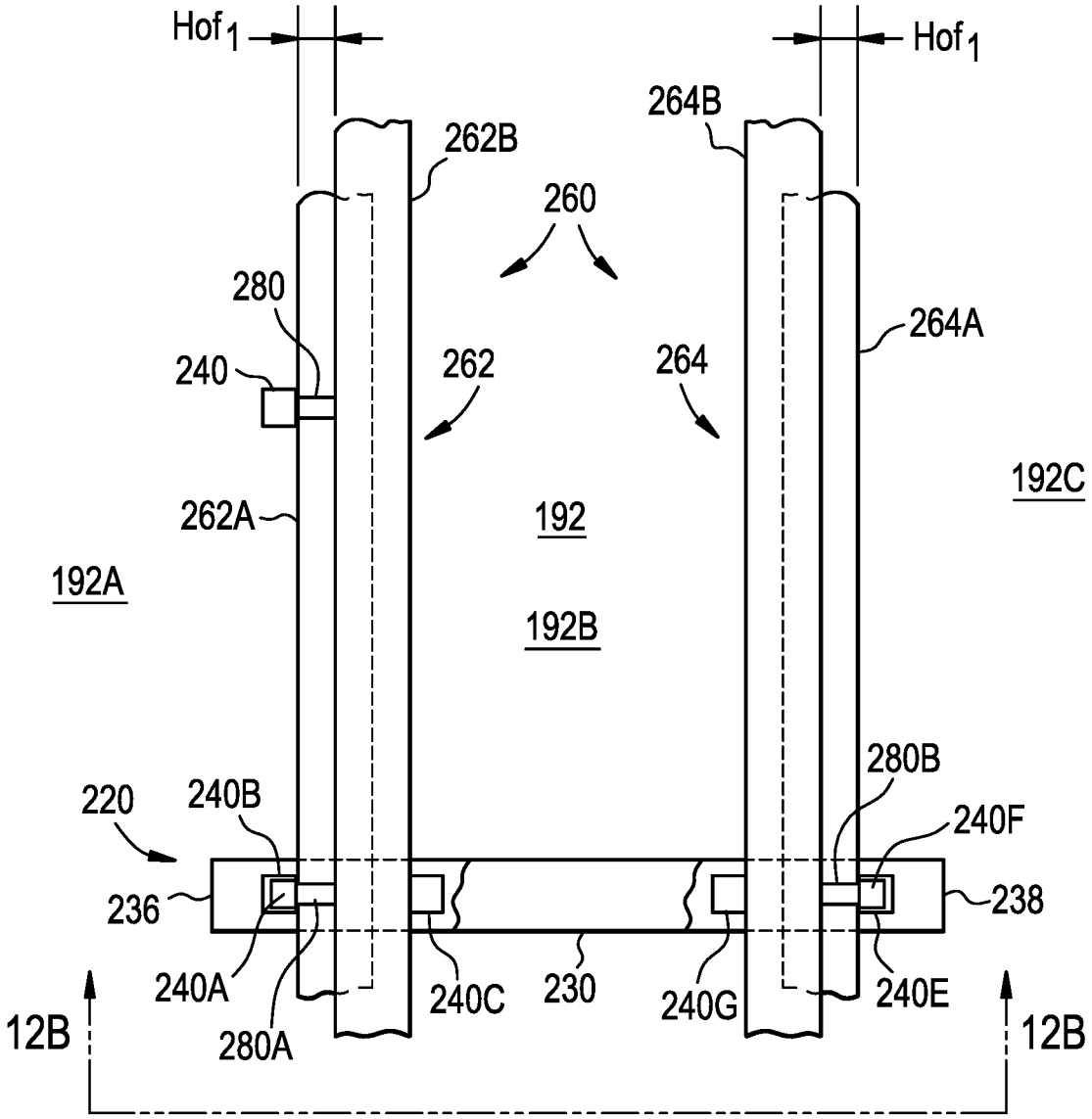
FIG. 12A is a partial plan view of components of the form system in accordance with one embodiment of the present invention.
Figure 12B:
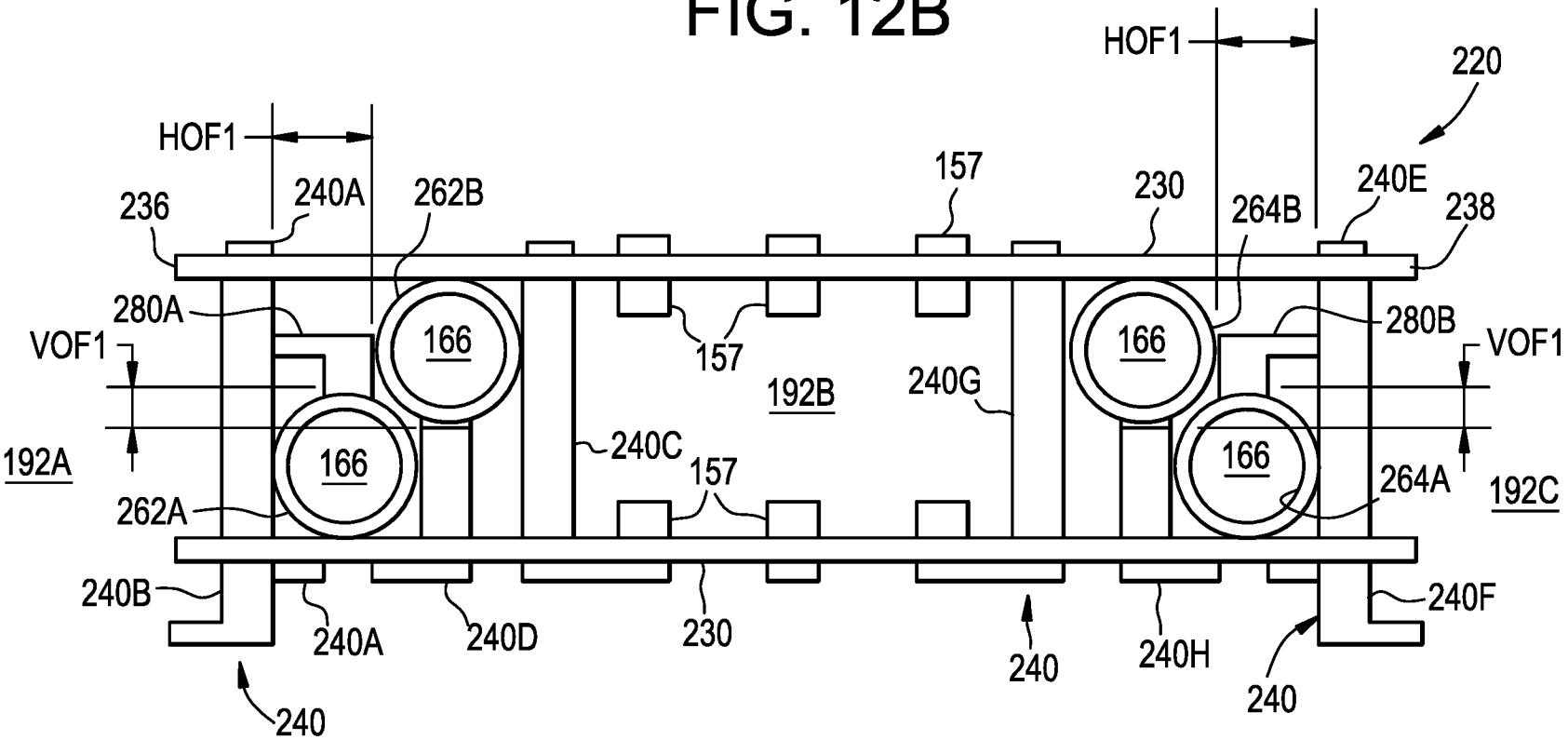
FIG. 12B is a cross-sectional view of the components of FIG. 12A, taken along line 12B-12B.
Figure 13:
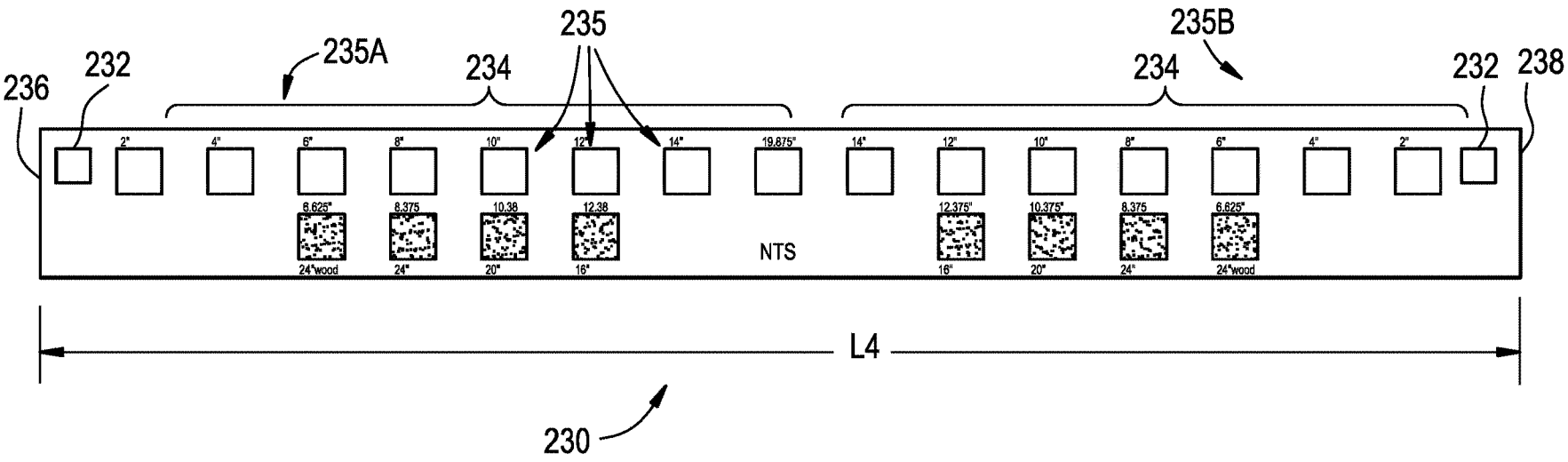
FIG. 13 is a plan view of a separator bar in accordance with one embodiment of the present invention.

Turning now to FIGS. 12A and 12B, in one embodiment the inventive form system 100 includes one or more bracket assemblies 220 disposed at varying intervals along the length L1 of the predetermined configuration within the excavated area 190 (similar to bracket assemblies 120) to keep side walls 260 from moving (e.g., being displaced) by pressure exerted thereon by the flowing concrete 196 introduced to the channel 192 formed between the side walls 260. In one embodiment, each of the one or more bracket assemblies 220 includes one or more separator bars 230 and two or more reinforcement posts 240, illustrated in greater detail at FIGS. 13, 14A and 14B, respectively. As with the separator bars 130 and the reinforcement posts 140 described above, the separator bars 230 and the reinforcement posts 240 cooperate to retain the side walls 260, and components thereof (e.g., the aforementioned single or stacked components of elongated building materials such as, for example, wooden boards, planks or sheet materials, tubular members such as round drain or drainage pipe, square or rectangular pipe or conduit, drainage cores, and combinations thereof), in the vertical orientations and the horizontally spaced apart (e.g., distant) relation of the predetermined configuration. As illustrated in FIG. 13, each of the one or more separator bars 230 include a plurality of apertures 232 and 234 disposed at predetermined locations along a length L4 of the separator bar 230. In one embodiment, the apertures 232 are disposed at opposing ends 236 and 238 of each of the separator bars 230 and are sized to receive the stake or post 158 (FIG. 1A) for securing the bracket assembly 220 at a location within the excavated area 190. The apertures 234 are disposed (as described below) at predetermined locations along the length L4 of the separator bar 230 and are sized to receive one or more of the reinforcement posts 240. In one embodiment, the apertures 234 may be used to support structural members such as, for example, rebar supports 157.

Figure 14A:
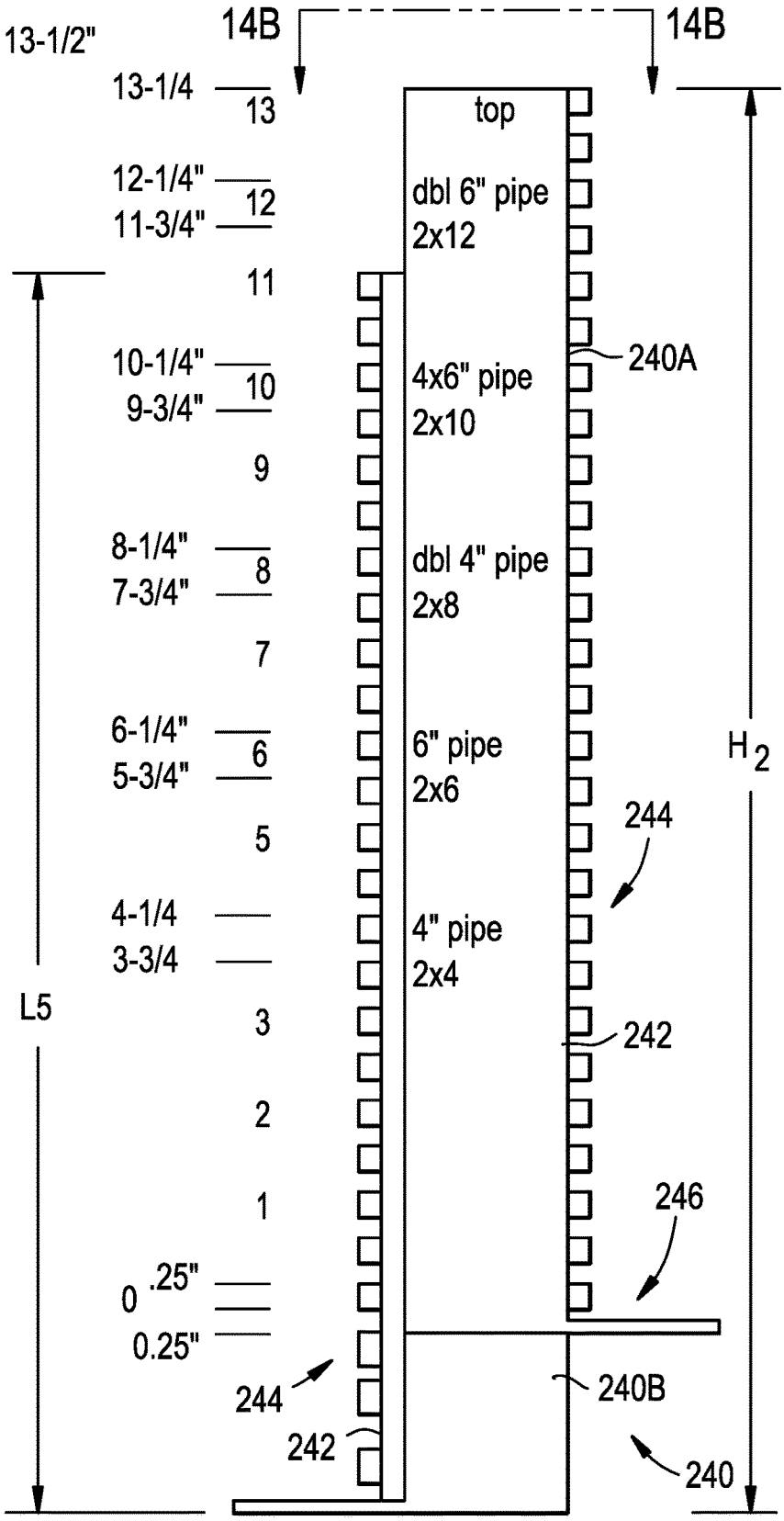
FIGS. 14A and 14B are an elevation view and a plan view of reinforcement posts in accordance with one embodiment of the present invention.
Figure 14B:
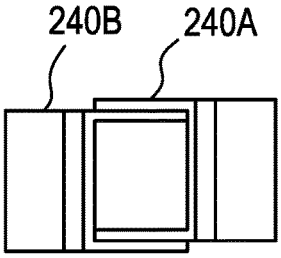

As illustrated in FIGS. 14A and 14B, in one embodiment each of the reinforcement posts 240 includes protrusions or serrations 244 disposed along at least a portion of a length L5 of one or more sides 242 of the reinforcement post 240. The sides 242 terminate at an end 246. In one embodiment, the end 246 is comprised of a foot extending outwardly from the sides 242. In one embodiment, the foot may include an aperture for receiving a stake to retain the reinforcement post 240 in position within the excavated area 190. Alternatively, the end 246 is tapered to conclude at a point or edge to retain the reinforcement post 240 in position. The plurality of apertures 234 of the separator bars 230 and the protrusions or serrations 244 of the reinforcement posts 240 are sized to frictionally engage one another whereby placement of a reinforcement bar 240 within an aperture 234 provides frictional engagement between the protrusions or serrations 244 and the separator bar 230 to prevent displacement. In one embodiment, the separator bar 230 may include a plurality of tabs that are selectively extendable into the apertures 234 to lock the reinforcement post 240 to the separator 230.

In one embodiment, the reinforcement posts 240 are comprised of U-shaped or rectangular tubular members (e.g., polymer U-channel or tubing) having a wall of a thickness to provide a relatively rigid structure (e.g., about 0.125 in (3.175 mm) thickness). In one embodiment, the reinforcement posts 240 are of uniform sizes and thus, are selectively interchangeable with and nestable within one another. For example, as shown in FIG. 14B, two posts 240A and 240B of the reinforcement posts 240 may be nested such that the reinforcement post 240A is vertically adjustable over a height H2 within the reinforcement post 240B. As can be appreciated by one skilled in the art, this vertical adjustment over the height H2 of the nested reinforcement posts 240A and 240B provides a leveling feature when the grade of at least a portion of the excavated area 190 is uneven. It should also be appreciated that nested ones of reinforcement posts 240 provide for a selectively adjustable height as needed to retain the separator bars 230 and/or components of the side walls 260 (described below) within the predetermined configuration, as the configuration is being constructed. In one embodiment, the nested reinforcement posts 240A and 240B include means for securing a relative vertical relation between them such as, for example, apertures for receiving a fastener or pin, a hook and/or ratchet arrangement, or like coupling mechanism.

In one aspect of the invention, the predetermined locations of the apertures 234 of the separator bars 230 correspond to nominal widths of elongated building material required, recommended or preferred, for use as components to construct the side walls 260 as well as widths of side walls 260 to be constructed. For example, as with the bracket assembly 120, when a first pair of the reinforcement posts 240 of the bracket assembly 220 are placed within corresponding ones of the apertures 234 proximate end 236 of the separator bar 230 a first side wall 262, and components thereof, are retained in place between the first pair of posts 240, and when a second pair of the reinforcement posts 240 are placed within corresponding ones of the apertures 234 proximate the opposing end 238 of the separator bar 230 a second side wall 264, and components thereof, are retained in place between the second pair of posts 240. Similar to the separator bar 130, as shown in FIG. 13, in one embodiment the separator bar 230 is stamped, labeled or otherwise marked with indicia, shown generally at 235, to identify nominal widths of typical building materials, required, recommended or preferred, for use as components to construct the side walls 260 and/or of the side walls 260 themselves. For example, the separator bar 230 includes such indicia 235 proximate its ends 236 and 238 to correspond to locations to construct each of the side walls 160 and 260. For example, a first set of indicia 235A proximate the end 236 corresponds to the location for constructing the first side wall 162 or the first side wall 262, and a second set of indicia 235B proximate the end 238 corresponds to the location for constructing the second side wall 164 or the second side wall 264.

Figure 12C:
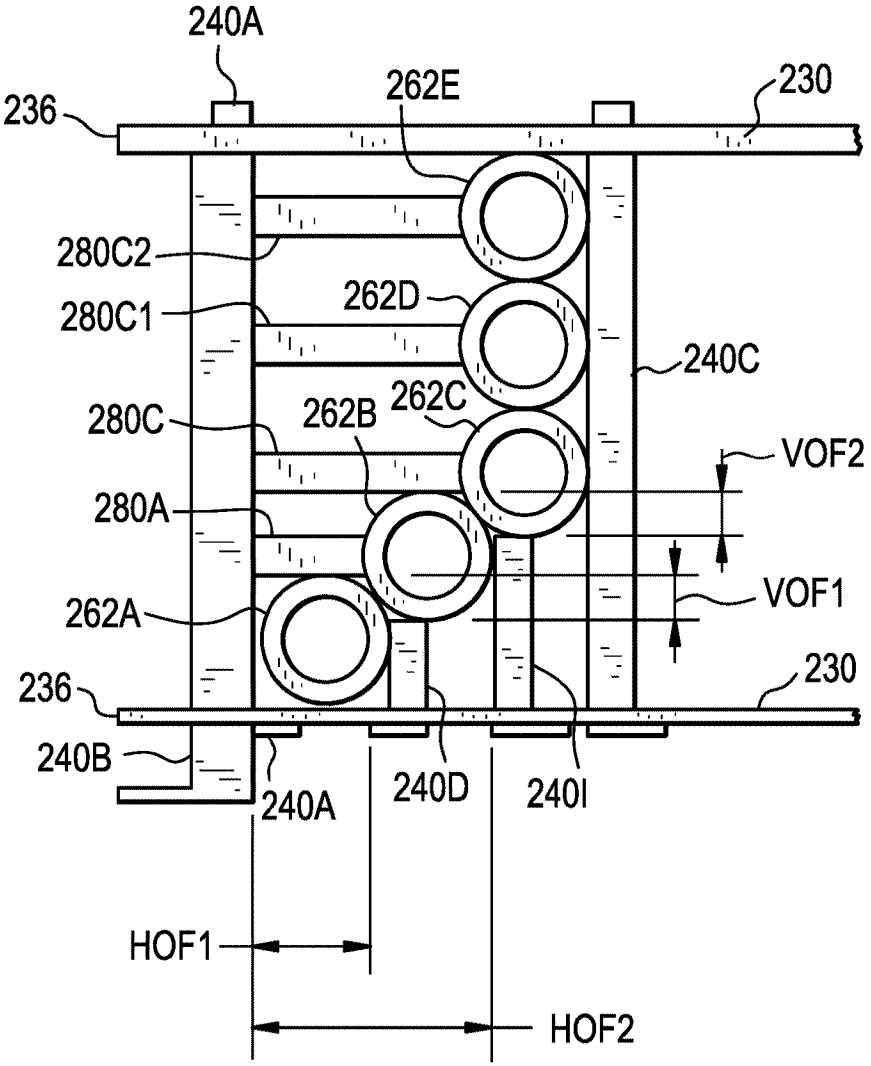
FIG. 12C is partial cross-sectional views of the components of FIG. 12A in accordance with one embodiment of the invention.
Figure 12D:
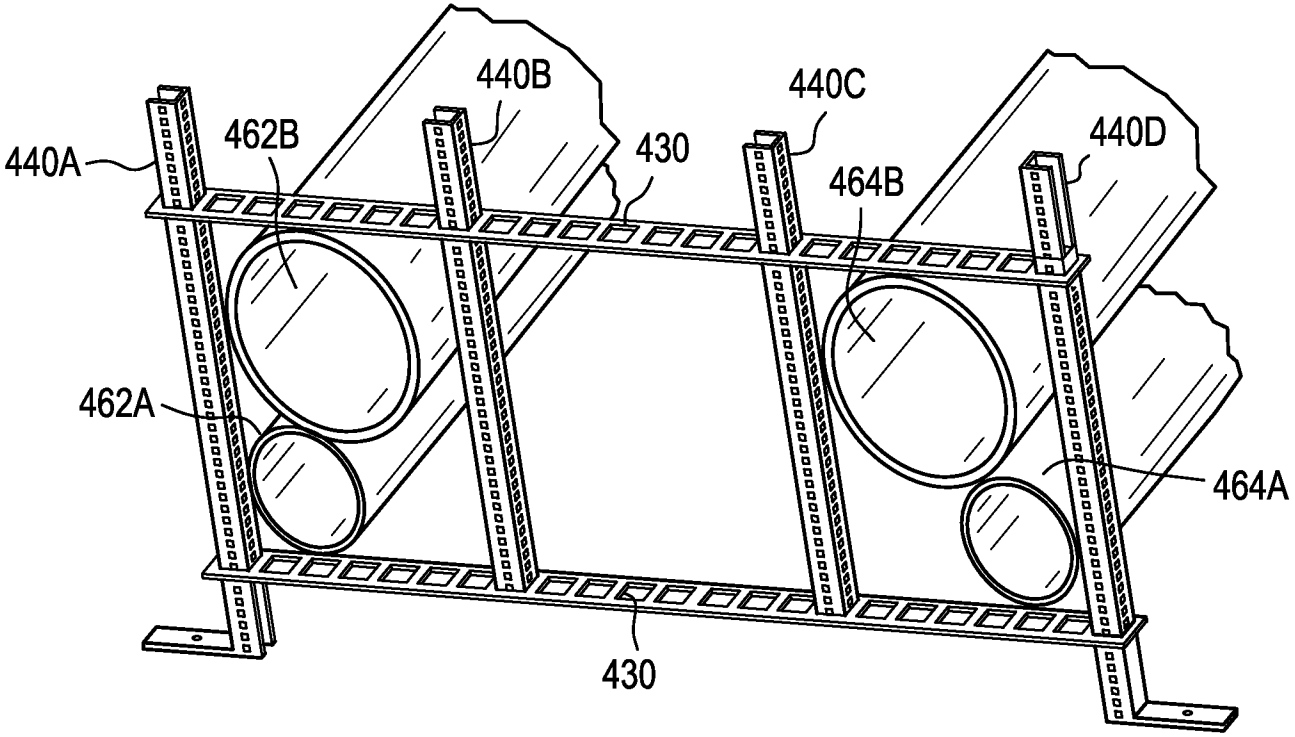
FIG. 12D is a partial cross-sectional view of the components of the form system in accordance with one embodiment of the present invention.

In one aspect of the invention, the bracket assembly 220 permits construction of footings 202 and walls 204 of the foundation 200 having the substantially vertical side walls 162 and 164 of a generally rectangular or square cross-section (e.g., as shown in FIGS. 3 and 6), as well as the side walls 262 and 264 of a generally trapezoidal cross-section, and/or of combinations and variations thereof such as, for example, a footing or wall having a first side wall (e.g., the walls 262) approximating a leg of a trapezoid (e.g., a trapezoidal cross-section with an angular incline of less than ninety degrees (90°)) and a second side wall (e.g., the walls 164) approximating a leg of a rectangle (e.g., a rectangular cross-section with an angular incline of ninety degrees (90°)) as shown in, e.g., FIGS. 12B and 12C. In one embodiment, the bracket assembly 220 includes one or more spacers 280 that mount over or are coupleable to the reinforcement posts 240 at a desired vertical location about the post 240 to permit an offset in the configuration (e.g., a horizontal offset HOF1 and a vertical offset VOF1) of one or more components used to construct the side walls 260 configured to approximate a leg of a trapezoid (FIG. 12B). As shown in FIG. 12D, the one or more components used to construct the sidewalls 260 themselves may be configured to approximate a leg of a trapezoid by, for example, stacking a larger diameter component above a smaller diameter component.

As shown in FIGS. 12A and 12B, during construction of a first side wall 262, the first reinforcement post 240A is nested within the second reinforcement post 240B and the nested posts are disposed within an aperture 234 proximate the end 236 of the separator bar 230 such that the nested reinforcement posts 240A and 240B are disposed externally with respect to the channel 192 (e.g., disposed at about location 192A). A third post 240C is then placed within another aperture 234 inwardly from the end 236 such that the third reinforcement post 240C is disposed internally with respect to the channel 192 (e.g., disposed at about location 192B) to externally and internally bound a first component 262A and a second component 262B (e.g., tubular members) used to construct the first side wall 262 between the nested, externally disposed reinforcement posts 240A and 240B and the internally disposed reinforcement post 240C. As shown in FIG. 12B, a spacer 280A is disposed over the nested, externally disposed reinforcement posts 240A and 240B and cooperates with a fourth reinforcement post 240D to maintain an offset relation between the first component 262A and the second component 262B of the first side wall 262, for example, the horizontal offset HOF1 and the vertical offset VOF1. Similarly, during construction of the second side wall 264, a fifth reinforcement post 240E is nested within a sixth reinforcement post 240F and the nested posts are disposed within an aperture 234 proximate the end 238 of the separator bar 230 such that the nested reinforcement posts 240E and 240F are disposed externally with respect to the channel 192 (e.g., disposed at about location 192C). A seventh reinforcement post 240G is then placed within an aperture 234 inwardly from the end 238 such that the seventh reinforcement post 240G is disposed internally with respect to the channel 192 (e.g., disposed at about location 192B) to inwardly bound a first component 264A and a second component 264B (e.g., tubular members) used to construct the second side wall 264 between the nested, externally disposed reinforcement posts 240E and 240F and the internally disposed reinforcement post 240G. As shown in FIG. 12B, a spacer 280B is disposed over the nested, externally disposed reinforcement posts 240E and 240F and cooperates with an eighth reinforcement post 240H to maintain an offset relation between the first component 264A and the second component 264B of the second side wall 264, for example, the horizontal offset HOF1 and the vertical offset VOF1. One skilled in the art, when viewing FIGS. 12A, 12B and 12D, would appreciate that the illustrated configuration of the bracket assembly 220 permits construction of side walls 262 and 264 forming a footing or foundation having generally trapezoidal cross-section.

It should be appreciated that a plurality of spacers 280 having varying lengths (distance as measured from its coupling with a reinforcement post) and a plurality of reinforcement posts 240 having varying heights may be employed to form footings and/or walls of a predetermined height and a generally trapezoidal cross-section over at least a portion of the predetermined height. For example, as shown in FIG. 12C, a partial cross-sectional view, a spacer 280C is disposed over the nested, externally disposed reinforcement posts 240A and 240B and cooperates with a ninth reinforcement post 240I to maintain an offset relation between the first component 262A, the second component 262B and a third component 262C of the first side wall 262, for example, the horizontal offset HOF1 and the vertical offset VOF1 between the first component 262A and the second component 262B, and a horizontal offset HOF2 between the first component 262A and the third component 262C and a vertical offset VOF2 between the second component 262B and the third component 262C. In one embodiment, a plurality of spacers of similar length as the spacer 280C (e.g., spacers 280C1 and 280C2) may be employed to maintain a common offset as fourth and fifth components 262D and 262E are added to increase the height of the first side wall 262. Accordingly, the first side wall 262 of FIG. 12C includes a lower portion having a generally trapezoidal cross-section, and an upper portion having a generally rectangular cross-section.

While FIGS. 12A to 12C illustrate for clarity, relatively similar vertical and horizontal offsets (e.g., HOF1, HOF2, VOF1, VOF2) between components (e.g., 262A, 262B, 262C, 264A, 264B, 264C) of the side walls 260, it is within the scope of the present invention to vary one or more such offsets as may be required, recommend or preferred to achieve side walls of various configurations. As such, the recited offset relation between components of the side walls 260 should be considered broadly to include various horizontal and vertical spacing of the components of the side walls 260. For example, while not illustrated in FIGS. 12A to 12C, it is also within the scope of the present invention to dispose one or more of the spacers 280 over one or more of the internally positioned (with respect to the channel 192) reinforcement posts 240 such as, for example, the reinforcement post 240C, that inwardly bounds the components of the side wall 260 (e.g., the second component 262B). In one embodiment, the spacers 280 may both internally and externally offset the components such that a cross section of the side walls 260 is configured to approximate a ribbed or corrugated side wall. It should be appreciated that the inventor recognizes that the ribbed or corrugated configuration of the side walls 260 can assist in the flow of water around the side walls 260 and the structure constructed thereon and, as such, may be an integral part of a drainage system or other water remediation system for the structure.

It should also be appreciated that as the height H1 of the side walls 162, 164, 262 and 264 increases, two or more of the bracket assemblies 120 and 220 may be stacked and coupled together. For example, apertures 134 and 234 may be used to receive posts or ties for coupling two or more stacked bracket assemblies 120 and 220. In addition, one or more of the reinforcement posts 140 and 240 may be coupled, interconnected or nested, to support the stacked arrangement.

Figure 12E:
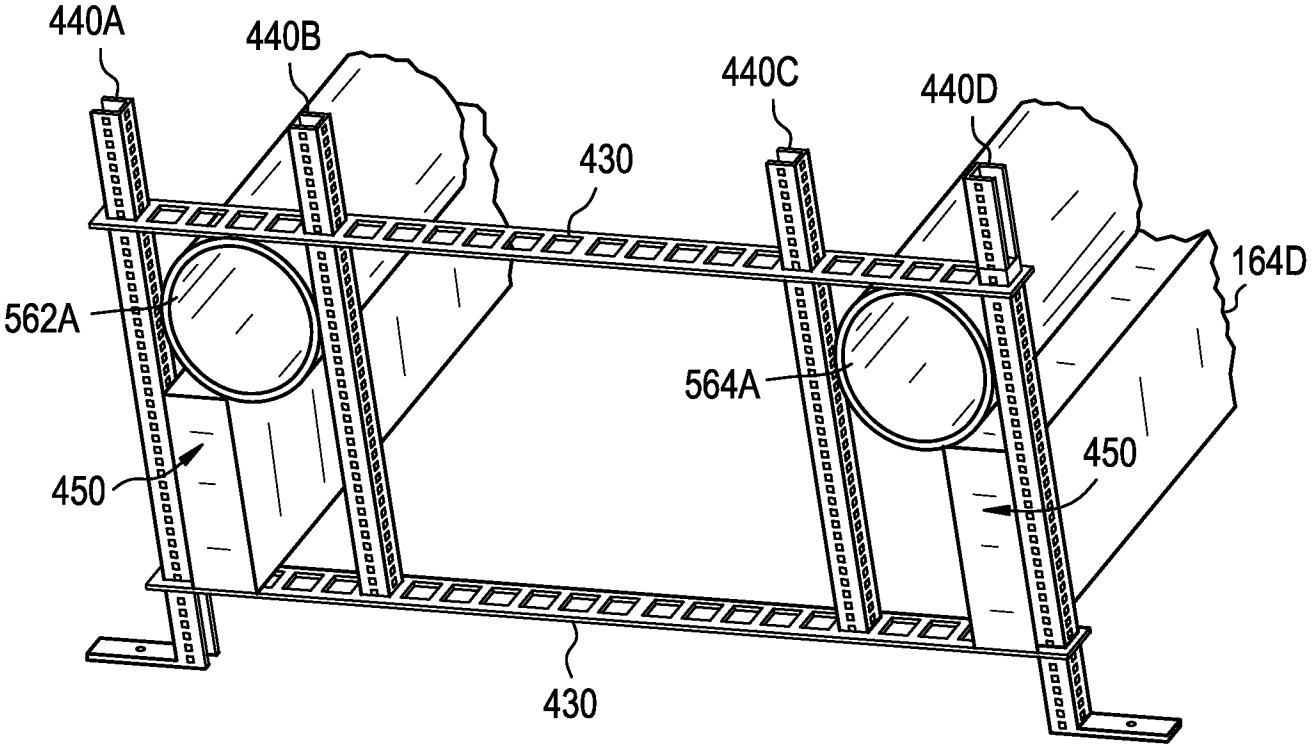
FIG. 12E is a partial cross-sectional view of the components of the form system in accordance with one embodiment of the present invention.

It should also be appreciated that while the vertical and horizontal offsets (e.g., HOF1, HOF2, VOF1, VOF2) between components (e.g., 262A, 262B, 262C, 264A, 264B, 264C) of the side walls 260 are described above as being achieved with one or more of a plurality of spacers 280 coupled to reinforcement posts 240 and having varying lengths, in one embodiment, the components themselves may provide one or more of the desired vertical and horizontal offsets. For example, as shown in FIG. 12D, large diameter conduits 462B and 464B (e.g., a six inch (6")/(15.24 cm) O.D. pipe) are stacked on top of smaller diameter conduits 462A and 464A (e.g., a four inch (4")/(10.16 cm) O.D. pipe), the conduits being held in place between outwardly bounding and inwardly bounding reinforcement posts 440A, 440B, 440C and 440D. In one embodiment, mating pairs of the reinforcement posts (e.g., outwardly bounding post 440A and inwardly bounding post 440B, and outwardly bounding post 440C and inwardly bounding post 440D) are coupled by respective feet portions, and retained in place by separator bars 430. Alternatively, the pairs of reinforcement posts may be formed of a one-piece construction. In still another embodiment, illustrated in FIG. 12E, the plurality of spacers 280 are replaced with conventional building materials 450 such as, for example, lumber, elongated plastics or foam members, and the like, to provide one or more of the desired vertical and/or horizontal offsets between one or more components, such as the conduits 562A and 564A.

Figure 12F:
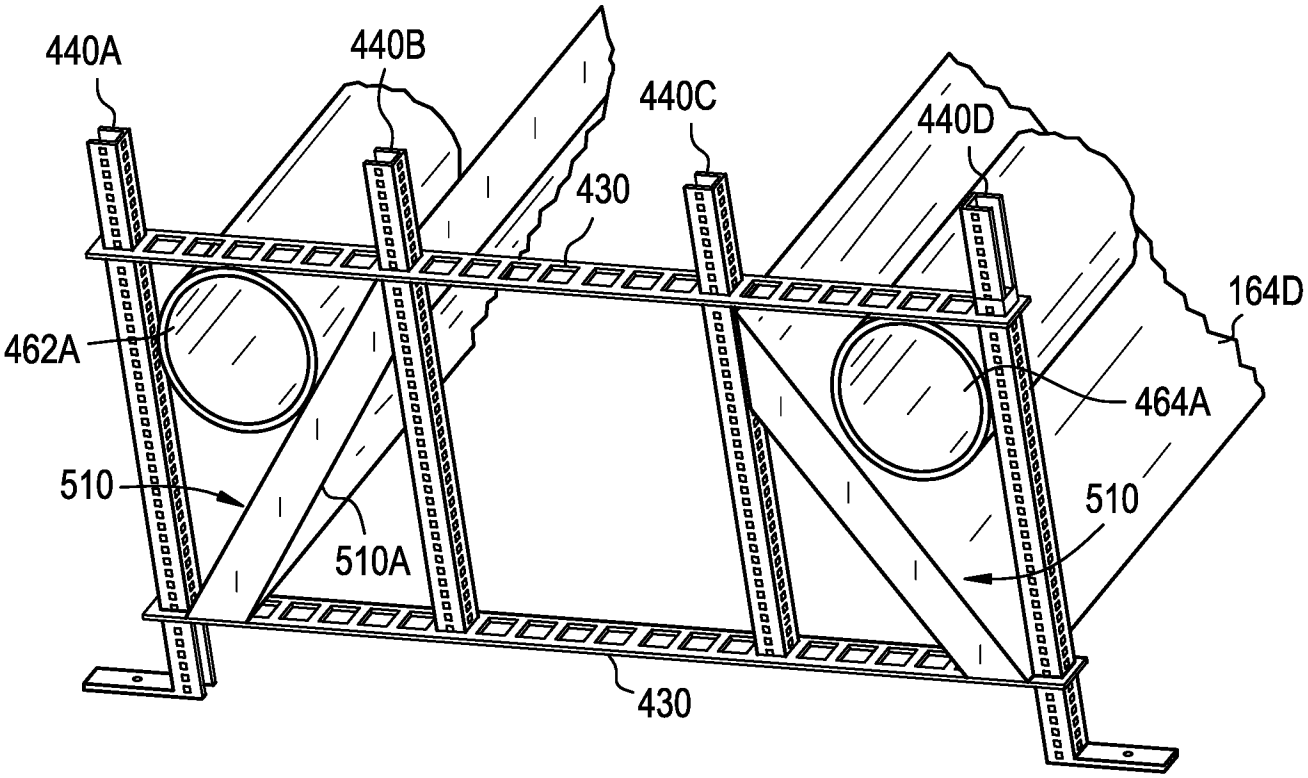
FIG. 12F is a partial cross-sectional view of the components of the form system in accordance with one embodiment of the present invention.
Figure 12G:
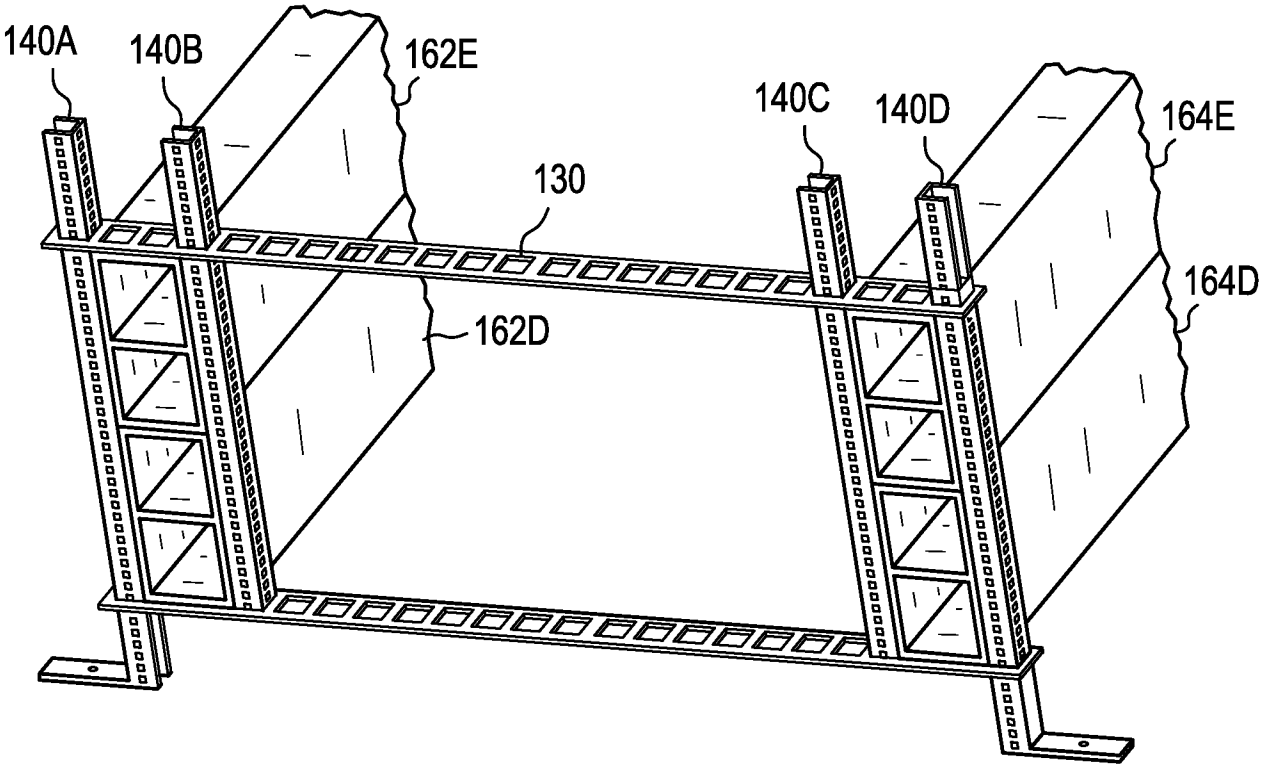
FIG. 12G is a partial cross-sectional view of the components of the form system in accordance with one embodiment of the present invention.
Figure 12H:
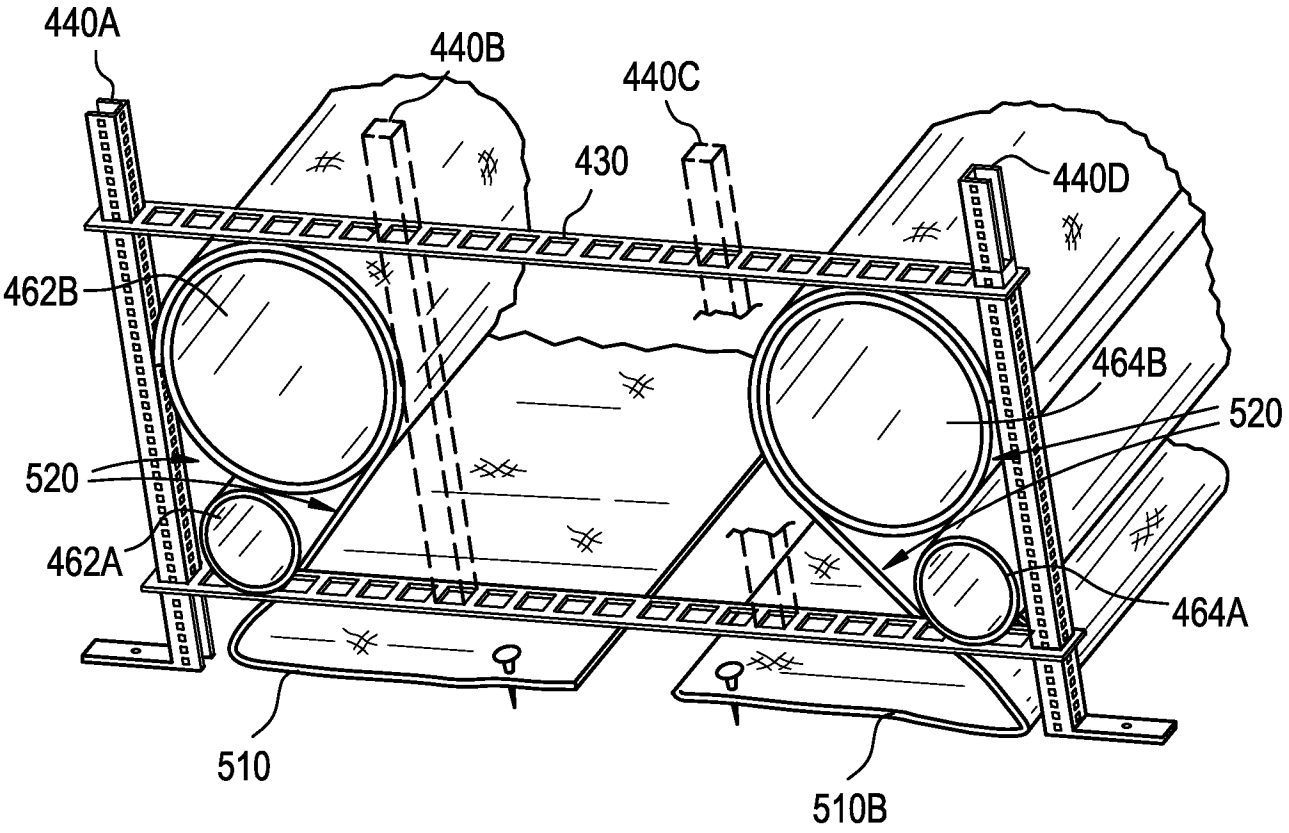
FIG. 12H is a partial cross-sectional view of the components of the form system of FIG. 12D having a barrier installed therein in accordance with one embodiment of the present invention.
Figure 12I:
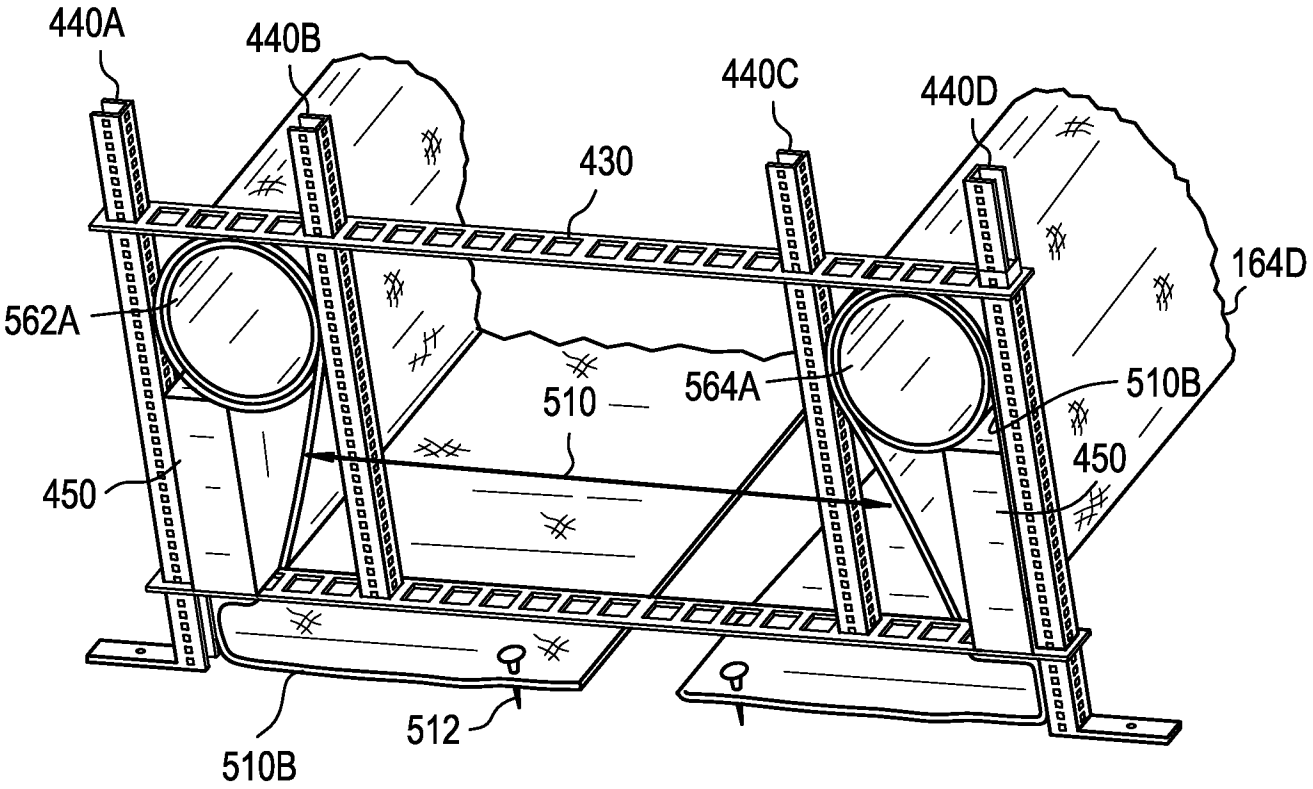
FIG. 12I is a partial cross-sectional view of the components of the form system of FIG. 12E having a barrier installed therein in accordance with one embodiment of the present invention.
Figure 12J:
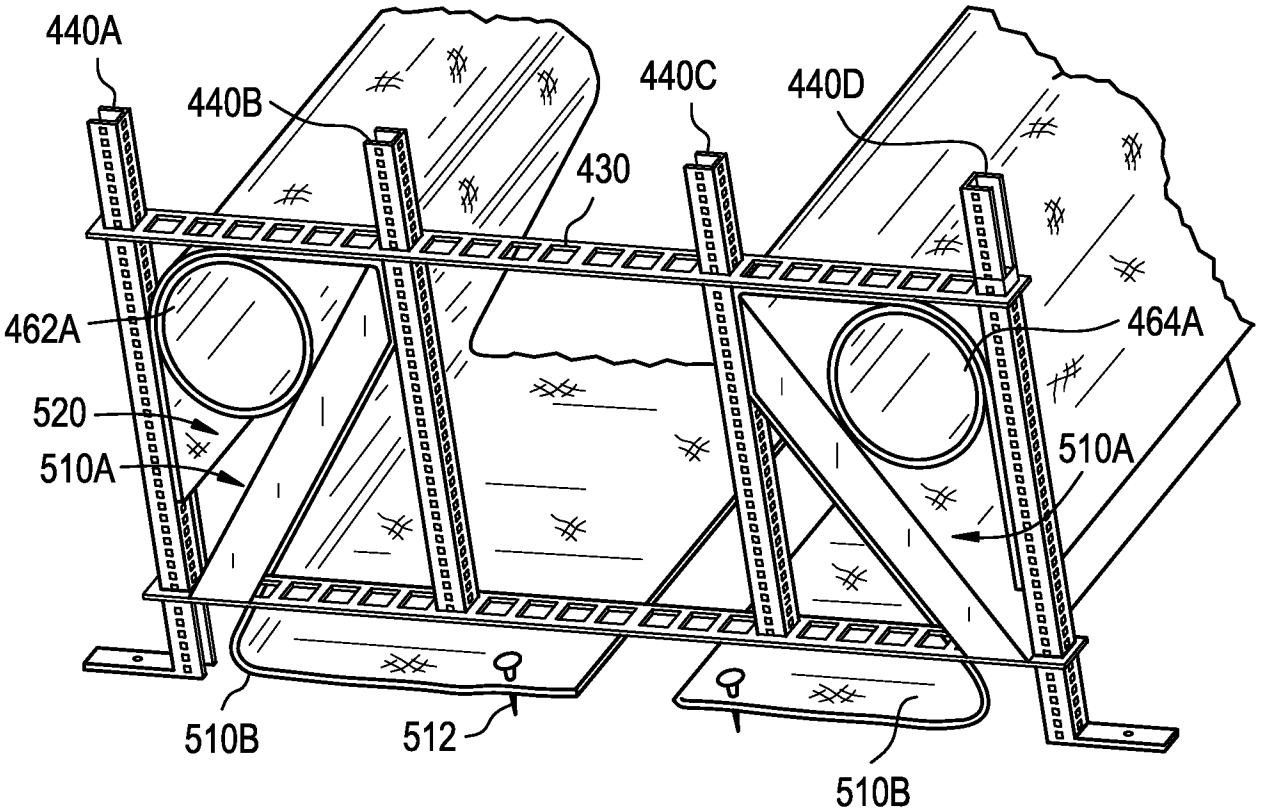
FIG. 12J is a partial cross-sectional view of the components of the form system of FIG. 12F having a barrier installed therein in accordance with one embodiment of the present invention.
Figure 12K:
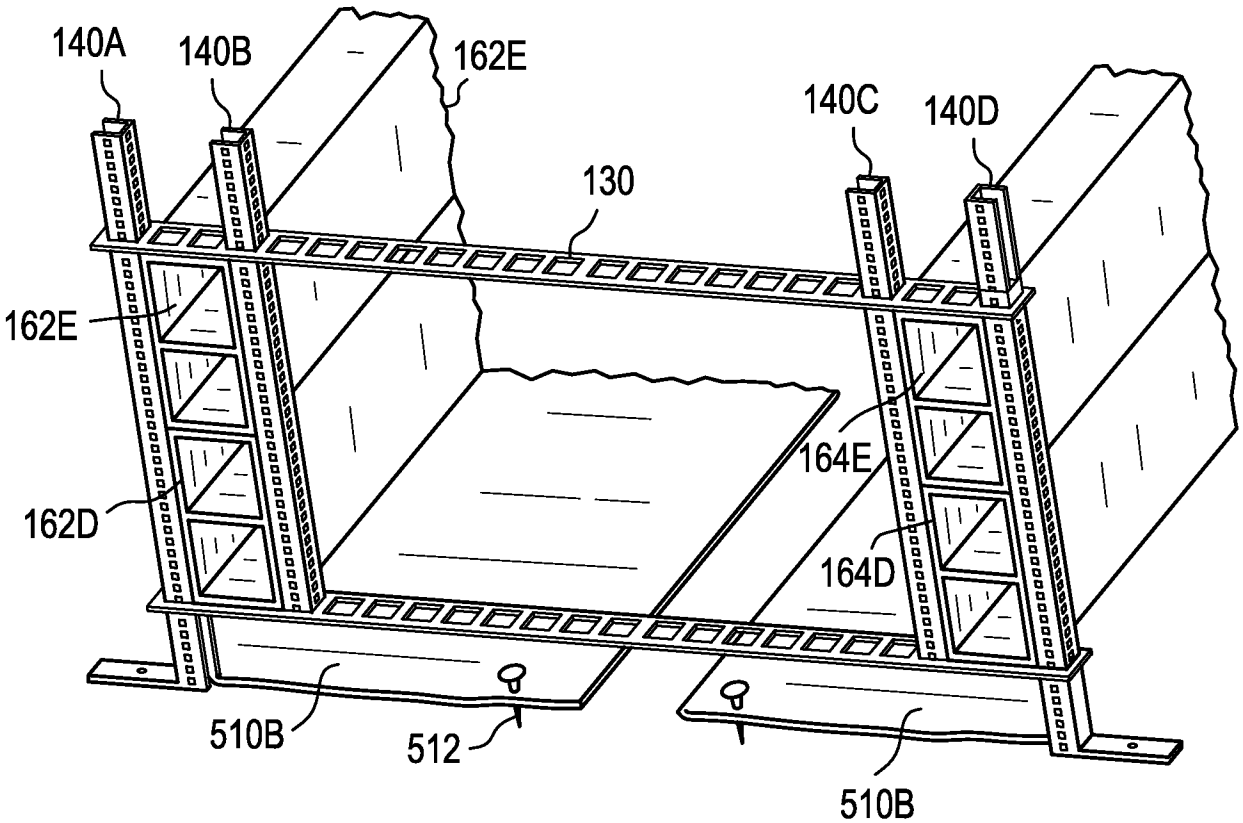
FIG. 12K is a partial cross-sectional view of the components of the form system of FIG. 12G having a barrier installed therein in accordance with one embodiment of the present invention.

Barrier Provides Thermal Conductivity, Insulating and/or Fire Resistant Characteristics In still another embodiment, illustrated in FIG. 12F, a barrier 510 is disposed between the outwardly bounding and inwardly bounding posts, e.g., 440A and 440B, and 440C and 440D, to support the conduits 462A, 462B, 464A and 464B. For example, in one embodiment shown in FIG. 12F, the barrier 510 may be comprised of a foam insulation board 510A such as a STYROFOAM® brand foam or other polystyrene foam board, or any other suitably rigid synthetic or organic material ("Styrofoam" is a registered trademark of Dow Chemical Company, Midland, Mich. USA). As shown in FIG. 12H, the barrier 510 may be comprised of a fabric or sheet material 510B such as a landscape fabric. In one embodiment, the fabric or sheet material 510B is comprised of or treated to provide fire resistant properties. In one embodiment, the fabric 510B is secured to the soil via, for example, stakes 512. In the embodiment shown in FIG. 12H, the fabric 510 is wrapped around large diameter conduits 462B and 464B and proximate smaller diameter conduits 462A and 464A thereby forming the channel 192. In the embodiment shown in FIG. 12I, the fabric 510B is wrapped around large diameter conduits 462B and 464B and proximate building materials 450. In one embodiment as shown in FIG. 12J, the foam board 510A and the sheet material 510B cooperate to form a first layer and a second layer of the barrier 510 wherein the fabric 510B is wrapped around conduits 462A and 462B and proximate the foam board 510A. In one embodiment as shown in FIG. 12K, the fabric 510B is wrapped around conduits 162D and 162E.

Figure 12L:
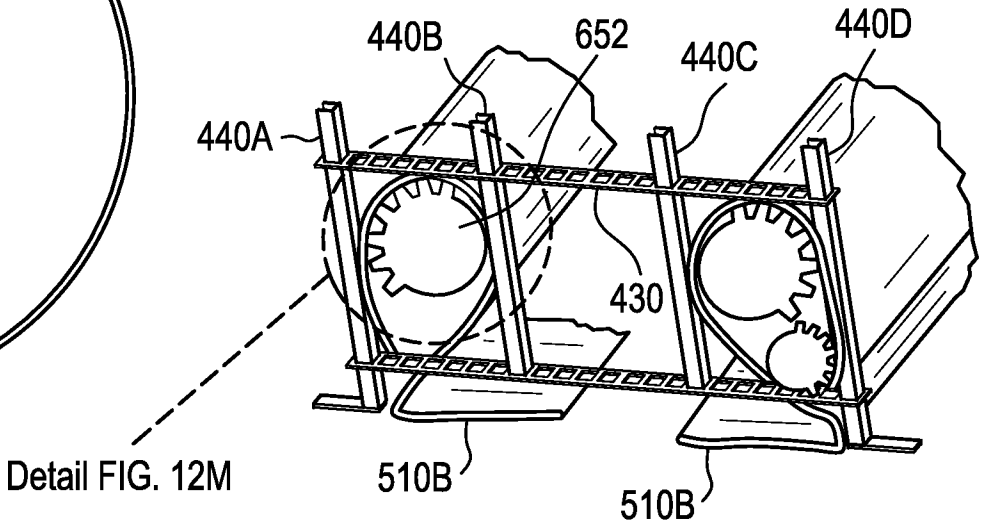
FIG. 12L is a partial cross-sectional view of the components of the form, drainage, gas remediation, leaching field system, in accordance with embodiments of the present invention.
Figure 12M:
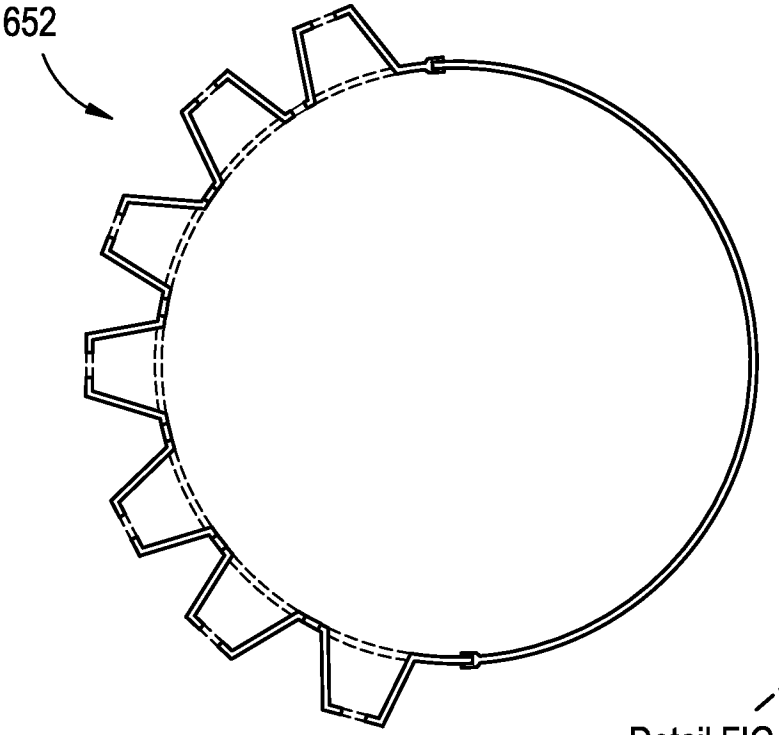
FIG. 12M is a detail view of a component of the form system of FIG. 12L.

It should be appreciated that, in one embodiment, the barrier 510 functions to prevent backfill, e.g., gravel, from inadvertently filling the channel 192, as well as increases an air flow and/or drainage area in a volume 520 about the conduits 462A, 462B, 464A and 464B (FIG. 12H). For example, the barrier 510 prevents backfill from entering the volume 520 between the outwardly bounding post (e.g., 140A, 440A) and the inwardly bounding post (e.g., 140B, 440B). In one embodiment, the barrier 510 surrounds or envelops the conduits 462A, 462B, 464A and 464B to prevent backfill from entering the volume 520. In one embodiment, illustrated in FIGS. 12L and 12M, one or more of the conduits 462A, 462B, 464A and 464B may be comprised in a gravel-less conduit configuration 652 wherein an outside diameter of the conduit has protrusions 654 extending therefrom.

Figure 15A:
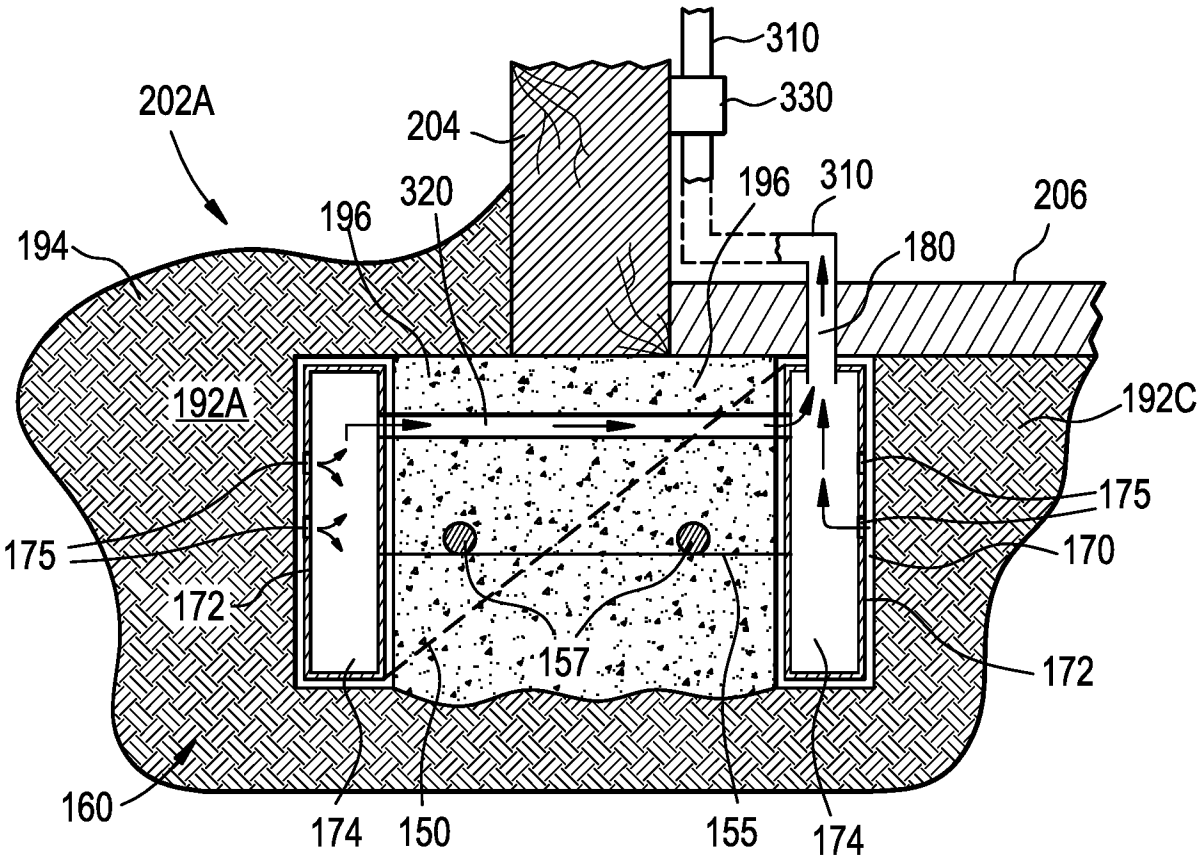
FIG. 15A is a partial cross-sectional view of a form system having an integral ventilation system formed therein in accordance with one embodiment of the present invention form system in use.
Figure 15B:
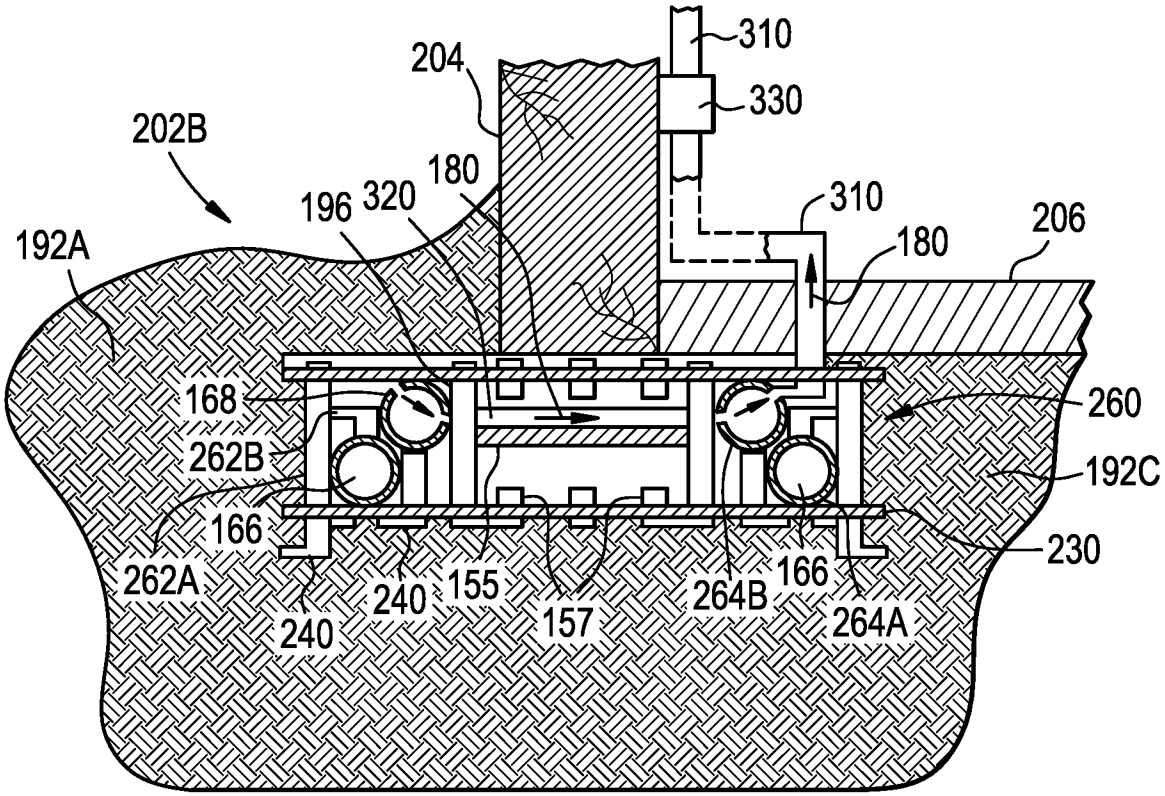
FIGS. 15B and 15C are partial cross-sectional views of a form system having an integral ventilation system formed therein in accordance with one embodiment of the present invention form system in use.

As shown in FIGS. 15A and 15B, sectional views of embodiments of the inventive form 100 are illustrated for use in forming elements of the foundation 200, namely, a footing 202A having a generally rectangular cross-section and a footing 202B having a generally trapezoidal cross-section. The side walls 160 of the footing 202A are formed of the spaced apart conduits 170 having the corrugated walls 172 and the interior cavity 174, and the side walls 260 of the footing 202B are formed of the stacked, offset conduits (e.g., components 162A, 162B, 164A, 164B, 262A, 262B, 264A and 264B) having the interior cavity 166. One or more of the plurality of straps 150 and spreaders 155 are disposed about the side walls 160 and 260 to prevent a spreading apart of connected conduits as the concrete 196 is being poured. Once the concrete 196 cures, the straps 150 and the spreaders 155 also assist in maintaining the integrally formed footing 202 and, components thereof, in position. For example, once cured, the straps 150 and the spreader 155 can be used in a permanent installation for example, to support rebar supports 157 placed in the channel 192 prior to pouring the cement.

As noted above, the interior cavity 174 of interconnected conduits 170 and the interior cavity 166 of the interconnected components 262A, 262B, 264A and 264B cooperate to provide the passage 180 for air flow around the interior and exterior of the footings 202 when the passage is accessed by means of, for example, another pipe or other conduit 310 either exteriorly or interiorly (e.g., through a floor or slab 206) after the structure has been completed and unacceptable levels of radon or other gases are detected to vent the radon laden air or other unwanted gas such as, for example, carbon dioxide, methane, into the atmosphere. In one embodiment, one or both of the conduit 170 and components 262A, 262B, 264A and 264B include means for receiving gases from the soil 194 within the areas 192A and 192C external and internal to footing 202 and under the slab 206. For example, the corrugated walls 172 of the conduit 170 include apertures or slots 175 to receive gases permeating from soil 194 within the areas 192A and 192C external and internal to footing 202 and under the slab 206. Similarly, one or more of the stacked components 262A, 262B, 264A, 264B include apertures or slots 168 to receive the gases permeating from the soil 194 within the areas 192A and 192C proximate the footing 202 and under the slab 206.

As shown in FIGS. 15A to 15E, one or more cross-venting pipes or conduits 320 may be installed during construction communicating between the two corrugated conduits 170 and/or components 262A, 262B, 264A, 264B of the footing 202 to provide the passage 180 for air flow communication between the corresponding conduits 170 and/or components 262A, 262B, 264A, 264B to facilitate venting and/or removal of gases, moisture and the like (FIGS. 15A, 15B, and 15D) and/or the addition of heated or cooled air within, and when coupled to conduit 310, outside the structure (FIGS. 11C, 11D, 15C and 15E). Thus, the cross-venting pipes or conduits 320 provide for a reverse air flow. Such reverse air flow provides for directing outside air to an area under a slab or similar foundation base. As a result, the temperature can be equalized to substantially reduce or eliminate condensation and moisture from forming in the area under a slab or similar foundation base. Accordingly, mold and other harmful microorganisms are prevented from forming. In one embodiment, an in-line force air system 330 is coupled to the pipe 310 to increase the volume of air flow within the passage 180 and facilitate remediation of the unwanted gases and/or the addition of desirable air (e.g., heated or cooled air).

Figure 20:
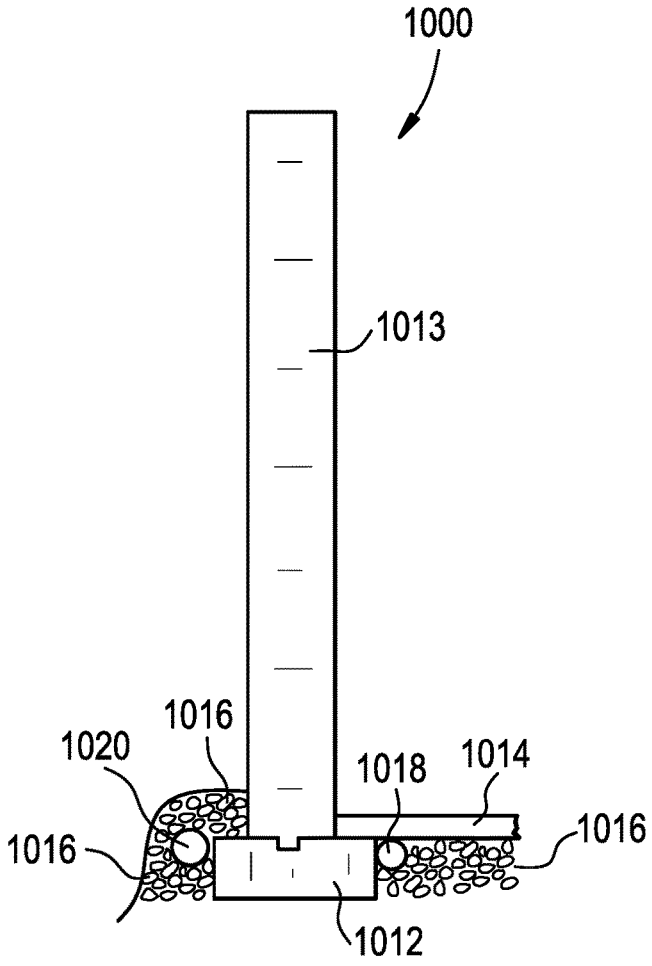
FIG. 20 PRIOR ART
FIG. 20 is an elevation view of a conventional foundation footing and accompanying drainage components.
Figure 21:
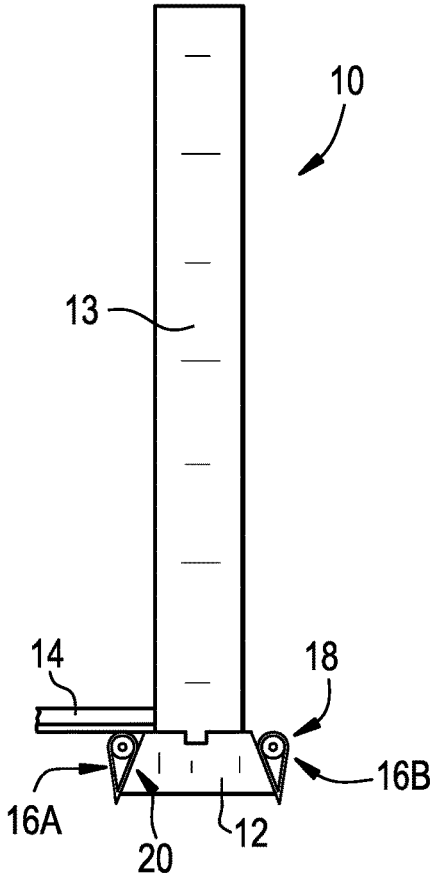
FIG. 21 is an elevation view of a gravel-less foundation footing integrally formed with a drainage and ventilation system in accordance with one embodiment of the present invention.

Drainage:

As seen in FIGS. 20 and 21, a conventional foundation footing system 1000 (FIG. 20), including accompanying drainage components, is compared to a gravel-less foundation footing system 10 (FIG. 21) integrally formed with a drainage and ventilation system in accordance with one embodiment of the present invention. In the conventional system 1000 shown in FIG. 20, conventional building forms are installed and a foundation footing 1012 is formed to support a wall 1013 and slab 1014 of a structure of interest. After the footing 1012 is formed, gravel 1016 is used to backfill an excavated area proximate the footing 1012. Gravel is conventionally used to promote drainage of liquid, e.g., ground and subsurface water, away from the foundation. Typically, a pipe 1018 is installed proximate to and inwardly from the footing 1012 beneath the slab 1014 to receive, capture and thereby mitigate radon and/or other unwanted gas (e.g., carbon dioxide, methane, and the like)

from entering the building. Typically, a drainage pipe 1020 is installed proximate to and outwardly from the footing 1012 to receive, capture and thereby drain water away from the structure. Additional gravel 1016 is used as backfill around the drainage pipe 1020 and over the footing 1012 to further promote drainage of water away from the foundation. In some cases, a fabric is positioned over the gravel 1016 and pipe 1020 to prevent silt and debris from entering and blocking passages through the gravel 1016 and pipe 1020. As can be appreciated, installing the conventional foundation footing system 1000 including the accompanying drainage components is a multi-step, time-consuming process that requires a variety of building materials, both of which increases the cost of construction.

Alternatively and as shown in FIG. 21, the foundation footing system 10 integrally formed with a drainage and ventilation system enables the formation of a footing 12 to support a wall 13 and slab 14 of the structure without the need to backfill or place gravel beneath the slab 14 or around the footing 12 to assist drainage. The foundation footing system 10 is a gravel-less foundation footing system and includes a first form assembly 16A and a second form assembly 16B that form sidewalls forming the footing 12, for example by cooperating with the bracket system 220 to form the sidewalls 260 of FIGS. 15B and 15C, while integrally forming a drainage system 18 and a ventilation system 20 as further described herein below.

Figure 12N:
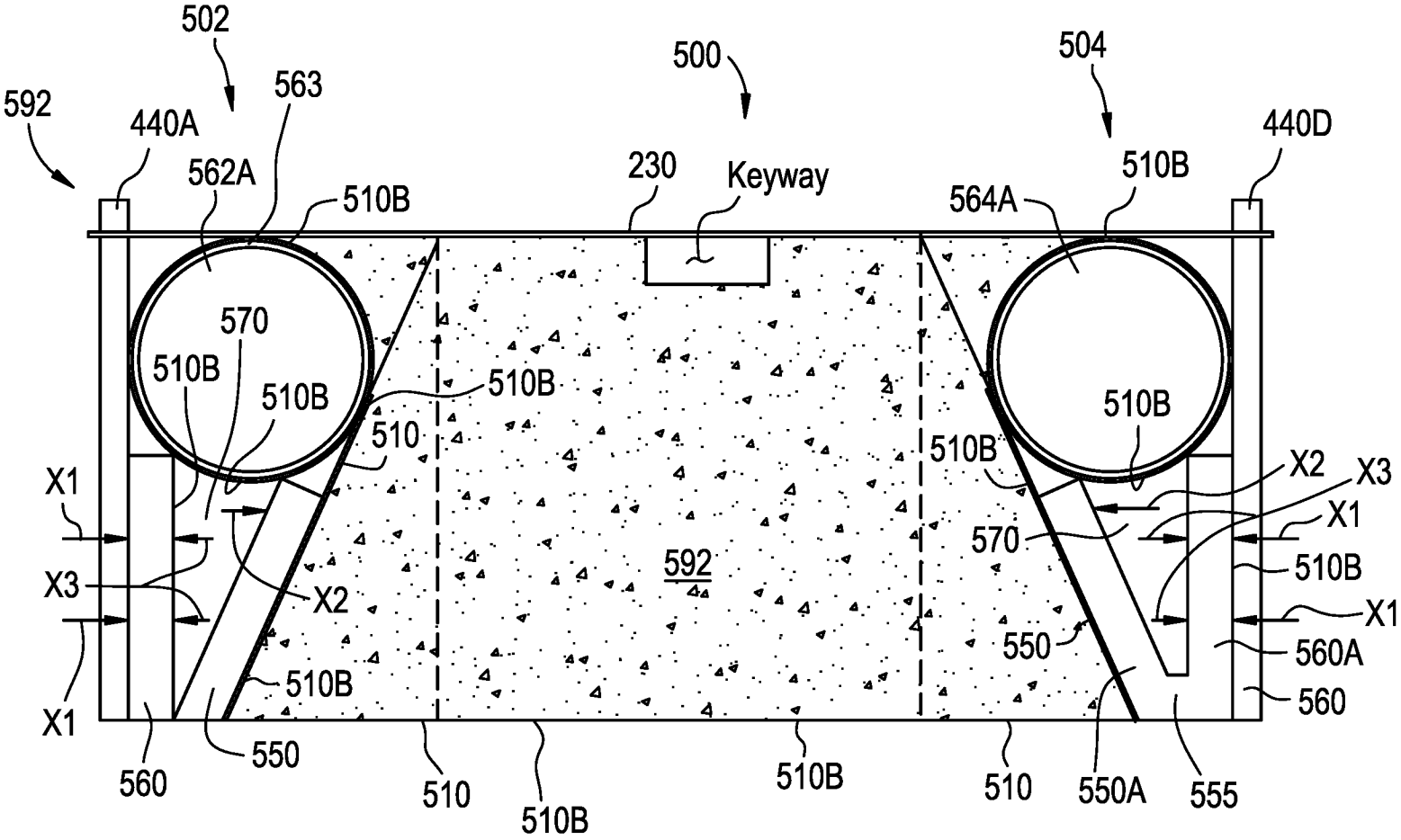
FIG. 12N is a partial cross-sectional view of the components of the form system in accordance with one embodiment of the present invention.
Figure 12O:
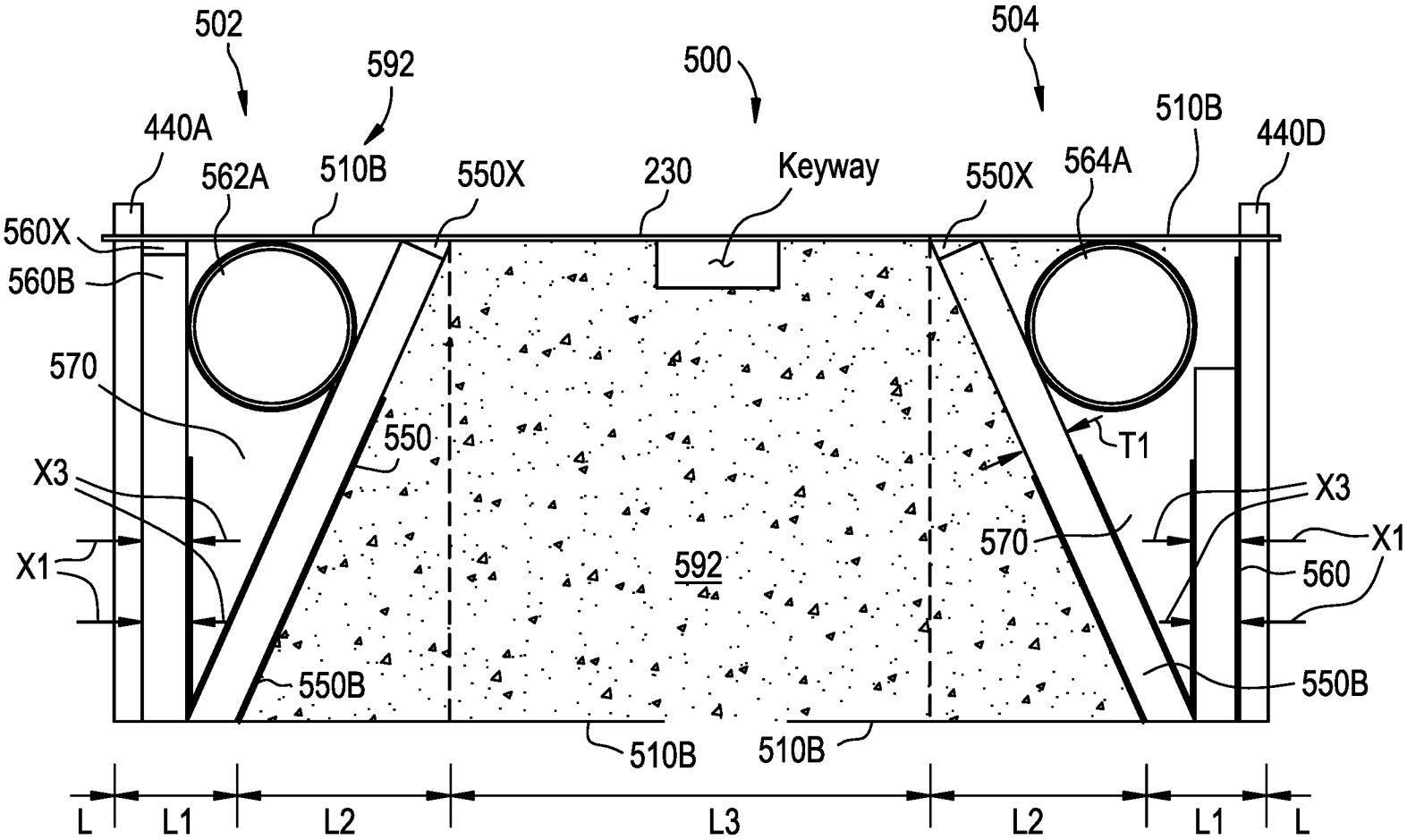
FIG. 12O is a partial cross-sectional view of the components of the form system in accordance with one embodiment of the present invention.
Figure 15C:
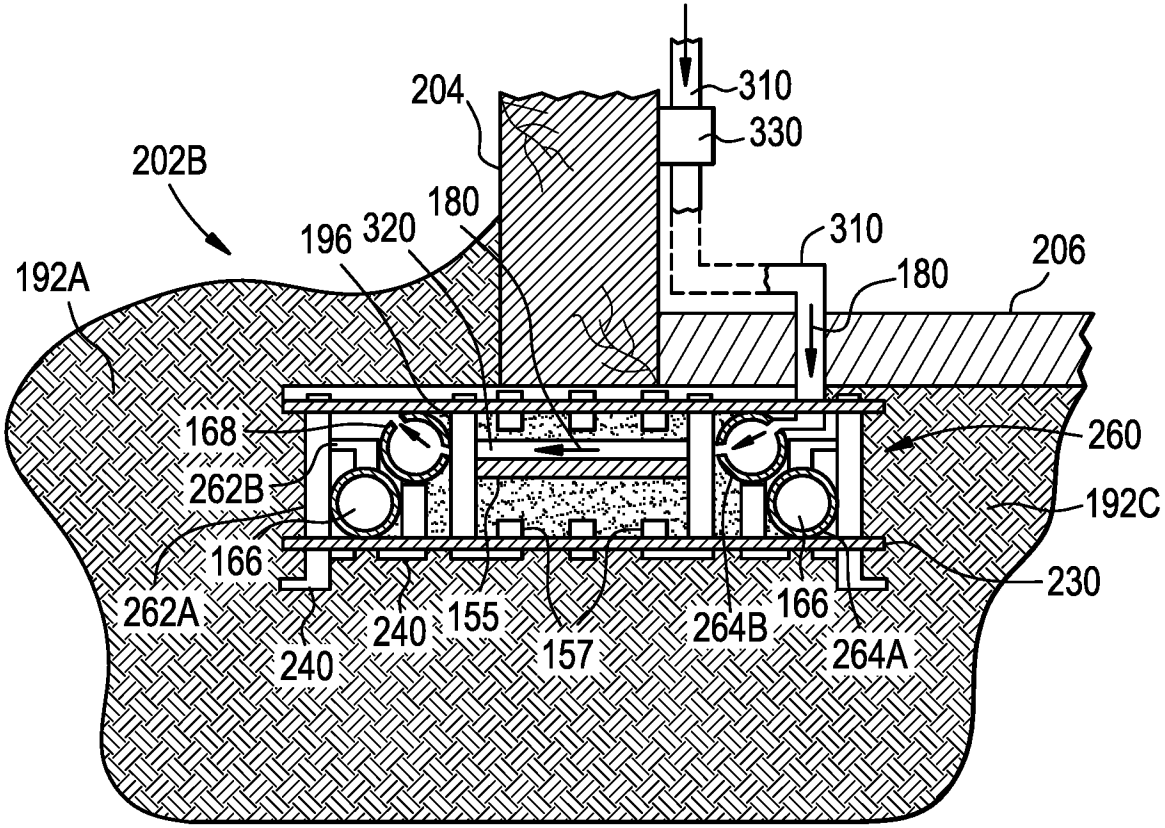
Figure 15D:
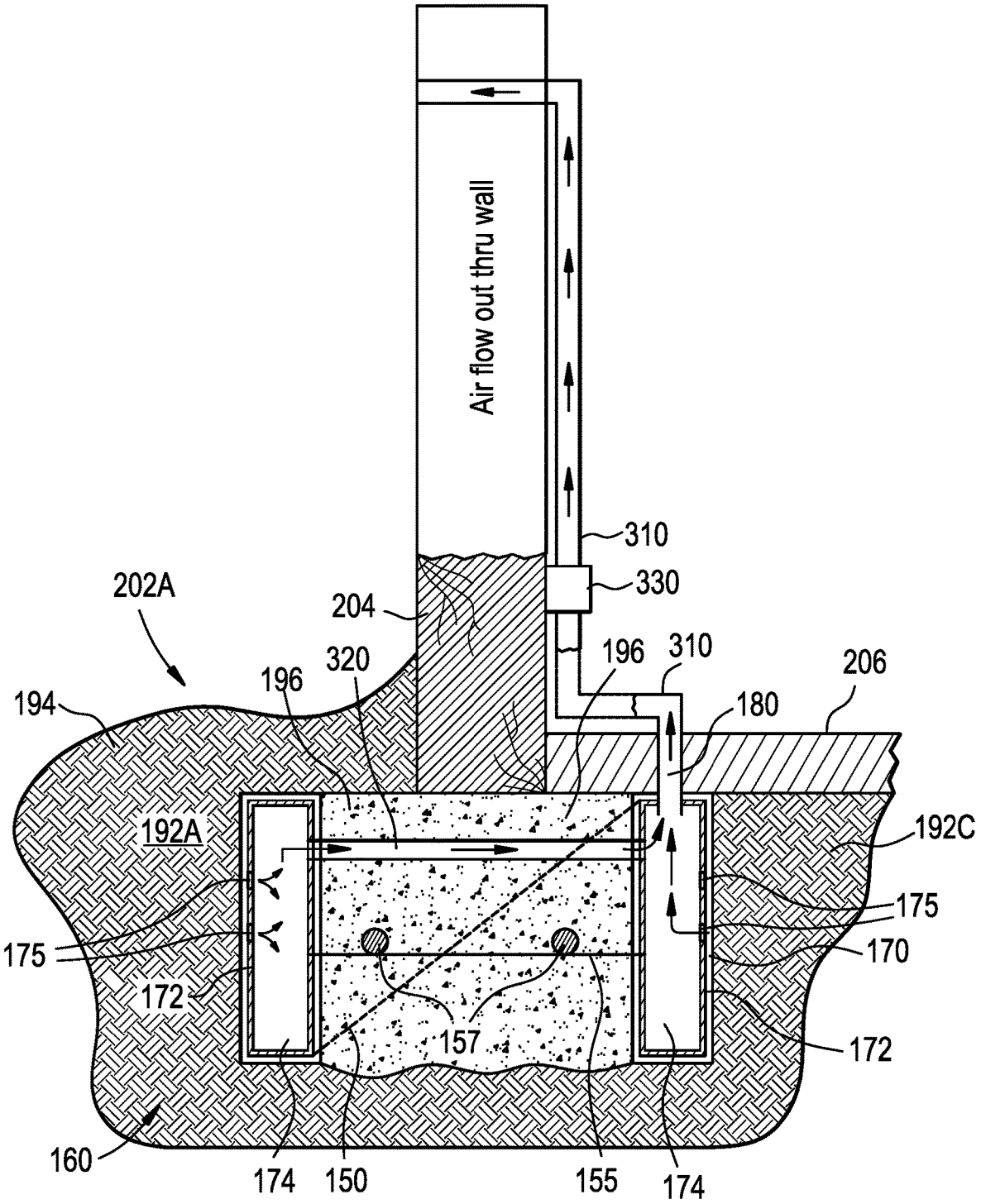
FIGS. 15D and 15E are partial cross-sectional views of another embodiment of the form system of FIG. 15A.
Figure 15E:
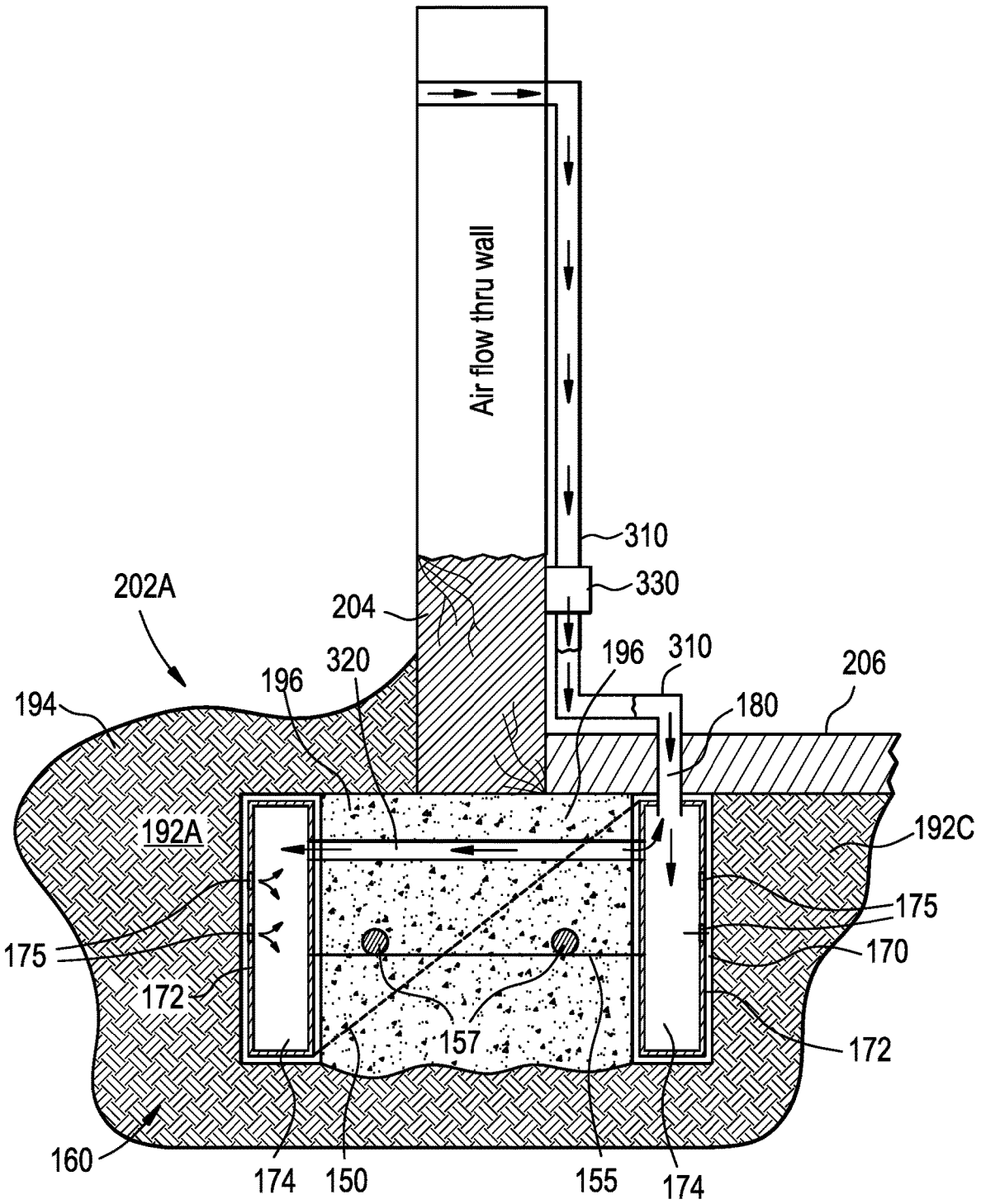

One embodiment of a gravel-less form system 500 according to the present invention is shown in FIGS. 12N and 12O and includes a first form assembly 502 and a second form assembly 504 that form sidewalls, for example the sidewalls 260 of FIGS. 15B and 15C. Referring first to FIG. 12N, the barrier 510 includes the sheet material 510B disposed around a first drainage core 550, a second drainage core 560, and a conduit such as, for example, conduits 562A and 564A. In one embodiment, conduits 562A and 564A are perforated conduits such that a flow of ground or subsurface water can be received therein. In one embodiment, the sheet material 510B is formed into a sleeve or pocket 563 thereby eliminating the need for a conduit wrapped by a barrier material. Alternatively, conduits 562A and 564A extend through the sleeve 563. An open volume or drainage cavity 570 is thereby formed bounded by the first drainage core 550, the second drainage core 560, and the respective conduit 562A and 564A. In one embodiment, the first drainage core 550 is a single-drainage core 550A (e.g., permits passage of a flow of liquid through the core in one direction) and the second drainage core 560 is a dual-drainage core 560A (e.g., permits passage of liquid through the core in two directions). Thus, a passageway is created through the dual-drainage core 560A in the direction indicated by the arrows X1 at a penetration point in the foundation wherein the footing intersects the wall to advantageously create a flow away from the penetration point into the drainage cavity 570. As a result, water (e.g., ground or subsurface water) can enter the drainage cavity 570 via the respective fabric-wrapped conduit 562A and 564A and the respective dual-drainage core 560A and be transferred away from the structure along an perimeter thereof (e.g., in a direction into and out of the drawing sheet). In one embodiment, the first drainage core 550 and the second drainage core 560 are in fluid communication, or are joined at a connection point 555, so that water may pass from one drainage core to the other. The liquid that enters the drainage cavity 570 may pass to the first drainage core 550 in the direction indicated by arrows X2 and to the second drainage core 560 in the direction indicated by arrows X3 and thereby equalize the volume of liquid (e.g., ground or subsurface water) in the first and second drainage cores 550 and 560 and in the drainage cavity 570 flowing along the perimeter of the structure. In one embodiment, the second drainage core 560 provides a passageway for seeping air and other gases such as, for example, carbon dioxide, radon, methane, and the like, as well as water.

In one embodiment and as shown in FIG. 12O, the first drainage core 550 is configured as an extended first drainage core 550B extending to an upper point 550X proximate the top of the respective conduit 562A or 564A. In one embodiment, the second drainage core 560 is an extended second drainage core 560B extending to an upper point 560X proximate the top of the respective conduit 562A or 564A. In one embodiment, both the extended first drainage core 550B and the extended second drainage core 560B are employed.

The bottom portion of the illustrated form system defines an overall length $L_{FORM}$. A first length $L_{FORM1}$ is defined by the combined thicknesses of each of the first drainage core 550 and the second drainage core 560. A second length $L_{FORM2}$ is defined by the horizontal distance traversed by the first drainage core 550. A third length $L_{FORM3}$ is defined by the distance between drainage cores assemblies, or from one second length $L_{FORM2}$ defined by one first drainage core 550 to another second length $L_{FORM2}$ defined by another first drainage core 550. Thus, as shown in FIG. 12O, the overall length $L_{FORM}$ is a summation of $L_{FORM1}$, $L_{FORM2}$, $L_{FORM3}$, $L_{FORM2}$ and $L_{FORM1}$. In one embodiment, the overall length $L_{FORM}$ is up to about thirty-six (36) inches (91.44 cm). In one embodiment, the overall length $L_{FORM}$ is about twenty-eight (28) inches (71.12 cm). In one embodiment, each of the first drainage core 550 and the second drainage core 560 define a thickness T1 of about one (1) inch (2.54 cm); thus, the first length $L_{FORM1}$ is about two (2) inches (5.08 cm). In one embodiment, the second length $L_{FORM2}$ is about six (6) inches (15.24 cm). In one embodiment, the third length $L_{FORM3}$ is about twelve (12) inches (30.48 cm).

As shown in FIGS. 12N and 12O, the configuration of the first drainage core 550, the second drainage core 560, and the respective conduit 562A and 564A form a channel 592 and provide for the elimination of a dual-reinforcement post configuration. As shown in FIGS. 12N and 12O, such a configuration includes only outwardly bounding reinforcement posts 440A and 440D and does not require respectively corresponding inwardly bounding reinforcement posts 440B and 440C. However, the use of respectively corresponding inwardly bounding reinforcement posts 440B and 440C with the configuration of the first drainage core 550, the second drainage core 560, and the respective conduit 562A and 564A is another embodiment of said configuration and is considered within the scope of the present invention.

The configuration of the first drainage core 550, the second drainage core 560, and the respective conduit 562A and 564A further provide for installing said configuration at varying height/depth and having varying width/conduit diameter. Thus, effective gravel-less drainage can be configured for a wide variety of drainage applications.

Figure 12P:
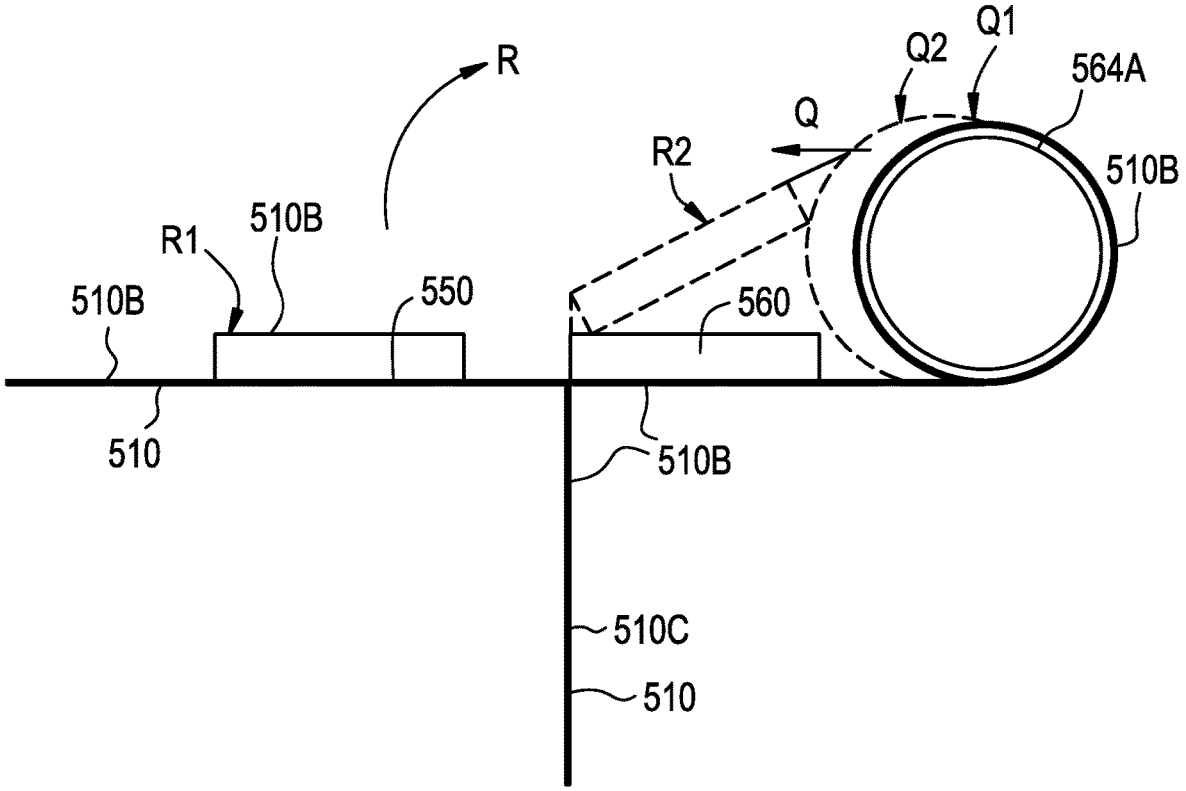
FIG. 12P is a depiction of several components of the form system of FIG. 12N prior to assembly for installation in the form system.

As shown in FIG. 12P, one embodiment of the first drainage core 550, the second drainage core 560 and the conduit 564A includes individually wrapping the components with the barrier 510 or a sheet material 510C of the fabric 510B and setting the components in relation to one another as shown in FIG. 12P, namely, the first drainage core 550 and the second drainage core 560 disposed proximate to one another and substantially flat in one plane (e.g., horizontally or vertically), and the conduit 564A disposed proximate to the second drainage core 560 on the opposite side of the position of the first drainage core 550. The wrapped first drainage core 550 is rotated in the direction indicated by the arrow R from a first position R1 to a second position R2. The wrapped conduit 564A is moved toward the first and second drainage cores 550 and 560 in the direction indicated by the arrow Q from a first position Q1 to a second position Q2.

Figure 12Q:
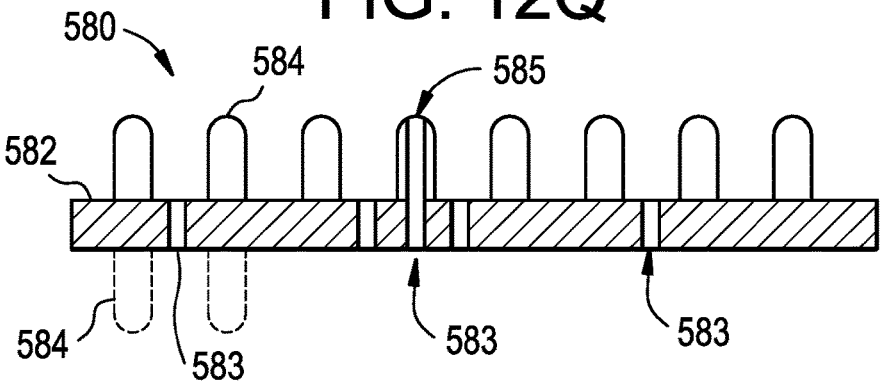
FIG. 12Q is a sectional view of a drainage core of the form system of FIG. 12N.

One embodiment of a drainage core 580 for use as the first and/or second drainage cores 550 and 560 is shown in FIG. 12Q. The drainage core 580 includes a base 582 and protrusions 584 extending outwardly from at least one side thereof. In one embodiment, the protrusions 584 extend outwardly from both sides thereof. In one embodiment, the base 582 is permeable and defines one or more apertures 583 extending therethrough for increased drainage through the core 580. In one embodiment, one or more of the protrusions 584 includes an aperture 585 extending therethrough for increased drainage through the core 580. In one embodiment, the aperture 585 is in fluid communication with one of the apertures 583 for increased drainage through the core 580.

In one embodiment, the core 580 is fabricated from a polyethylene thermoplastic. In one embodiment, the core 580 is a structural foam polyethylene. In one embodiment, the core 580 is a dimpled polymeric core. In one embodiment, the core 580 is a dimpled high impact polystyrene core. In one embodiment, the wrapped first and second drainage cores 550 and 560 are formed using geocomposite materials such as for example a geotextile-geonet composite, a geotextile-geomembrane composite, a geomembrane-geogrid composite, and a geotextile-polymer core composite. In one embodiment, the wrapped first and second drainage cores 550 and 560 are formed using a polystyrene core wrapped by polypropylene filter fabric.

Figure 16:
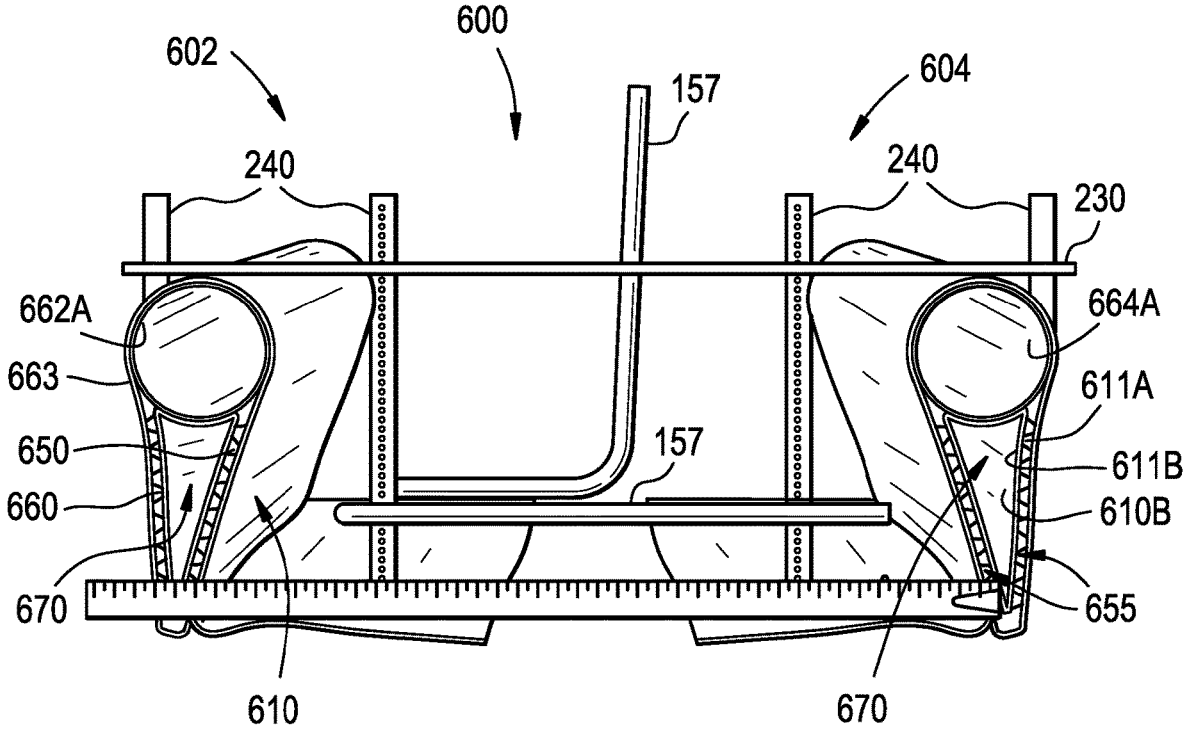
FIG. 16 is a partial cross-sectional view of the components of the form system in accordance with one embodiment of the present invention.

One embodiment of a gravel-less form system 600 according to the present invention is shown in FIG. 16 and includes a first form assembly 602 and a second form assembly 604 that form sidewalls, for example the sidewalls 260 of FIGS. 15B and 15C. A barrier 610 includes an inner layer 611A wrapped by an outer layer 611B. In one embodiment, the inner layer 611A includes a first drainage core 650 and a second drainage core 660. In one embodiment, the outer layer 611B is a fabric 610B. The fabric 610B is wrapped around the first drainage core 650, the second drainage core 660, and a conduit such as for example conduits 662A and 664A. In one embodiment, conduits 662A and 664A are perforated conduits. In one embodiment, the fabric 610B is formed into a sleeve or pocket 663 through which the conduits 662A and 664A extend. An open volume or drainage cavity 670 is thereby formed bounded by the first drainage core 650, the second drainage core 660, and the respective conduit 662A and 664A.

Figure 17:
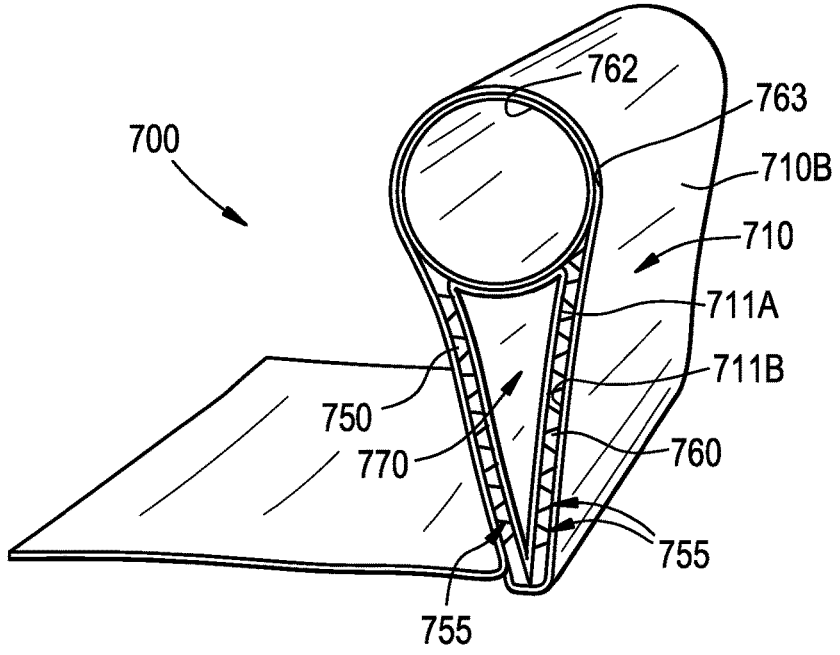
FIG. 17 is a partial cross-sectional view of a foundation footing drainage and ventilation system in accordance with one embodiment of the present invention.

One embodiment of a gravel-less foundation footing drainage and ventilation system 700, employable according to aspects of the present invention without the aforementioned bracket assemblies 120 and 220, is shown in FIG. 17. A barrier 710 includes an inner layer 711A wrapped by an outer layer 711B. In one embodiment, the inner layer 711A includes a first drainage core 750 and a second drainage core 760. In one embodiment, the outer layer 711B is a fabric 710B. The fabric 710B is wrapped around the first drainage core 750, the second drainage core 760, and a conduit 762. In one embodiment, conduit 762 is a perforated conduit. In one embodiment, the fabric 710B is formed into a sleeve or pocket 763 through which the conduit 762 extends. An open volume or drainage cavity 770 is thereby formed bounded by the first drainage core 750, the second drainage core 760 and the conduit 762. As described below, the inventor has discovered a plurality of innovative uses of the drainage and ventilation system 700, and other components described above, in athletic field, golf courses and other applications, in addition to the uses within and proximate to building structural components.

Figure 18A:
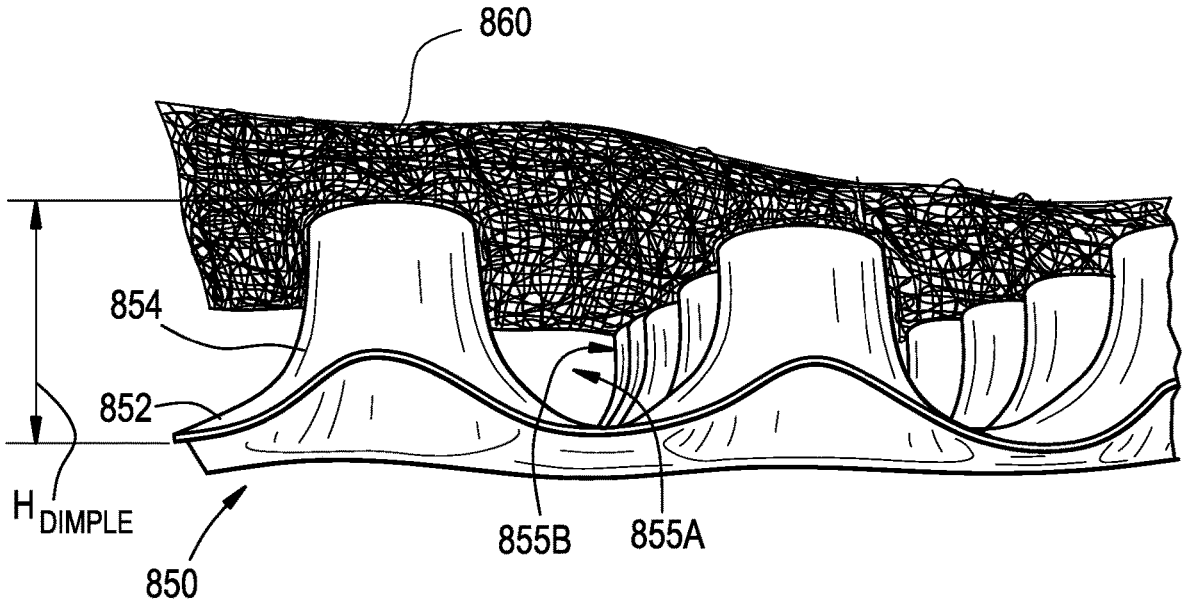
FIG. 18A is detail view of a component of the form system of FIG. 16 and the foundation footing drainage and ventilation system of FIG. 17.

In one embodiment and as shown in FIGS. 16 and 17, one or both of the first and second drainage cores 650, 660 and/or 750, 760 include a plurality of surface elevations and/or depressions therein that form a plurality of respective passages 655 and 755 extending vertically and horizontally through the respective drainage cores. As a result, water (e.g., ground or sub-surface water) and seeping air and other gases can enter the drainage cavity 670, 770 via the respective fabric-wrapped drainage core 650 and/or 660, and 750 and/or 760. In one embodiment, one or both of the first and second drainage cores 650, 660 and/or 750, 760 include one or more apertures extending therethrough for increased drainage through the core as shown with respect to the core 580 in FIG. 12Q. FIG. 18A illustrates one embodiment of a drainage core 850 for use with any of the systems described herein above. The drainage core 850 is comprised of a sheet 852 having a plurality of dimples 854 formed therein, for example by stamping, punching or molding. In one embodiment, the dimples 854 are form in a row-column configuration including a first plurality of passages 855A extending in a first direction through the core 850 (e.g., along a row of dimples 854), and a second plurality of passages 855B extending in a second direction through the core 850 in a substantially orthogonal orientation to the first plurality of passages 855A (e.g., along a column of dimples 854). It should be appreciated that depending on orientation of the drainage core 850, the passages 855A and 855B permit liquid and gas to vertically and horizontally traverse the core 850. In one embodiment, each of the dimples 854 extends upwardly from the sheet 852 a height $H_{DIMPLE}$ of about 0.437 inch (1.110 cm). It should be appreciated that varying (e.g., increasing or decreasing) the height $H_{DIMPLE}$ of the dimples 854 typically varies (e.g., proportionally increases or decrease) the volume of air, gas and/or liquid captured, retained and moved/carried in the drainage core 850. For example, a larger height $H_{DIMPLE}$ increases the flow capacity of the drainage core 850, and a smaller height $H_{DIMPLE}$ decreases the flow capacity of the drainage core 850. It should be appreciated that the present invention is not limited to a specific height $H_{DIMPLE}$ and that the height may be varied to accommodate certain drainage design and application specific parameters for good water management practices. FIG. 18C shows generally, at 870, various characteristics of example geotextile fabric and well as various characteristics, at 880, of example heights ($H_{DIMPLE}$) referred to as "Cusp Height" and corresponding liquid flow rates (gals/min per foot of width).

Figure 18B:
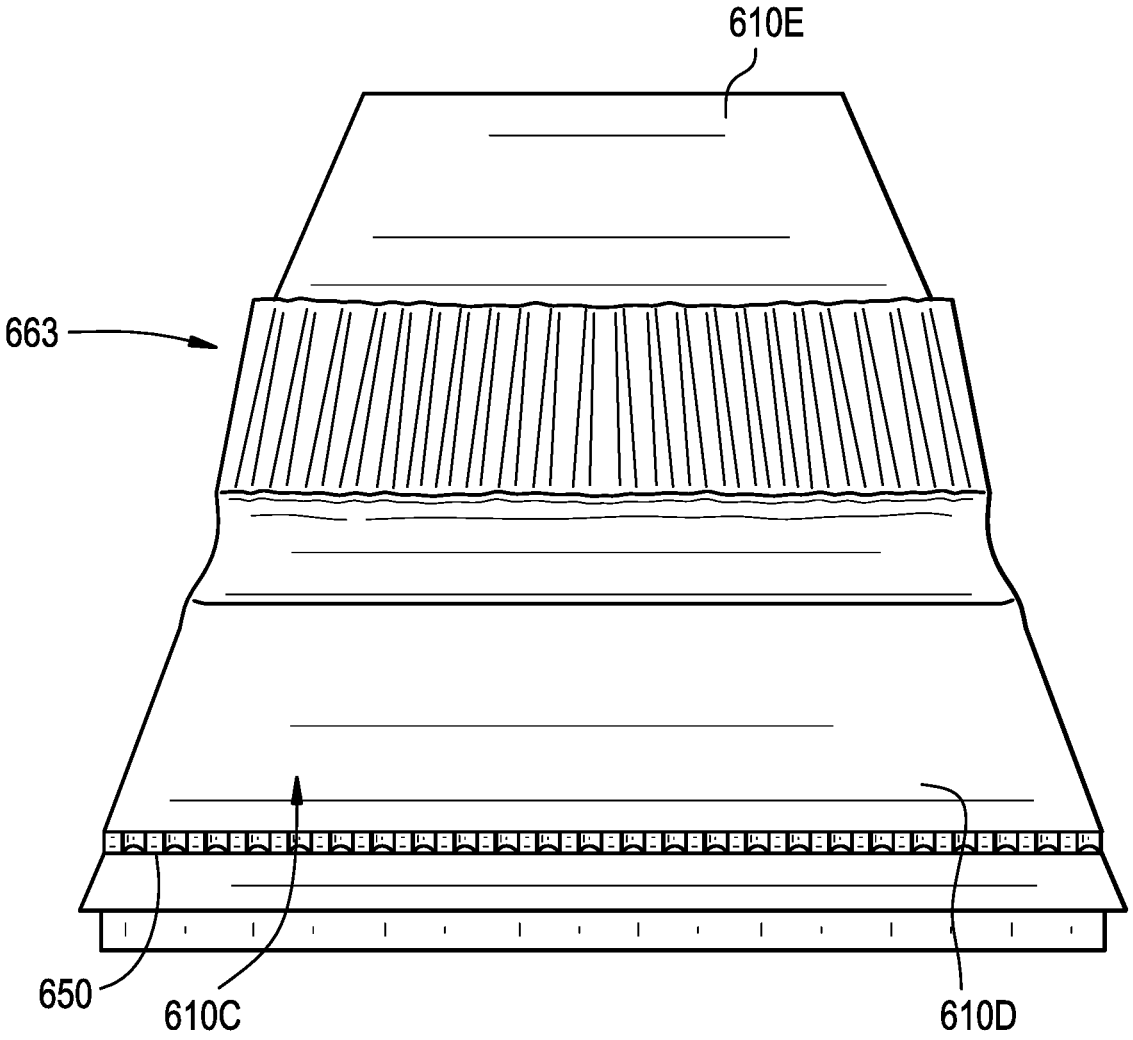
FIG. 18B is a depiction of several components of the form system of FIG. 16 and the foundation footing drainage and ventilation system of FIG. 17 prior to assembly for installation in the form system.

As shown in FIG. 18B, one embodiment of forming system, the barrier 610, 710 includes providing a sheet 610C of the fabric 610B integrally formed with the sleeve 663 extending between portions 610D and 610E of fabric sheet 610C wherein such portions respectively envelope or wrap the respective drainage core, for example first drainage core. In one embodiment, one of the conduits, for example conduit 662A, is disposed within the sleeve 663. In one embodiment, the fabric 610B is a thermally bonded nonwoven geotextile that exhibits a high grab tensile strength and elongation as set forth in ASTM D4632, Grab Breaking Load and Elongation of Geotextiles. In one embodiment, the fabric 610B exhibits a grab tensile strength greater than 100 lbs. and an elongation that is greater than fifty percent (50%). In one embodiment, the fabric 610B provides for hydraulic conductivity therethrough as set forth in ASTM D4491, Standard Test Methods for Water Permeability of Geotextiles by Permittivity. In one embodiment, the fabric 610B exhibits a permittivity greater than 1 $s^{-1}$ and a permeability of at least 0.05 cm/s. In one embodiment, the fabric 610A is Typar® SF geotextile commercially available from E. I. du Pont de Nemours and Company. ("Typar" is a registered trademark of E. I. du Pont de Nemours and Company).

The inventor has discovered that in some embodiments, the barriers 510, 610 and 710 form a thermal break when disposed as an interface between, for example, a slab wall or floor and fill (e.g., vertical and/or horizontal configuration), and/or as a drainage blanket or mat (e.g., horizontal configuration) disposed at or below the surface of backfill. For example, as shown FIGS. 18A and 18B, the barriers 610 and 710 are comprised of an inner drainage cores 650 or 660, and 750 or 760, shown generally at 850, wrapped by an outer fabric 610B and 710B, shown generally at 860, such that the fabric 610B and 710B (fabric 860) encloses the cores 650 or 660 and 750 or 760 (core 850). The inventor has recognized that in this fabric-core-fabric "layered" or "sandwich" configuration forms a thermal break between the surfaces that it is disposed between. For example, the opposing fabric layers at least partially, if not fully, isolate temperature of the abutting materials. On one side, the slab wall or floor, and on the opposing side, the fill of gravel or soil. The inner drainage cores 650 or 660, and 750 or 760 (e.g., core 850) permit an air flow that further acts to isolate temperature differentials between the opposing fabric layers 610B and 710B (fabric 860) and the abutting materials. The inventor has also discovered that this isolation may be further enhanced, supplemented or controlled as desired by introducing conditioned air or liquid within the drainage cores 650 or 660 and 750 or 760 (core 850). For example, warm or cool air or liquid may be passed through the drainage cores 650 or 660 and 750 or 760 to regulate the temperature differential between the abutting materials.

In one embodiment, the drainage cores 550, 560, 650, 660, 750 and/or 760 are fabricated by, for example: (i) continuous thermal forming of the core; (ii) perforating the core; (iii) cutting the core to a desired width; and (iv) laminating the fabric 610B, 710B or fabric sheet 610C to the core in the desired configuration. In one embodiment, an adhesive 673 is disposed on one or both outer surfaces 672 and 674 of the respective drainage core 650, 660 prior to applying the fabric 610B or fabric sheet 610C. In one embodiment, the adhesive 673 is compliant with the composition requirements set forth in 21 C.F.R. § 175.105 ("Indirect Food Additives: Adhesives and Components of Coatings; Adhesives"). In one embodiment, the adhesive 673 exhibits an open time (i.e., the time after the adhesive is applied during which a serviceable bond is made) of greater than thirty (30) seconds. In one embodiment, the adhesive 673 is Hot Melt 1066 commercially available from Tailored Chemical Products, Inc.

Figure 19:
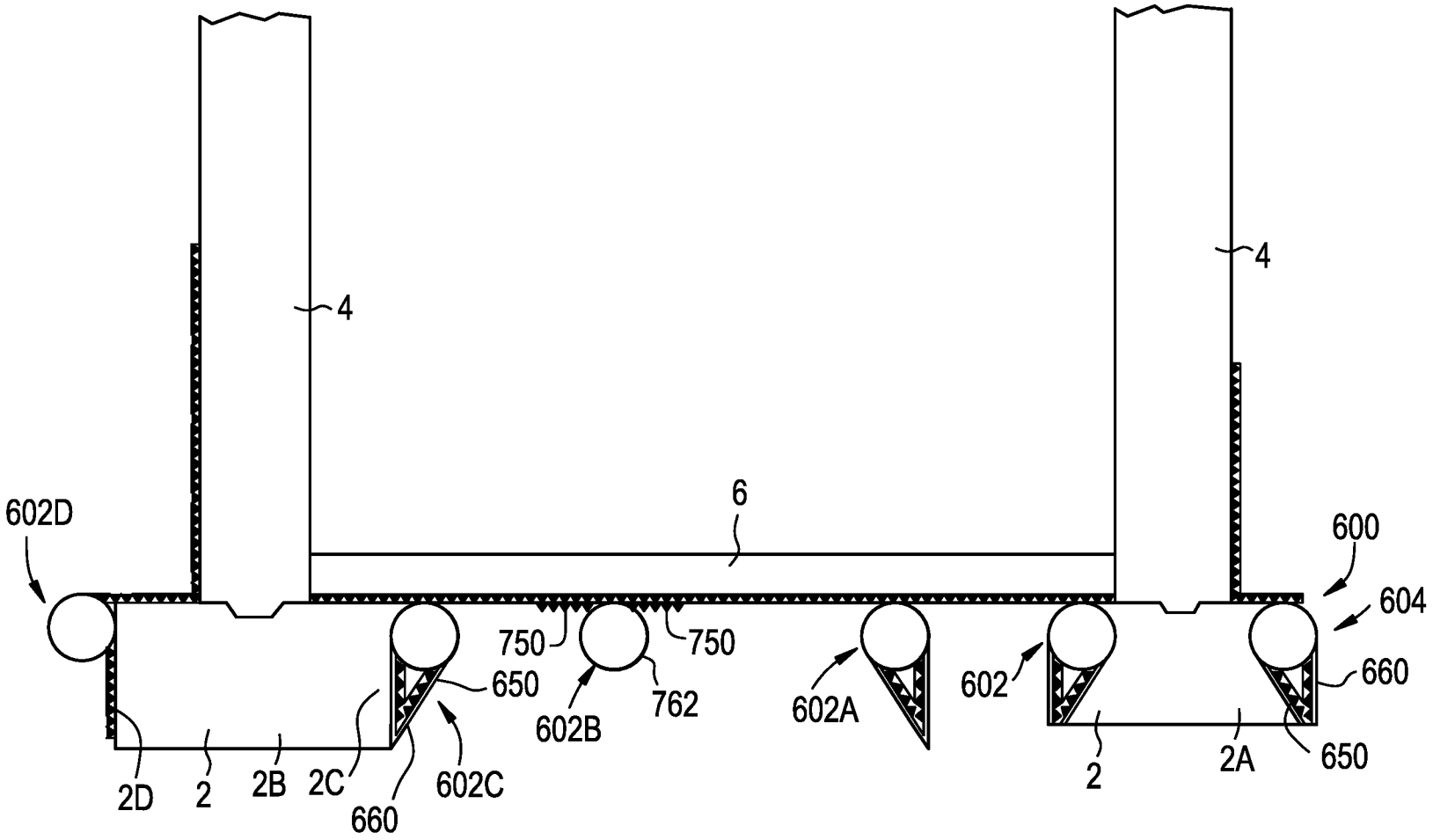
FIG. 19 is a depiction of several methods of use of the form system of FIG. 16.

FIG. 19 shows a number of methods of use of forming system 600 of FIG. 16 and the gravel-less foundation footing, drainage and ventilation system 700 (FIG. 17). As described hereinabove, construction of a building or other structure of interest includes forming a foundation footing 2 to support foundation walls 4 and a slab 6 extending therebetween. In one embodiment, the forming system 600 is employed to form a new foundation footing 2A having an integrally formed drainage and ventilation system therein as described hereinabove. In one embodiment, one form assembly 602A, configured similarly to form assembly 602, is employed to further provide drainage and ventilation capacity beneath the slab 6. In one embodiment, one form assembly 602B is configured such that first and second cores 650 and 660 extend substantially horizontally outwardly from conduit 662A to further provide drainage and ventilation capacity beneath the slab 6. In one embodiment, the form assemblies of the present invention are employed to provide drainage and ventilation capacity around an existing foundation footing 2B. In one such embodiment, one form assembly 602C is positioned on an inward side 2C of footing 2B; and a second form assembly 602D is positioned on an outward side 2D of footing 2B. In one embodiment, first drainage core 650 and second drainage core 660 can be positioned proximate the existing foundation footing 2B. While FIG. 19 shows a number of methods of use of the forming system 600 and the ventilation system 700, it should be appreciated that all of the embodiments of a forming system in accordance with the present invention can be employed as shown in FIG. 19.

As described herein, the present invention provides a concrete forming system for building foundations, and portions thereof, wherein walls of the foundation are constructed using building material sections that interlock end-to-end to form a passage (e.g., the passage 180). The passage is conducive to provide ventilation for effective and efficient radon or other unwanted gas such as, for example, carbon dioxide, methane, mitigation or remediation from the structure being constructed. The inventive forming system permits construction of footings and walls of the foundation that may have substantially vertical side walls of a generally rectangular or square cross-section, side walls of a generally trapezoidal cross-section, and/or combinations and variations thereof. The inventor has recognized that the forming system permits construction of, for example, a sub-slab depressurization system (e.g., with the introduction of conditioned air and/or removal of air and other gases) with a minimum of about fifty percent (50%) more mitigation than is seen with prior art systems.

In one aspect of the present invention, when installing footing forms that need to be leveled, the present invention (e.g., the bracket assembly 220) provides a relatively easy leveling feature to minimize labor needed to level the form prior to use.

In yet another aspect of the present invention, once concrete has cured, there is no need to remove components of the forms as the components are integrally formed within the footings or walls to provide additional structural support. In one embodiment, self-leveling reinforcement posts act as a vertical brace if material is needed to block concrete from flowing out from under form.

In yet another aspect, components of the inventive form system are vertically stackable and horizontally expandable to accommodate footings and/or walls of various heights and widths.

Some perceived benefits of constructing footings and/or walls having a trapezoidal cross section include, for example:

A. Increases bearing with standard footing sizes.
B. Decrease amount of material used with standard footing sizes.
C. The standard footing sizes are reduced, but a same bearing is achieved.
D. Decreasing amount of material in reduced size achieving same bearing.

For example, a typical rectangular footing of dimensions of about twenty four inches (24 in.; 60.96 cm) in width, twelve inches (12 in.; 30.48 cm) in height and ten feet (10 ft.; 3.048 m) in length provides a cubic volume of twenty cubic feet (20 cu. ft.), while a trapezoidal footing may be constructed to carry the same bearing by have dimensions of about sixteen inches (16 in.; 40.64 cm) in upper width and twenty four inches (24 in.; 60.96 cm) in lower width, twelve inches (12 in.; 30.48 cm) in height and ten feet (10 ft.; 3.048 m)) in length provides a cubic volume of sixteen cubic feet (16 cu. ft.).

The barrier and a form system for forming a foundation footing integrally formed with a drainage and ventilation system according to the present invention provides for retaining a flowable and curable building material to form a portion of a foundation of at least a portion of a structure of interest. The system includes side walls receiving and retaining the building materials therebetween. The side walls are disposed in a predetermined configuration suitable for the portion of the foundation and include a first side wall and a second side wall. At least one of the first side wall and the second side wall is comprised of at least one component having an interior cavity. A bracket assembly retains the side walls in the predetermined configuration. The bracket assembly includes a first outwardly bounding reinforcement post disposed proximate the first side wall, and a second outwardly bounding reinforcement post disposed proximate the second side wall. A separator bar includes a first end, a second end opposed from the first end, and a plurality of apertures disposed along a length of the separator bar. The plurality of apertures includes a first set of apertures disposed proximate the first end and a second set of apertures disposed proximate the second end. The first set apertures and the second set of apertures are sized to receive and retain each of the reinforcement posts at locations corresponding to nominal widths of the at least one component. A barrier is disposed between the outwardly bounding posts. The barrier is defined by an inner layer wrapped by an outer layer, and the barrier being permeable. The barrier and the at least one component is retained in the foundation after the building material cures, and the barrier prevents backfill from filling a volume between the portion of the foundation and the outwardly bounding posts.

In one embodiment, the barrier inner layer includes a first drainage core having a first end, a second end, and a plurality of passages extending therethrough; and a second drainage core having a first end, a second end, and a plurality of passages extending therethrough. In one embodiment, the system includes a drainage cavity bounded by the at least one component and the first and second drainage cores wherein the second drainage core is disposed substantially vertically and proximate at least one of the first and second outwardly bounding reinforcement posts, the second end of the second drainage core being disposed proximate the second end of the first drainage core, and the first end of the first drainage core is positioned upwardly from the second end of the first drainage core and inwardly from the at least one of the first and second outwardly bounding reinforcement posts, and wherein the at least one component is disposed on the first end of each of the first and second drainage cores.

In one embodiment, the barrier outer layer is a fabric. In one embodiment, the barrier outer layer is a geotextile exhibiting a grab tensile strength greater than 100 lbs. and an elongation that is greater than fifty percent (50%). In one embodiment, the barrier outer layer is a geotextile exhibiting a permittivity greater than 1 $s^{-1}$ and a permeability of at least 0.05 cm/s. In one embodiment, the barrier further comprises an adhesive disposed between the barrier inner layer and the barrier outer layer. In one embodiment, the at least one component is a perforated conduit.

A foundation footing drainage and ventilation system in accordance with the present invention includes a conduit, a first drainage core having a first end, a second end, and plurality of passages extending therethrough; and a second drainage core having a first end, a second end, and plurality of passages extending therethrough. A fabric is wrapped around each of the conduit, the first drainage core and the second drainage core. A drainage cavity is bounded by the conduit and the first and second drainage cores wherein the second drainage core is disposed substantially vertically and proximate a first side of the conduit, the second end of the second drainage core being disposed proximate the second end of the first drainage core, wherein the first end of the first drainage core is positioned upwardly from the second end of the first drainage core and proximate a second side of the conduit; and wherein the at least one component is disposed on the first end of each of the first and second drainage cores.

A foundation footing drainage and ventilation system, includes a conduit; a first drainage core having a first end, a second end, a first plurality of passages extending therethrough and a second plurality of passages extending therethrough substantially orthogonal to the first plurality of passages; a second drainage core having a first end, a second end, a first plurality of passages extending therethrough and a second plurality of passages extending therethrough substantially orthogonal to the first plurality of passages; a fabric wrapped around each of the conduit, the first drainage core and the second drainage core; wherein the conduit is disposed proximate the first end of each of the first and second drainage cores, and the second end of each of the first and second drainage cores extends outwardly from the conduit.

In one embodiment, the conduit is perforated. In one embodiment, the first and second drainage cores are permeable. In one embodiment, the fabric is permeable. In one embodiment, the fabric comprises a geotextile exhibiting a grab tensile strength greater than 100 lbs. and an elongation that is greater than fifty percent (50%). In one embodiment, the fabric comprises a geotextile exhibiting a permittivity greater than 1 $s^{-1}$ and a permeability of at least 0.05 cm/s. In one embodiment, an adhesive is disposed between the fabric and the first and second drainage cores.

Additional Embodiments.

The inventor has discovered that the aforementioned bracket and form system can be utilized in novel and non-obvious manners to provide and improve drainage, air and gas barriers, as air and thermal insulating sheathing, drywall and ceiling tiles to provide remediation and improve air flow (into and out of a system), to provide and improve conditions within the building/structure's envelope, irrigation, septic leaching fields, and the like, some with gravelless embodiments. Applications of such systems may include, but are not limited to, agriculture, indoor and outdoor athletic sport fields, and building structures of a variety of uses, as well as open air structures and environments including, but not limited to, driveways, parking lots, sidewalks, parking garages, airport runways, bridges, mining, roofing systems, and the like.

Figure 22:
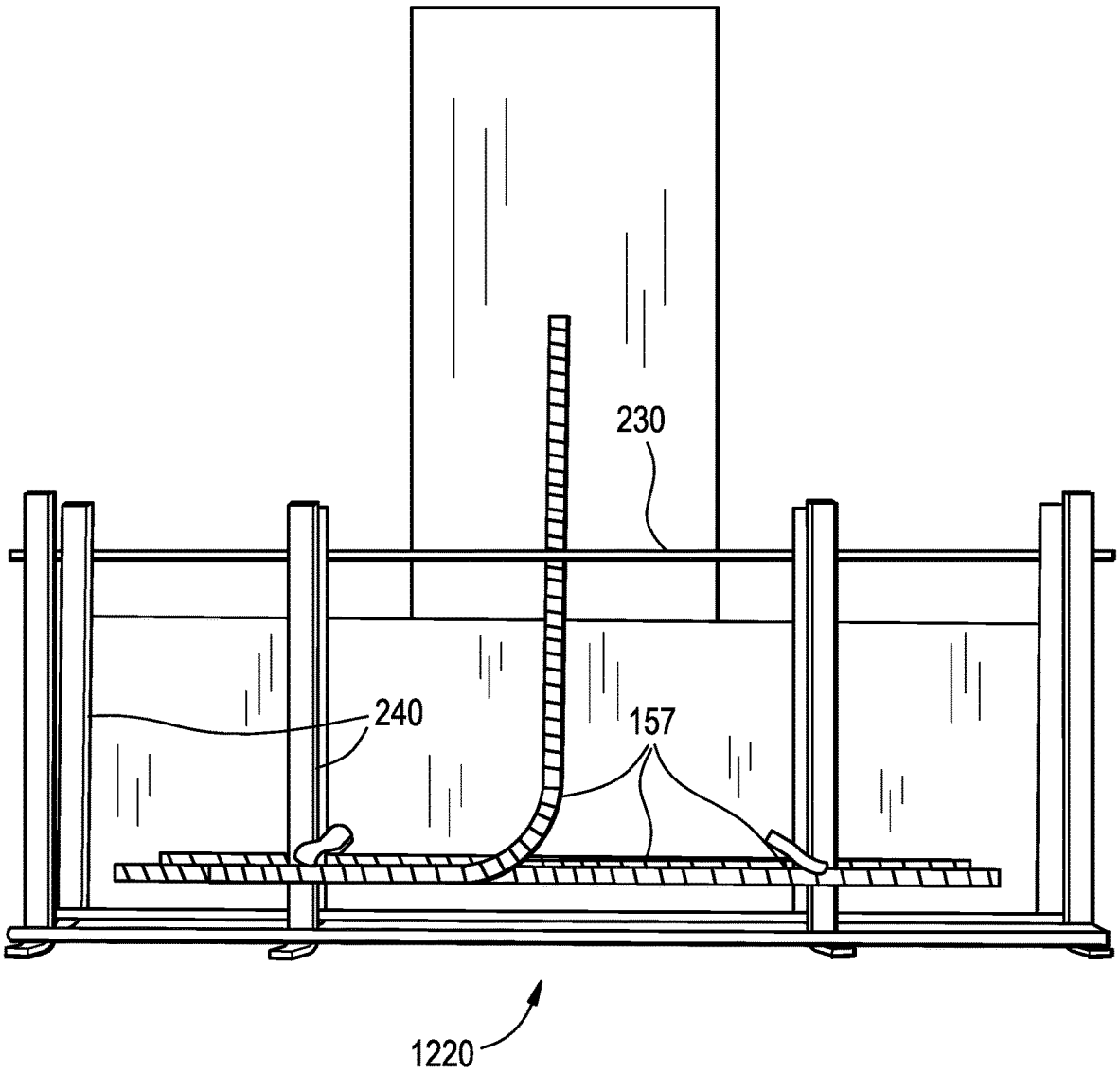
FIG. 22 is an elevation view of a bracket assembly in accordance with one embodiment of the present invention.

The inventor has discovered that the aforementioned systems can be used together, and individually, in a number of commercial products. For example, the bracket assembly 220, including one or more of the separator bars 230 and two or more of the reinforcement posts 240, may be purchased under a trademark Dri-Bracket as illustrated generally at 1220 in FIG. 22. As described herein, the Dri-Bracket system 1220 may be used as a form system to support components of side walls 262 and 264 (not shown in FIG. 22), as well as rebar supports 157. As shown in FIGS. 16, 19 and 21, the Dri-Bracket system 1220 can be used to form building structural components such as footings and foundations for a structure of interest. When used with components such as conduits 662A and 664A, and drainage cores 650 and 660, the Dri-Bracket system 1220 provides an integral ventilation and drainage forming system that may be purchased under the trademark Dri-Form (e.g., as shown in FIGS. 16 and 19). As shown in FIG. 17, conduits 762A and drainage cores 750 and 760 provide the standalone drainage and ventilation system 700 that may be purchased under a trademark Dri-Drain. Dri-Bracket, Dri-Form and Dri-Drain are trademarks of DRFF, LLC, Shelton, Conn. US.

Figure 23A:
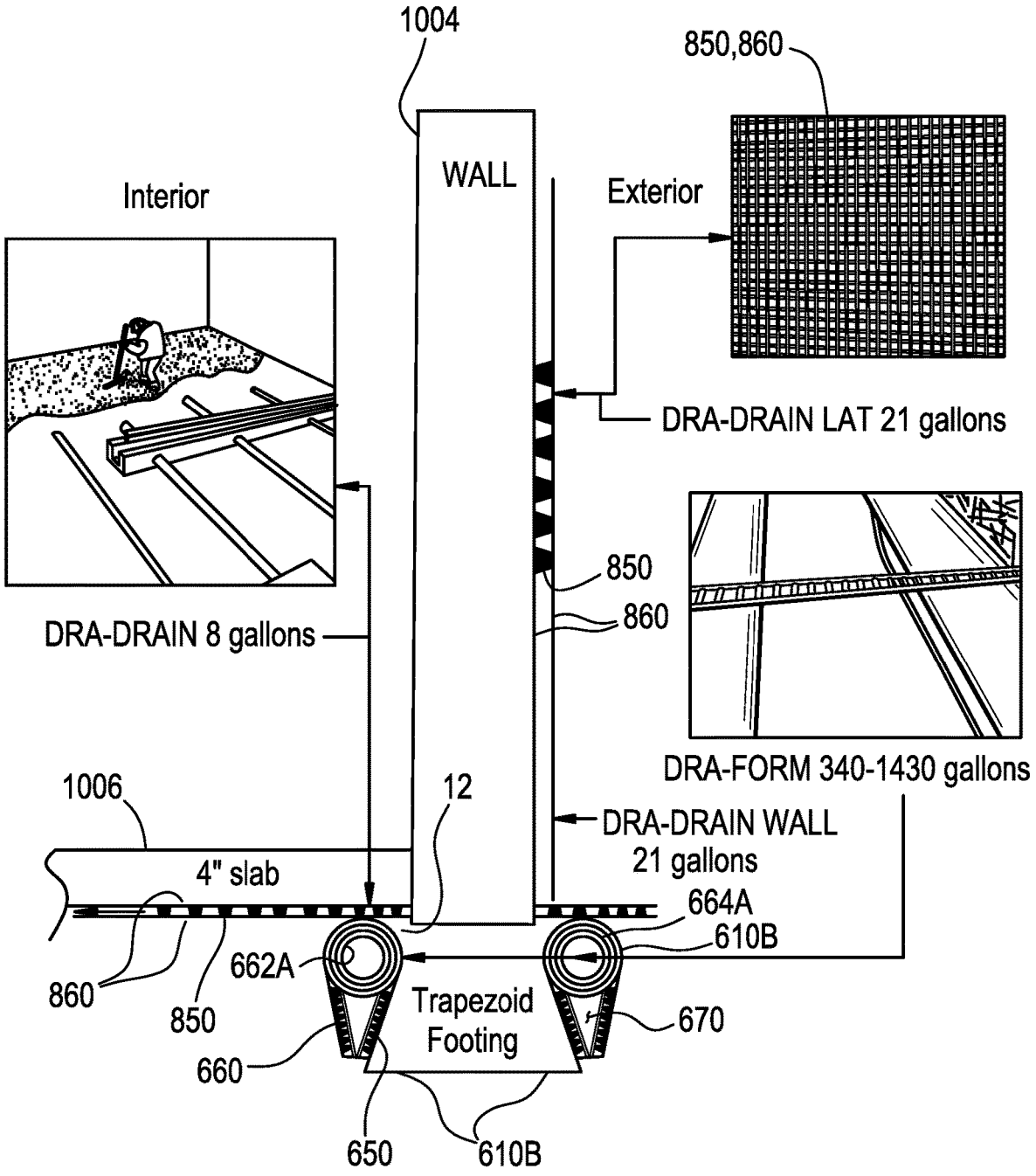
FIGS. 23A and 23B are elevation views of a gravel-less foundation footing and slab wall integrally formed with drainage and ventilation systems, configured in accordance with embodiments of the present invention.
Figure 23B:
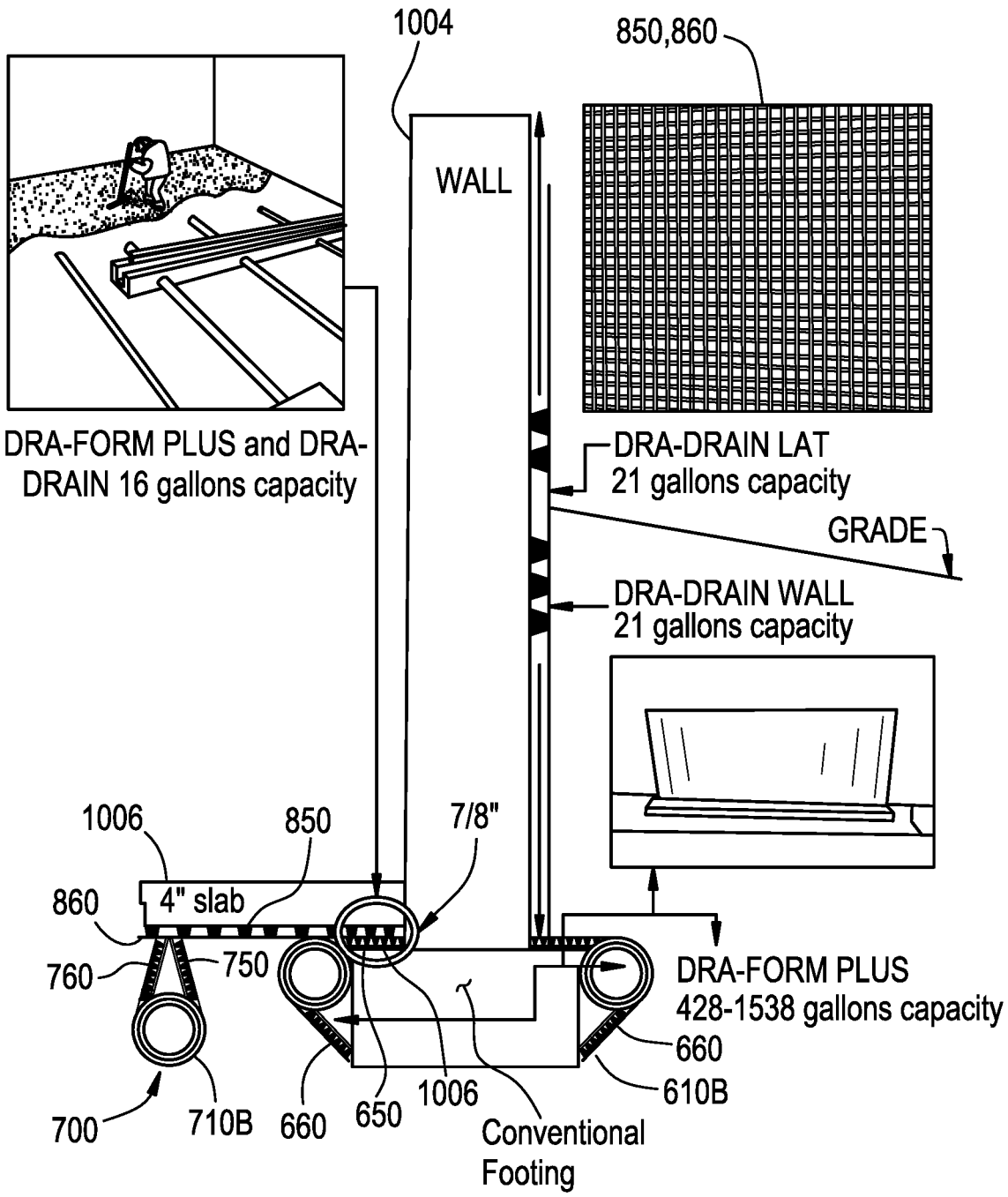

As shown in FIGS. 23A and 23B, the barriers 610 and 710 including drainage cores 650, 660, 750, 760, 850 and outer fabric 610B, 710B, 860 (FIGS. 16, 17, 18A and 18B) may be employed as an interface between a slab wall 1004 or floor 1006 and fill (e.g., vertical and/or horizontal, and interior and/or exterior configurations), and/or as a drainage blanket or mat (e.g., horizontal configuration) disposed at or below the surface of backfill or the footing 12, and additionally as a ceiling tile, subfloor component, or the like within the structure. For example, as shown FIGS. 16, 17, 18A and 18B, the barriers 610 and 710 are comprised of the inner drainage cores 650 or 660, and 750 or 760, 850 wrapped by the outer fabric 610B, 710B and 860 such that the fabric 610B, 710B and 860 encloses the cores 650 or 660, 750 or 760, and 850. As described above, the inventor has recognized that in this fabric-core-fabric "layered" or "sandwich" configuration forms a thermal break between the surfaces that it is disposed between. For example, the opposing fabric layers at least partially, if not fully, isolate temperature of the abutting materials; on one side, the slab wall or floor, and on the opposing side, the fill of gravel or soil. The inner drainage cores 650, 660, 750, 760, 850 permit an air flow that further acts to isolate temperature differentials between the opposing fabric layers 610B, 710B, 860 and the abutting materials. The inventor has also discovered that this isolation may be further enhanced, supplemented or controlled as desired by introducing conditioned air or liquid within the drainage cores 650 or 660 and 750 or 760. For example, warm or cool air or liquid may be passed through the drainage cores 650, 660, 750, 760, 850 to regulate the temperature differential between the abutting materials. In one embodiment, where the inventive "layered" or "sandwich" configuration is installed from below grade (e.g., as a drainage mat or footing form) to a ridge or upper most roof component, the air continuously traversing the passage formed by the drainage cores 650, 660, 750, 760, 850 promotes a more healthy environment with the structure by moving stagnant air or gas within the building envelope. In another embodiment, the fabric 660, 760, 860 is installed only on one side of the layer configuration, e.g., leaving an expose surface of the drainage core 650, 750, 850 that can provide an interior or exterior "lath system" for applying plaster, stucco (scratch or finish coat), tile, stone, brick or the line.

In yet another embodiment, the inventor has recognized that liquid, foam or a fire suppression chemistry, may be provided from, for example, a sprinkler or other fire suppression system disposed within a structure (not shown) such that the barriers 610 and 710 may enhance fire retardance of the structure to assist in containing a structure fire. Still further, in one embodiment, fire retardant materials may be applied to the fabric 610B, 710B, 860 to assist in the fire retardance of the barriers 610, 710. In still another embodiment, the barriers 610, 710 may include only one fabric layer 610B, 710B to leave a surface of the drainage core 650, 660, 750, 760, 850 exposed. In this embodiment, the fabric layer 610B, 710B is installed facing the abutting surface, for example an interior or exterior face of the slab wall 1004, to receive a plaster, stucco or mortar to bond a stone veneer thereto.

Figure 24A:
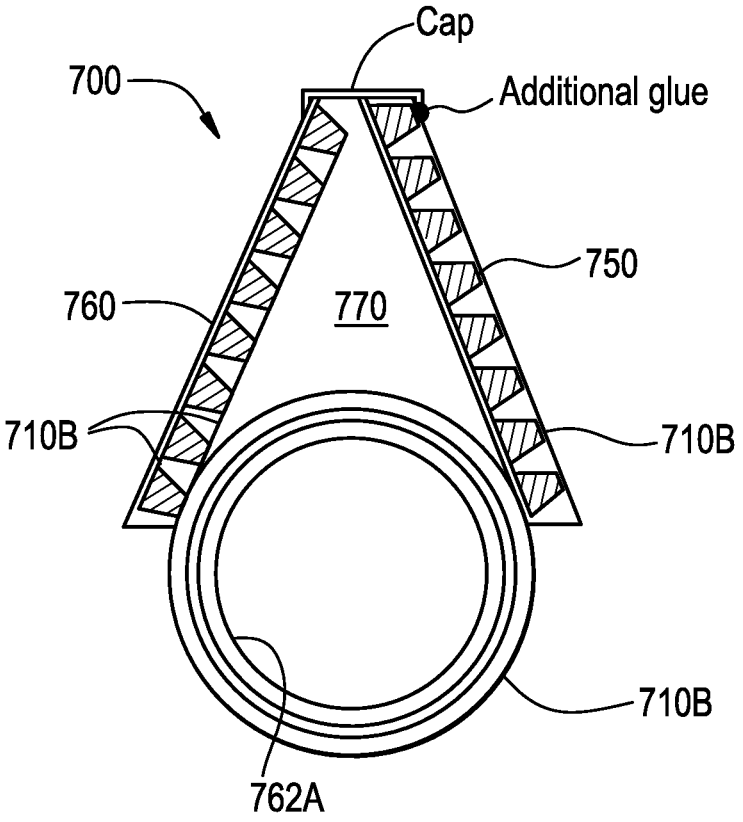
FIGS. 24A, 24B, 24C and 24D are elevation views of a gravel-less foundation footing drainage and ventilation system, in accordance with embodiments of the present invention.
Figure 24B:
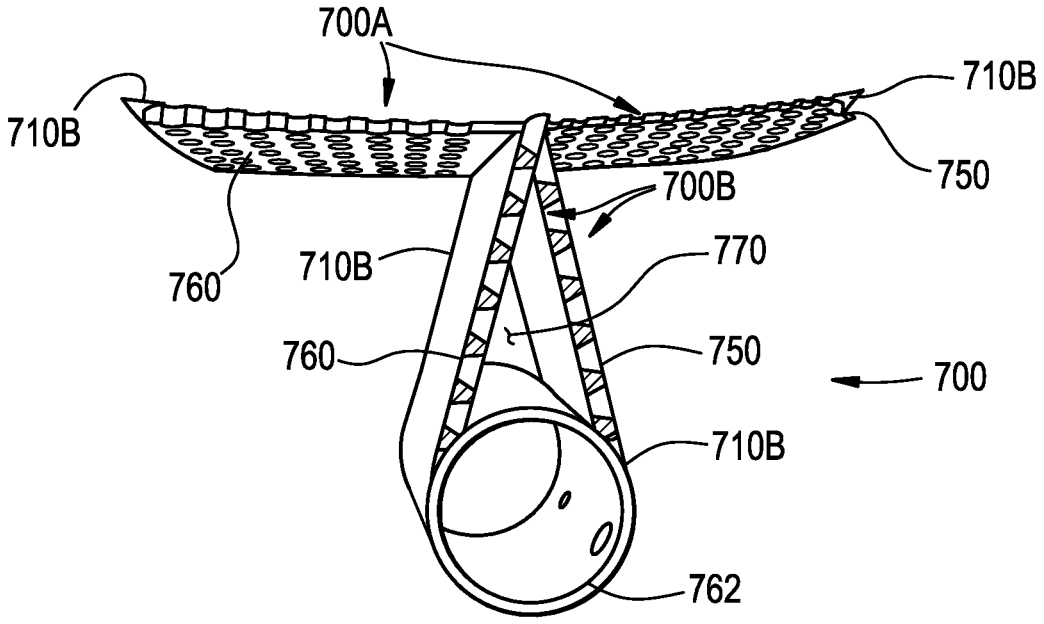
Figure 24C:
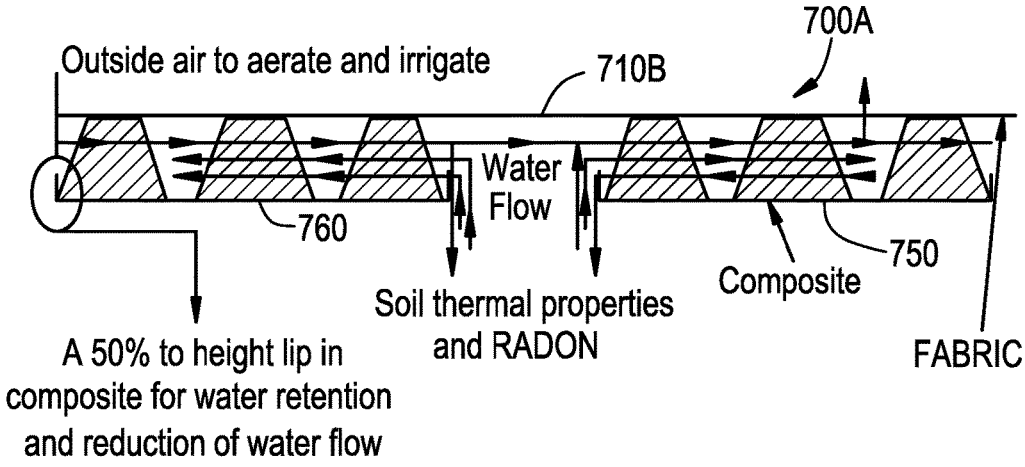
Figure 24D:
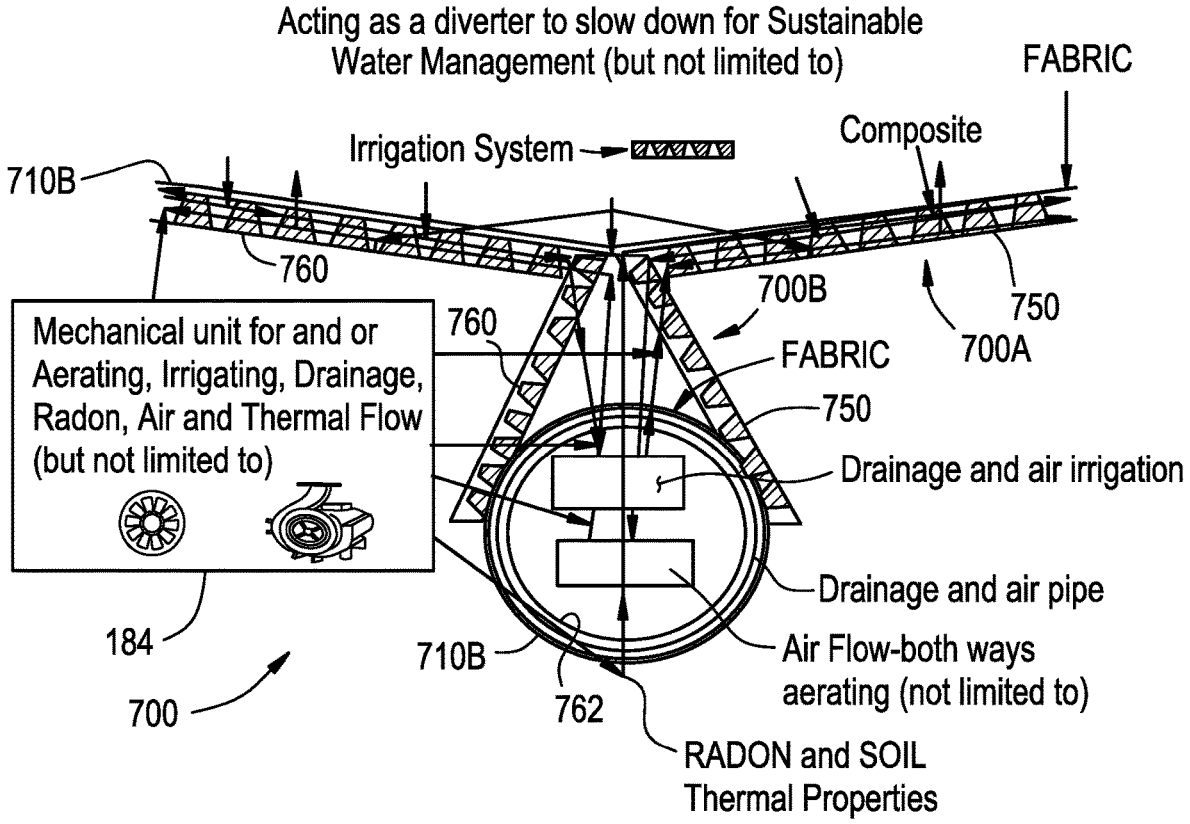
Figure 25A:
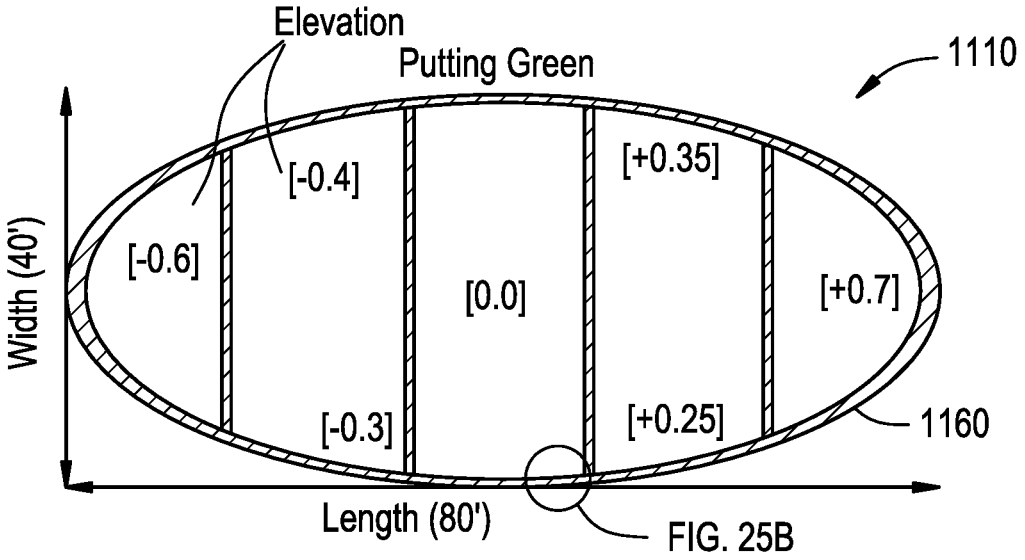
FIGS. 25A and 25B are a plan view and a detailed elevation view of gravel-less drainage and ventilation systems employed within a putting green, in accordance with embodiments of the present invention.
Figure 25B:
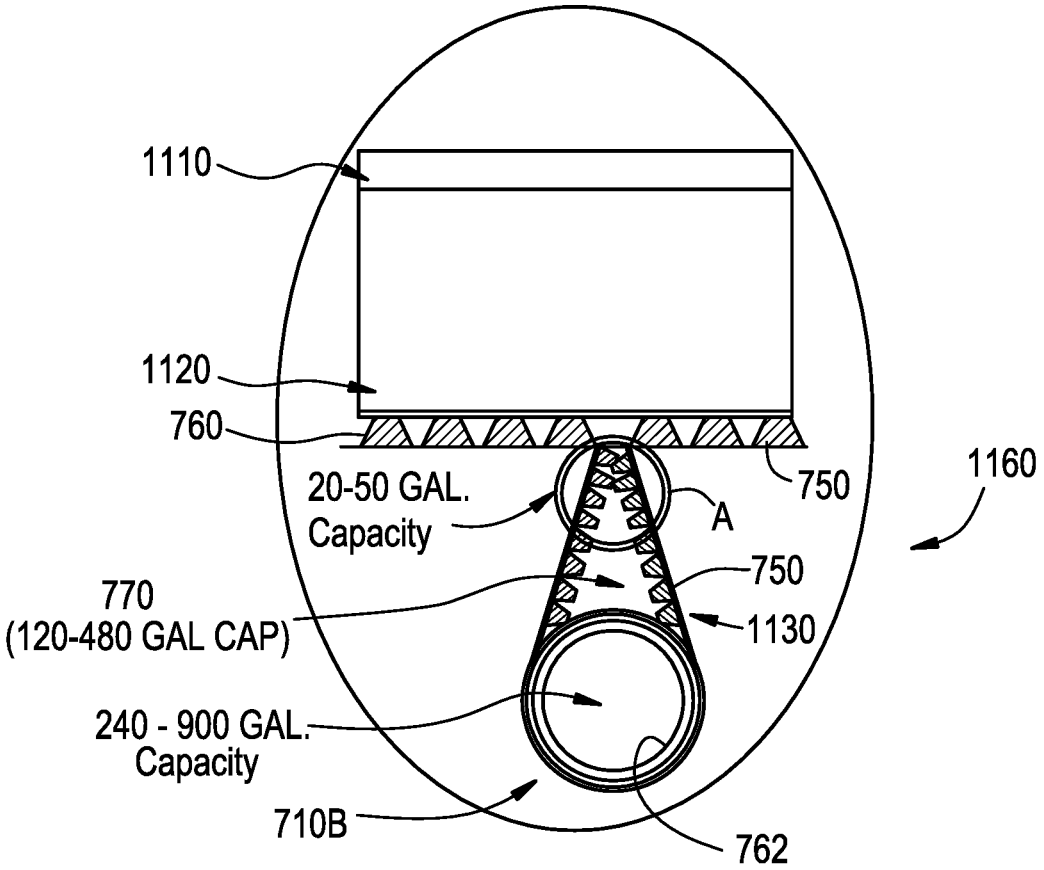

As shown in FIGS. 17 and 19, the conduit 762 and drainage cores 750 and 760 wrapped in the fabric 710B provide the standalone drainage and ventilation system 700 also referred to as Dri-Drain. The inventor has discovered that in various configurations (illustrated in FIGS. 24A to 24D), the system 700 including substantially flat and/or sloped horizontal 700A and vertical 700B configured fabric-wrapped drainage cores 750, 760 and the conduit 762 may be employed in agricultural, athletic field, golf course applications, and the like, to provide an improved, integral aeration, irrigation, drainage and ventilation system. In this standalone embodiment, the system 700 is offered under the trademark Dri-Turf. For example, in one embodiment, a putting green 1100 is illustrated in FIGS. 25A and 25B and includes a subsurface configuration 1160 of interconnected drainage and ventilation system 700, a Dri-Turf system (e.g., the drainage cores 750 and 760 and conduit 762 wrapped in the fabric 710B). Dri-Turf is a trademark of DRFF, LLC, Shelton, Conn. US. As shown in FIG. 25B, the putting green 1100 includes a relatively short (in height) grass or synthetic material top layer 1110, a soil layer 1120 and the subsurface drainage and ventilation layer 1130, including the configuration 1160 of interconnected drainage and ventilation system 700. As shown in FIG. 25B, various portions of the subsurface configuration 1160 of the interconnected drainage and ventilation system 700 can carry a drain or flow capacity such that the system 700 can capture, retain and move away a volume of water, e.g., ground and subsurface water, to an attached drainage system, containment area, retention pond or the like (not shown). As shown in FIG. 25B, a point A where the drainage mat (horizontal) configuration of the drainage cores 750 and 760 meets the vertical configuration of the drainage core 750 and 760 has a drain capacity of about twenty to fifty gallons per minute (20 to 50 gals./min.; 75.71 to 189.27 liters/min.), the drainage cavity 770 has a drain capacity of about one hundred twenty to four hundred eighty gallons per minutes (120 to 480 gals./min.; 454.25 to 1817 liters/min.), and the conduit 762 has a drain capacity of about two hundred forty to nine hundred gallons per minute (240 to 900 gals./min.; 908.50 to 3,406.87 liters/min.).

Figure 26A:
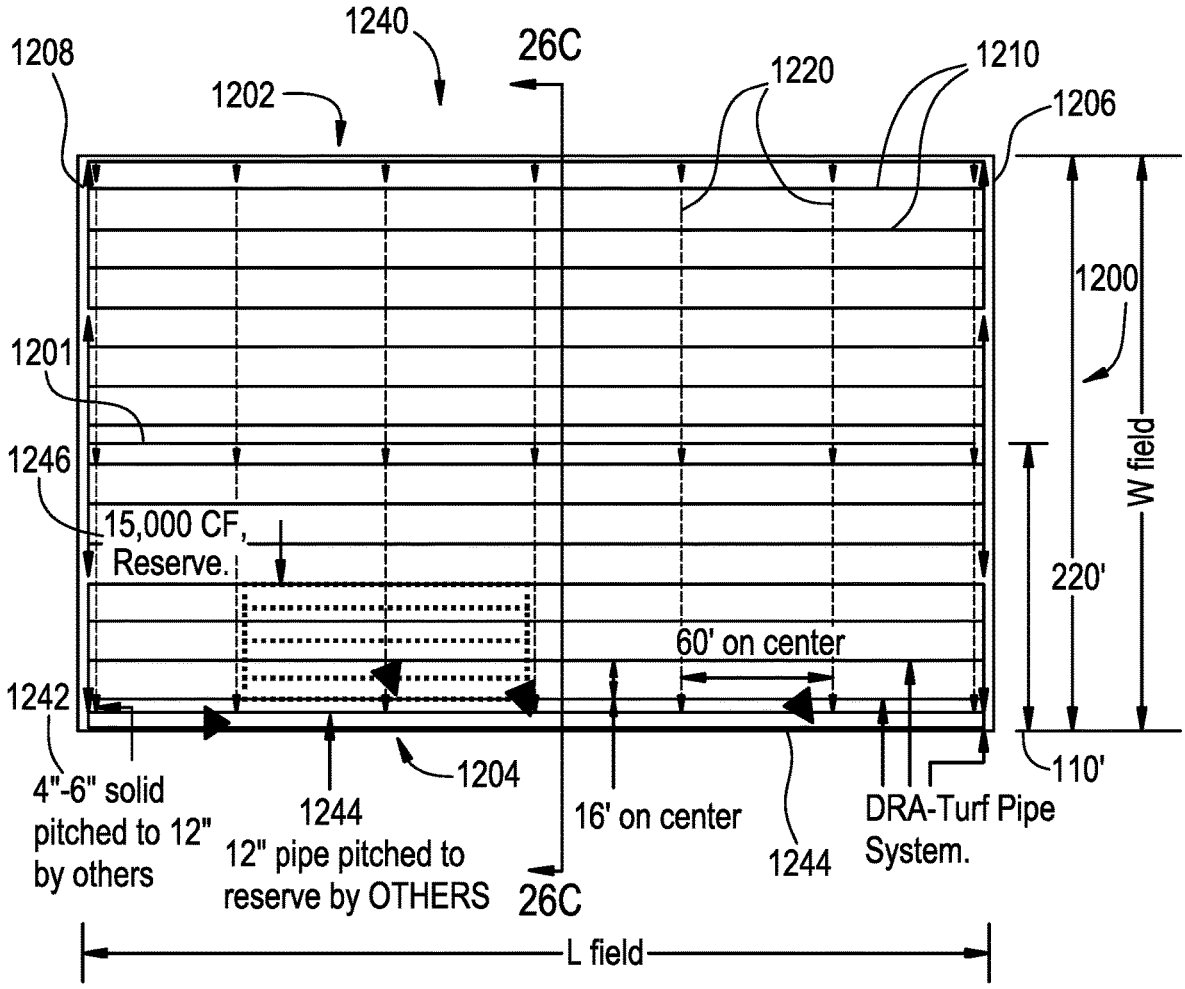
FIG. 26A is an elevation view.
Figure 26B:
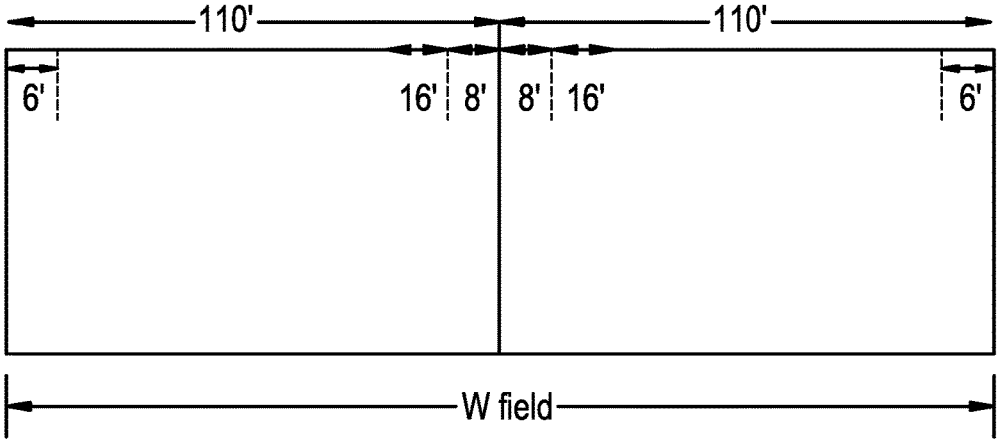
FIG. 26B is an end view.
Figure 26C:
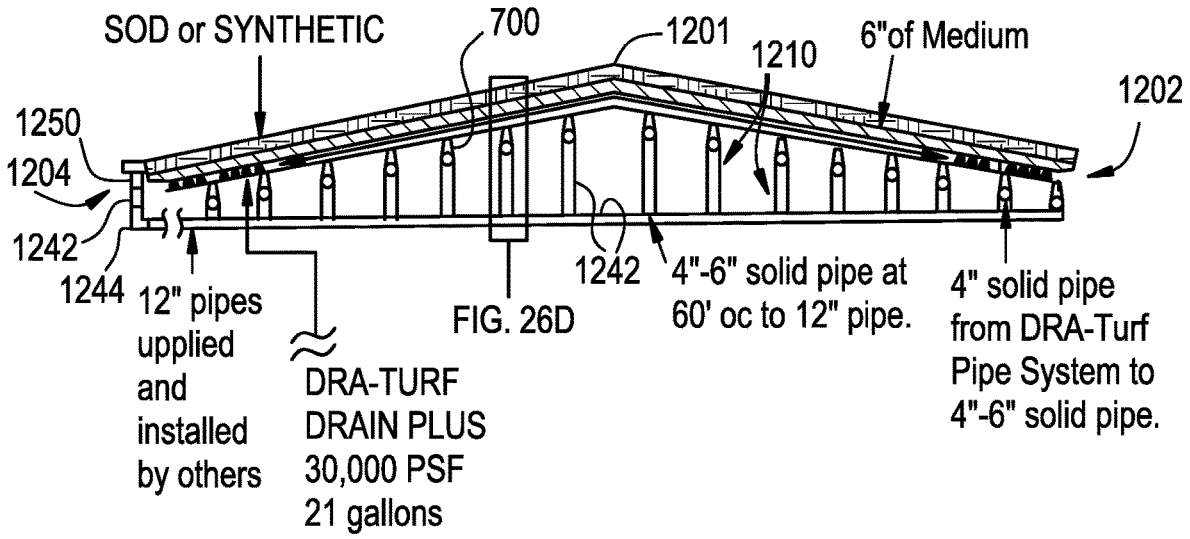
FIG. 26C is a cross section view and 26D is a detailed elevation view of gravel-less drainage and ventilation systems employed within athletic fields, in accordance with embodiments of the present invention.
Figure 26D:
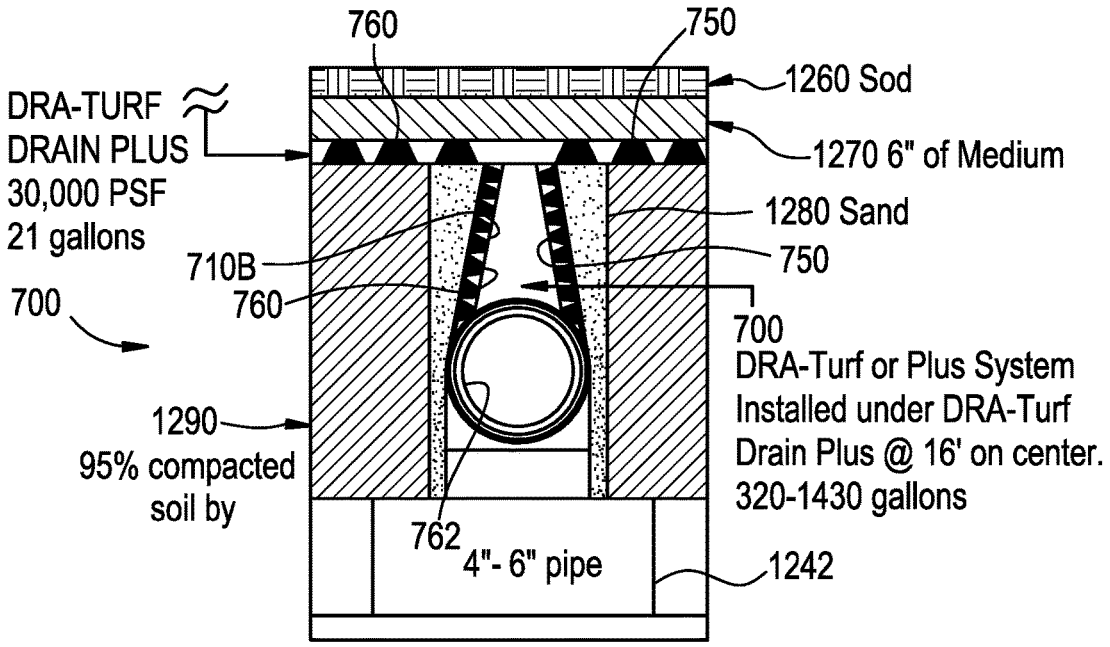

Similarly, and as shown in FIGS. 26A to 26D, the interconnected drainage and ventilation system 700, Dri-Turf, may be employed with a plurality of drainage conduits 1240 in a subsurface configuration below an athletic field 1200. In one embodiment, illustrated in FIGS. 26A and 26B, the athletic field 1200 is two hundred twenty feet (220 ft.; 67.06 meters) in width $W_{FIELD}$ from one sideline 1202 to an opposing sideline 1204, and has a centerline 1201 at one hundred ten feet (110 ft.; 33.53 meters). The athletic field 1200 further includes opposing ends 1206 and 1208 over a length $L_{FIELD}$ of the athletic field 1200. In this embodiment, the inventor has discovered that an effective drainage and ventilation system would include interconnected runs of the drainage and ventilation system 700, Dri-Turf, arranged at the opposing ends 1206 and 1208 of the athletic field 1200 and in a plurality of rows 1210 spanning the length $L_{FIELD}$ and across its width $W_{FIELD}$. Each of the systems 700 is coupled to conduits 1242, within the plurality of conduits 1240, disposed in a plurality of columns 1220 along the length $L_{FIELD}$ of the field 1200 from end 1206 to end 1208. At an intersection of each of the respective rows 1210 and columns 1220, the drainage and ventilation system 700, Dri-Turf, is arranged in a stack configuration as shown in FIG. 26D. In one embodiment illustrated in FIGS. 26A and 26B, the plurality of rows 1210 of the drainage and ventilation system 700 are spaced eight feet (8 ft.; 2.44 meters) apart at the centerline 1201 of the athletic field 1200 and then equally spaced sixteen feet (16 ft.; 4.88 meters) apart between centerlines of the respective systems 700 traveling from the centerline 1201 to each of the opposing sidelines 1202 and 1204 of the field 1200. In one embodiment, a last of the rows 1210 proximate to each respective sideline 1202 and 1204 is six feet (6 ft.; 1.83 meters) from the sideline 1202 or 1204. In one embodiment, the plurality of columns 1220 of the conduits 1242 are comprised of, for example, four to six inch (4 to 6 in.; 10.16 cm to 15.24 cm) solid (non-perforated) pipes, and are spaced sixty feet (60 ft.; 18.29 meters) apart (centerline of stack to centerline of stack) along the length $L_{HELD}$ of the field 1200 from end 1206 to end 1208. In one embodiment, the plurality of conduits 1240 includes at least one conduit 1244 disposed at one or both of the sidelines 1202 and 1204 and coupled to each of the plurality of columns 1220 of the conduits 1242. In one embodiment, the conduit 1244 is comprised of, for example, a twelve inch (12 in.; 30.48 cm) solid (non-perforated) pipe that runs along the length $L_{FIELD}$ of the athletic field 1200 to carry or drain a volume of water, e.g., ground and subsurface water, the system 700 can capture, retain and move by the drainage and ventilation system 700, to an attached drainage system, containment area, reserve 1246 or the like.

A cross-section view (along line 26C-26C) of one embodiment of the athletic field 1200 is illustrated in FIG. 26C. As shown in FIG. 26C, the athletic field 1200 includes a crown or elevated portion at the centerline 1201 and tapers downwardly from the centerline 1201 to respective sidelines 1202 and 1204. As illustrated in FIGS. 26C and 26D, a stack configuration of the drainage and ventilation system 700 are disposed at each intersection of a respective row 1210 and a column 1220. As shown in FIG. 26D, as with previous embodiments, the drainage and ventilation system 700 includes the drainage cores 750 and 760 and conduit 762 wrapped in the fabric 710B. In one embodiment, each of the stacks includes the system 700 coupled to one of the conduit 1242 arranged vertically at the intersection of one of the plurality of rows 1210 and one of the plurality of columns 1220, which is then coupled to one of the conduits 1242 arranged horizontally and defining one of the plurality of columns 1220. As shown in FIGS. 26A and 26C, each of the conduits 1242 arranged horizontally within the plurality of columns 1220 is coupled to the conduit 1244 at one or both of the sidelines 1202 and 1204 (shown at 1204). As shown in FIGS. 26C and 26D, the athletic field 1200 includes a top layer 1260 including a sod or synthetic turf, a soil layer 1270 and a subsurface drainage and ventilation layer, including the stack of a respective one of the drainage and ventilation systems 700 and conduit 1242. As shown in FIG. 26D, the stacked drainage and ventilation system 700 is disposed in a trench 1300 forming the rows 1210 in, for example, the compacted soil 1290. In one embodiment, once the system 700 is installed, the trench 1300 is backfilled with sand 1280 or other media to permit, if needed, subsequent access to the system 700.

Figure 27A:
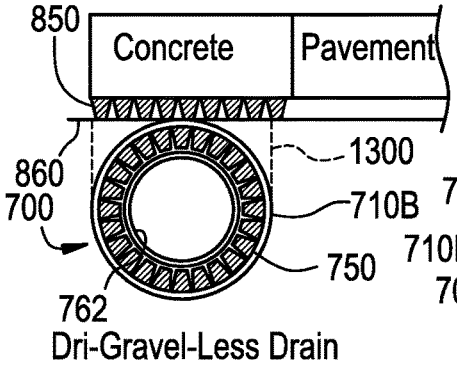
FIGS. 27A, 27B and 27C are cross section views of gravel-less drainage and ventilation systems, in accordance with embodiments of the present invention.
Figure 27B:
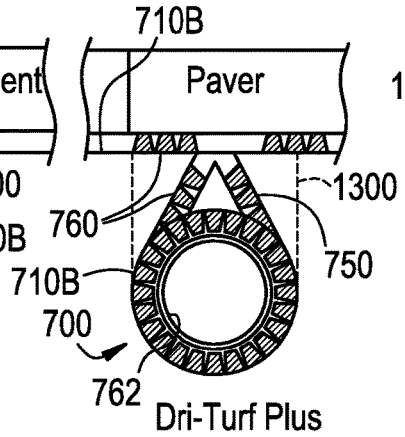
Figure 27C:
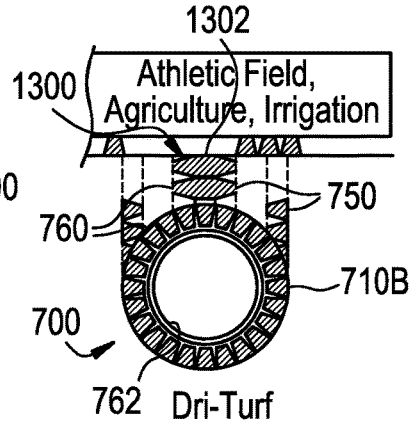
Figure 31:
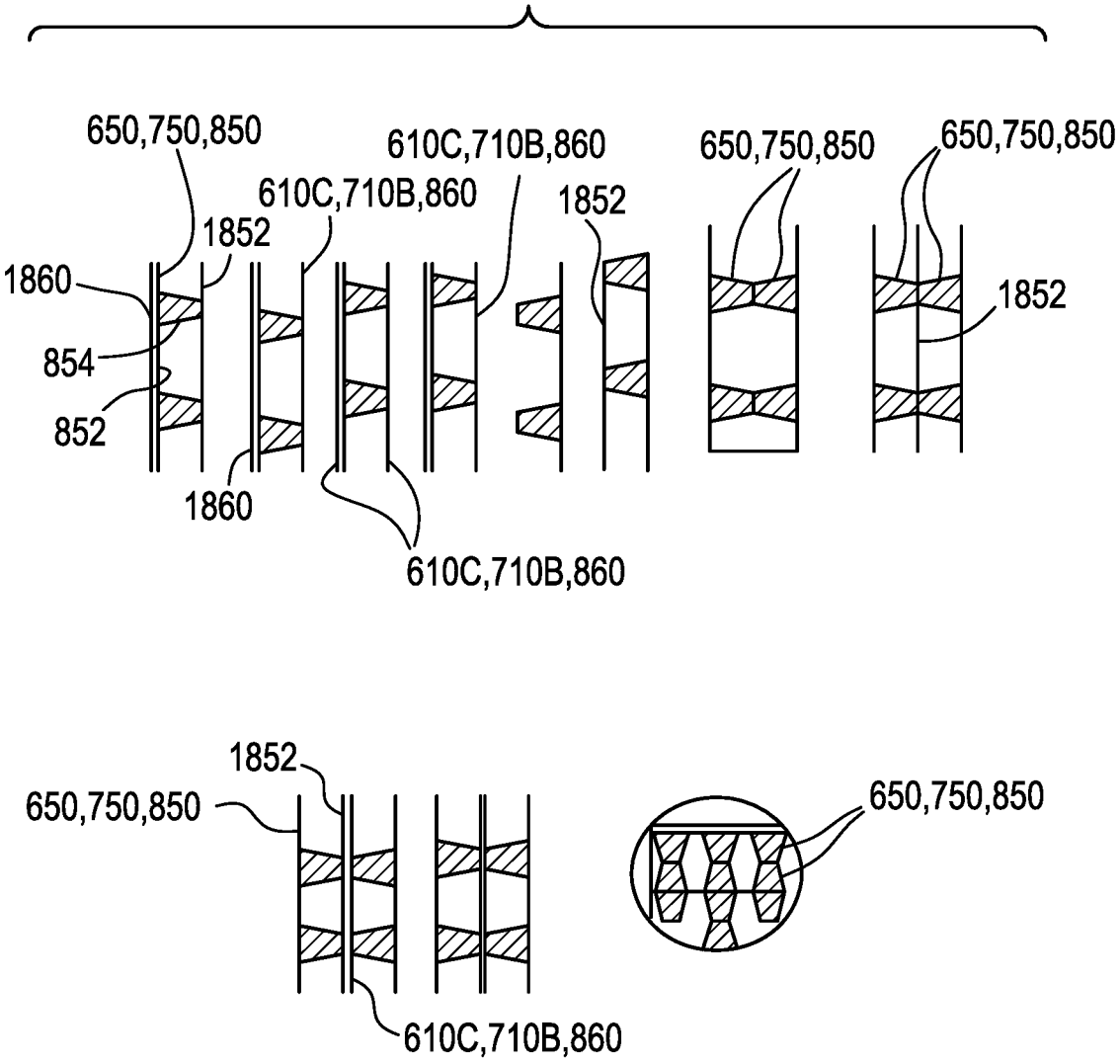
FIG. 31 illustrates cross section views of components of drainage and ventilation systems, in accordance with embodiments of the present invention.

FIGS. 27A to 27C illustrated examples of embodiments of the drainage and ventilation systems 700 that may be disposed within the trench 1300. In FIG. 27A, for example, the drainage and ventilation systems 700 is configured where the conduit 762 is wrapped about its circumference by the drainage core 750 and fabric 710B, and where the drainage core 850 is disposed in a substantially horizontal drainage mat configuration above the wrapped conduit 762. In FIG. 27B, for example, the drainage and ventilation systems 700 is configured where the conduit 762 is wrapped about its circumference by the drainage cores 750 and 760, and the fabric 710B, which then extend vertically and upwardly from the conduit 762 toward the top surface at a sloped angle. The drainage cores 750 and 760 are then horizontally configured, in a similar manner as is illustrated in FIG. 24B. Alternatively, the vertically and upwardly extending drainage cores 750 and 760 wrapped in the fabric 710B, terminate at the drainage core 850 that is disposed in a substantially horizontal drainage mat configuration above the wrapped cores 750 and 760. In still another embodiment, illustrated in FIG. 27C, for example, the drainage and ventilation systems 700 is configured where the conduit 762 is wrapped about its circumference by the drainage cores 750 and 760, and the fabric 710B, which then extend vertically and upwardly from the conduit 762 toward the top surface parallel to sidewalls of the trench 1300 (e.g., substantially vertical at no angle). A center portion 1302 of the trench 1300 above the conduit 762 and between the drainage cores 750 and 760 is then filled with a side-by-side or back-to-back arrangement of the drainage cores 750 and 760. The substantially vertical and side-by-side or back-to-back arrangements of the drainage cores 750 and 760 wrapped in the fabric 710B, terminate at the drainage core 850 that is disposed in a substantially horizontal drainage mat configuration above the wrapped cores 750 and 760. In one embodiment, as with the embodiment of FIG. 26D, once the system 700 is installed in either of the example embodiments illustrated in FIGS. 27A to 27C, the trench 1300 is backfilled with sand 1280 or other media to permit, if needed, subsequent access to the system 700. The inventor has discovered that the example embodiment of FIG. 27C can be particularly useful for accessing the drainage and ventilation systems 700 after initial installation, for example, for maintenance or repair. The inventor has further discovered that improved drainage, ventilation, thermal conductivity and other characteristics can be achieved with one or more arrangements, e.g., a side-by-side and/or back-to-back configuration of drainage cores 650, 750, and 850 as illustrated in FIG. 31. In one embodiment, the drainage cores 650, 750, 850 include a flat sheet 1852, similar to sheet 852 that has the plurality of dimples 854 formed therein, with no dimples 854 formed therein. The flat sheet 1852 may be fixed to portions of the dimples 854 in the sheet 852 to bound passages formed between the dimples 852. In still another embodiment, a mesh or grid sheet 1860 is added to the "layered" or "sandwich" configuration of, for example, the core 850 and the fabric 860. In one embodiment, the mesh or grid sheet 1860 may be coupled to a low voltage source (not shown). The grid sheet 1860 may conduct low voltage across the sheet in a row and column manner, for example, and provide a notification system when, for example, a change of conductivity and/or impedance is detected at a point (intersection of a respective row and column) on the grid sheet 1860. The inventor has recognized that when the drainage core 650, 750, 850 including the grid sheet 1860 is disposed proximate a slab wall, for example, the change in conductivity or impedance can indicate a leak of liquid, e.g., ground water, through the slab wall. In this embodiment, the drainage core acts as a notification and/or detection system for a defect in a foundation, for example.

Figure 28A:
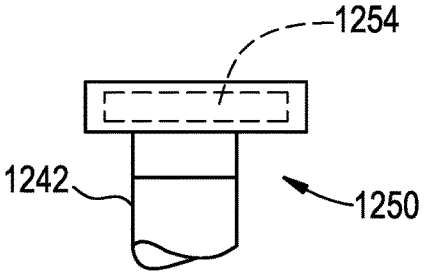
FIG. 28A is an elevation view and FIG. 28B is a plan view of a drain member component of the drainage and ventilation system of FIG. 26C, in accordance with an embodiment of the present invention.
Figure 28B:
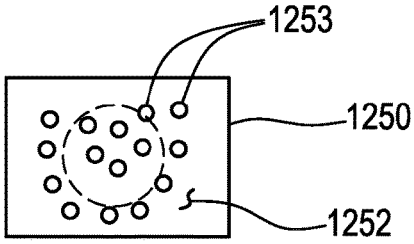

Referring again to FIGS. 26A and 26C, a larger conduit, for example, the conduit 1244, may be disposed at one or both of the sidelines 1202 and 1204 of the athletic field 1200. In one embodiment, a plurality of drain members 1250 (illustrated in FIGS. 28A and 28B) are disposed at one or both of the sidelines 1202 and 1204 in a stacked configuration, wherein one of the conduits 1242 arranged vertically, couples a respective drain member 1250 to the conduit 1244. In one embodiment, the drain member 1250 includes a drain grate or screen 1252 having a plurality of apertures 1253 and drain containment chamber 1254 to assist in inhibiting a flow of debris into the subsurface configuration of drainage systems 700 and drainage conduits 1240 below the athletic field 1200.

Figure 29:
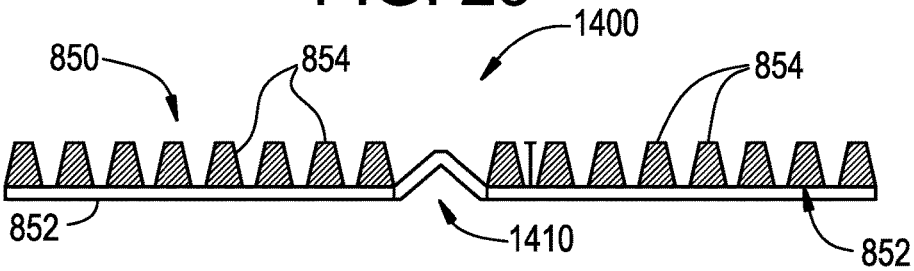
FIG. 29 is an elevation view of an expansion joint portion of a drainage core, in accordance with an embodiment of the present invention.

The inventor has discovered that certain environmental conditions, for example, high temperature days and colder temperature nights, allows for heat to radiate to and through the drainage cores 750, 760, 850 that may lead to thermal expansion of the cores 750, 760 and 850 during heat exposure and subsequent contraction at night when the heat dissipates. The cycle of thermal expansion and contraction can buckle or otherwise displace the cores 750, 760 and 850 if this movement is not otherwise accommodated in the installation of the drainage and ventilation system 700. In one embodiment, illustrated in FIG. 29, an expansion joint 1400 is configured within the structure of the drainage cores 750, 760 and 850. As illustrated above with reference to FIGS. 18A and 18B, the drainage core 850 is comprised of the sheet 852 having the plurality of dimples 854 formed therein, in for example a row-column configuration. As shown in FIG. 29, a portion 1410 of the sheet 852 includes no dimples 854 and is comprised of a thinner, more flexible wall that permits and otherwise accommodates expansion and contraction by for example bending or folding inwardly and upwardly in response to expansion. In one embodiment, the portion 1410 may include a configuration, pattern or profile to more readily accommodate expansion and contraction, for example a series of raised portions forming a jagged or zig-zagged cross section.

Figure 30:
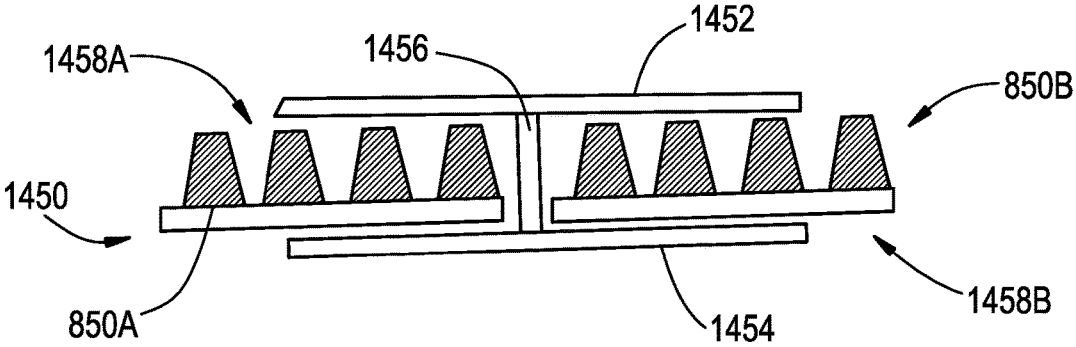
FIG. 30 is an elevation view of a joining and restricting member, in accordance with an embodiment of the present invention.

In one embodiment, one or more of the horizontal drainage mat configured drainage cores 750, 760 and 850 are joined or coupled using a joining and restricting member 1450 illustrated in FIG. 30. In one embodiment, the joining and restricting member 1450 includes an upper flange 1452 and a lower flange 1454 joined by a central wall 1456 and defining a first interior cavity 1458A and a second interior cavity 1458B therebetween. The interior cavities 1458A ad 1458B of the joining and restricting member 1450 adapted to receive horizontally configured drainage cores 850. In one embodiment, the joining and restricting member 1450 joins adjacent drainage cores 850A and 850B, and restricts a flow of liquid, air, gas and the like, between the cores 850A and 850B. In one aspect of the invention, the joining and restricting member 1450 prevents flow across the cores 850 and can be utilized to allow uniform drainage.

In further embodiments, the inventive drainage and ventilation system is seen to provide a rain screen, exterior and interior sheathing, replacement for sheetrock and ceiling tiles as well. Installation of the above described Dri-Drain Wall systems is easier and faster due, in part, to the relative light weight in comparison to conventional systems. The system is seen to have a less environmental impact, provides for shipment of larger quantities per truck load, with enhancements to accommodate different building divisions or industries. Embodiments provided improved fire resistance, thermal conductivity and/or barrier, improved ventilation to remove poor air quality or gases in residential, commercial, industrial applications of use.

Additionally, in applications involving athletic fields, the present invention provides for a decreased impact (G-MAX) on the fields, resulting in less injuries, fatigue and wear and tear on an athlete's body, as well as higher drainage flow and a thermal conductivity and/or barrier to extend season use of fields. The systems described herein provide an increase in water retainment capabilities, thermal conductivity and/or barrier in irrigation an agriculture. Solving many irrigation and environmental issues in agricultural and mining. When used with a low voltage applied across the core, can be used as a leak detection system for below grade applications. The systems can be used as ceiling tiles, as an improvement/supplement to HVAC systems, air remediation and venting systems and the like. The systems described herein may be used as interior sheathing or sheetrock having light weight, fast easier to install, larger quantities shipped per truckload, environmental friendly. HVAC air vent, air remediation, moisture resistant. The systems may also be used as exterior sheathing and or siding, lath and rain screen, each having light weight, thermal conductivity and/or barrier, and moisture resistant characteristics.

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A drainage and ventilation system, comprising:

a conduit having an exterior surface and an interior cavity;

a first drainage core having a first end, a second end, and plurality of passages extending therethrough;

a second drainage core having a first end, a second end, and plurality of passages extending therethrough;

a fabric wrapped around each of the conduit, the first drainage core and the second drainage core;

wherein the first end of the first drainage core is disposed upward from the conduit and the second end of the first drainage core is disposed proximate the exterior surface of the conduit; and wherein the first end of the second drainage core is disposed upward from the conduit and the second end of the second drainage core is disposed proximate the exterior surface of the conduit; and wherein the first end of the first drainage core is spaced lateral to the first end of the second drainage core;

a first cavity bounded by the exterior surface of the conduit, the first drainage core, and the second drainage core; and a second cavity formed by an interconnection of the interior cavity of the conduit, the plurality of passages of the first drainage core, and the plurality of passages of the second drainage core.

2. The drainage and ventilation system of claim 1, wherein the fabric comprises a geotextile exhibiting a permittivity greater than 1 $s^{-1}$ and a permeability of at least 0.05 cm/s.

3. The drainage and ventilation system of claim 1, further comprising:

a plurality of the drainage and ventilation systems disposed in soil; and wherein the conduit of each of the plurality of drainage and ventilation systems is perforated and the fabric of each system is permeable, and wherein the conduit and the fabric of each system receive a flow of at least one of liquid, air and gas from the soil.

4. The drainage and ventilation system of claim 3, wherein the first and second drainage cores of each of the plurality of drainage and ventilation systems are permeable, and wherein the first drainage core, the second drainage core and the fabric of each system receive the flow of the at least one of liquid, air and gas.

5. The drainage and ventilation system of claim 4, further comprising:

a plurality of drainage conduits disposed in the soil, each of the plurality of drainage conduits having an interior cavity; and wherein at least one of the plurality of drainage conduits is interconnected to the conduit of at least one of the plurality of drainage and ventilation systems to capture, retain and move the flow of the at least one of liquid, air and gas from the conduit, the first drainage core, and the second drainage core of the at least one of the plurality of drainage and ventilation systems and to distribute the flow within the plurality of drainage conduits.

6. The drainage and ventilation system of claim 5, wherein the flow of the at least one of liquid, air and gas through the conduit, the first drainage core, and the second drainage core of the at least one of the plurality of drainage and ventilation systems and through the plurality of drainage conduits promotes thermal conductivity in the drainage and ventilation system.

7. The drainage and ventilation system of claim 4, further comprising:

an air exchange unit in communication with at least one of the conduit, the first drainage core and the second drainage core.

8. A drainage and ventilation system, comprising:

a conduit having an exterior surface and an interior cavity;

a first drainage core having a mat portion and an upward extending portion extending from the mat portion, the upward extending portion having a first end and a second end, each of the mat portion and the upward extending portion of the first drainage core having a first plurality of passages extending therethrough;

a second drainage core having a mat portion and an upward extending portion extending from the mat portion, the upward extending portion having a first end and a second end, each of the mat portion and the upward extending portion of the second drainage core having a first plurality of passages extending therethrough;

a fabric wrapped around each of the conduit, the first drainage core and the second drainage core;

wherein the first end of the upward extending portion of the first drainage core is disposed upward from the conduit and the second end of the upward extending portion of the first drainage core is disposed proximate the exterior surface of the conduit;

wherein the first end of the upward extending portion of the second drainage core is disposed upward from the conduit and the second end of the upward extending portion of the second drainage core is disposed proximate the exterior surface of the conduit;

wherein the first end of the upward extending portion of the first drainage core is spaced lateral to the first end of the upward extending portion of the second drainage core; and wherein the mat portion of the first drainage core extends outwardly from the first end of the upward extending portion of the first drainage core in a direction away from the second drainage core, and the mat portion of the second drainage core extends outwardly from the first end of the upward extending portion of the second drainage core in a direction away from the first drainage core;

a first cavity bounded by the exterior surface of the conduit, the upward extending portion of the first drainage core, and the upward extending portion of the second drainage core; and a second cavity formed by an interconnection of the interior cavity of the conduit, the first plurality of passages of the first drainage core, and the first plurality of passages of the second drainage core.

9. The drainage and ventilation system of claim 8, wherein first drainage core further includes a second plurality of passages extending therethrough orthogonal to the first plurality of passages of the first drainage core.

10. The drainage and ventilation system of claim 9, wherein second drainage core further includes a second plurality of passages extending therethrough orthogonal to the first plurality of passages of the second drainage core.

11. The drainage and ventilation system of claim 8, wherein the mat portion of at least one of the first drainage core and the second drainage core is disposed in a horizontal position relative to the upward extending portion of the at least one of the first drainage core and the second drainage core.

12. The drainage and ventilation system of claim 8, wherein the mat portion of at least one of the first drainage core and the second drainage core is disposed in a sloped horizontal position relative to the upward extending portion of the at least one of the first drainage core and the second drainage core.

13. The drainage and ventilation system of claim 8, further comprising:

an air exchange unit in communication with at least one of the conduit, the first drainage core and the second drainage core.

14. The drainage and ventilation system of claim 8, further comprising:

a plurality of the drainage and ventilation systems disposed in soil; and wherein the conduit of each of the plurality of drainage and ventilation systems is perforated and the fabric of each system is permeable, and wherein the conduit and the fabric of each system receive a flow of at least one of liquid, air and gas from the soil.

15. The drainage and ventilation system of claim 14, wherein the first and second drainage cores of each of the plurality of drainage and ventilation systems are permeable, and wherein the first drainage core, the second drainage core and the fabric of each system receive the flow of the at least one of liquid, air and gas.

16. The drainage and ventilation system of claim 14, further comprising:

a plurality of drainage conduits disposed in the soil, each of the plurality of drainage conduits having an interior cavity; and wherein at least one of the plurality of drainage conduits is interconnected to the conduit of at least one of the plurality of drainage and ventilation systems to capture, retain and move the flow of the at least one of liquid, air and gas from the conduit, the first drainage core, and the second drainage core of the at least one of the plurality of drainage and ventilation systems and to distribute the flow within the plurality of drainage conduits.

17. The drainage and ventilation system of claim 16, wherein the flow of the at least one of liquid, air and gas through the conduit, the first drainage core, and the second drainage core of the at least one of the plurality of drainage and ventilation systems and through the plurality of drainage conduits promotes thermal conductivity throughout the drainage and ventilation system.

18. The drainage and ventilation system of claim 16, wherein the plurality of the drainage and ventilation systems are disposed in a plurality of rows spanning a length of the soil, and the plurality of drainage conduits are disposed in a plurality of columns spanning a width of the soil; and wherein at an intersection of a respective one of the plurality of rows of the plurality of the drainage and ventilation systems and a respective one of the plurality of columns of the plurality of drainage conduits, the at least one of the plurality of drainage conduits interconnects to the conduit of the at least one of the plurality of drainage and ventilation systems that is disposed in a stack configuration above the intersection of the respective one of the plurality of columns.

19. The drainage and ventilation system of claim 18, further comprising:

a plurality of third drainage cores disposed in the soil in a side-by-side arrangement, each of the plurality of third drainage cores having a mat portion including a third plurality of passages extending therethrough, at least one of the plurality of third drainage cores interconnected to the mat portion of at least one of the first drainage cores and the second drainage cores of the plurality of the drainage and ventilation systems.

20. The drainage and ventilation system of claim 19, wherein at least one of the plurality of third drainage cores includes a flexible wall portion for accommodating expansion and contraction of the at least one of the plurality of third drainage cores.

21. The drainage and ventilation system of claim 19, further comprising:

a joining member having a first interior cavity and a second interior cavity, wherein each of the first interior cavity and the second interior cavity of the joining member is adapted to receive and to interconnect at least one of the plurality of third drainage cores and the mat portion of at least one of the first drainage cores and the second drainage cores of the plurality of the drainage and ventilation systems.

22. The drainage and ventilation system of claim 19, wherein the mat portions of the plurality of first drainage cores, the plurality of second drainage cores, and the plurality of third drainage cores provide decreased impact resistance to the soil.

* * * * *